US009917369B2

(12) United States Patent
Stepanenko et al.

(10) Patent No.: US 9,917,369 B2
(45) Date of Patent: Mar. 13, 2018

(54) COMPACT BROADBAND ANTENNA SYSTEM WITH ENHANCED MULTIPATH REJECTION

(71) Applicant: Limited Liability Company "Topcon Positioning Systems", Moscow (RU)

(72) Inventors: Anton Pavlovich Stepanenko, Moscow (RU); Andrey Vitalievich Astakhov, Moscow (RU); Dmitry Vitalievich Tatarnikov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 0 days.

(21) Appl. No.: 15/520,208

(22) PCT Filed: Sep. 23, 2015

(86) PCT No.: PCT/RU2015/000597
§ 371 (c)(1),
(2) Date: Apr. 19, 2017

(87) PCT Pub. No.: WO2017/052400
PCT Pub. Date: Mar. 30, 2017

(65) Prior Publication Data

US 2017/0358863 A1 Dec. 14, 2017

(51) Int. Cl.
*H01Q 1/28* (2006.01)
*H01Q 9/04* (2006.01)
(Continued)

(52) U.S. Cl.
CPC ..... *H01Q 9/0428* (2013.01); *H01Q 1/28* (2013.01); *H01Q 1/38* (2013.01); *H01Q 1/48* (2013.01); *H01Q 5/30* (2015.01); *H01Q 13/10* (2013.01)

(58) Field of Classification Search
CPC .. H01Q 9/04; H01Q 5/30; H01Q 1/28; H01Q 1/38; H01Q 1/48; H01Q 13/10
(Continued)

(56) References Cited

U.S. PATENT DOCUMENTS 5,694,136 A 12/1997 Westfall
5,986,615 A 11/1999 Westfall et al.
(Continued)

FOREIGN PATENT DOCUMENTS

RU 2368040 C1 9/2009
RU 2419930 C2 5/2011
(Continued)

OTHER PUBLICATIONS

International Search Report and Written Opinion dated Jun. 20, 2016 in connection with international patent Application No. PCT/RU2015/000597, 5 pages.

*Primary Examiner* — Andrea Lindgren Baltzell
(74) *Attorney, Agent, or Firm* — Chiesa Shahinian & Giantomasi PC

(57) ABSTRACT

An antenna includes a planar ground plane, a planar exciter, and a plurality of passive elements. The planar ground plane and the planar exciter are disposed orthogonal to a longitudinal axis of the antenna. The planar exciter is spaced apart from the ground plane. The planar exciter is configured to excite right-hand circularly-polarized electromagnetic radiation. The planar exciter is configured to excite first currents orthogonal to the longitudinal axis and substantially no current parallel to the longitudinal axis. The plurality of passive elements is symmetrically disposed azimuthally about the longitudinal axis and spaced apart from the planar exciter. The plurality of passive elements is electromagnetically coupled to the planar exciter. The plurality of passive elements is configured to excite second currents parallel to
(Continued)

the longitudinal axis and third currents orthogonal to the longitudinal axis.

20 Claims, 53 Drawing Sheets

(51) Int. Cl.
*H01Q 1/48* (2006.01)
*H01Q 5/30* (2015.01)
*H01Q 1/38* (2006.01)
*H01Q 13/10* (2006.01)

(58) Field of Classification Search
USPC ..... 343/705
See application file for complete search history.

(56) References Cited

U.S. PATENT DOCUMENTS

| | | | |
|---|---|---|---|
| 6,014,114 | A | 1/2000 | Westfall et al. |
| 8,624,792 | B2 | 1/2014 | Popugaev et al. |
| 8,723,731 | B2 | 5/2014 | Tatarnikov et al. |
| 2007/0146206 | A1 | 6/2007 | Sun |

FOREIGN PATENT DOCUMENTS

| | | | |
|---|---|---|---|
| RU | 2471272 | C1 | 12/2012 |
| RU | 2483404 | C2 | 5/2013 |
| WO | 2011141821 | | 11/2011 |
| WO | 2015108436 | A1 | 7/2015 |

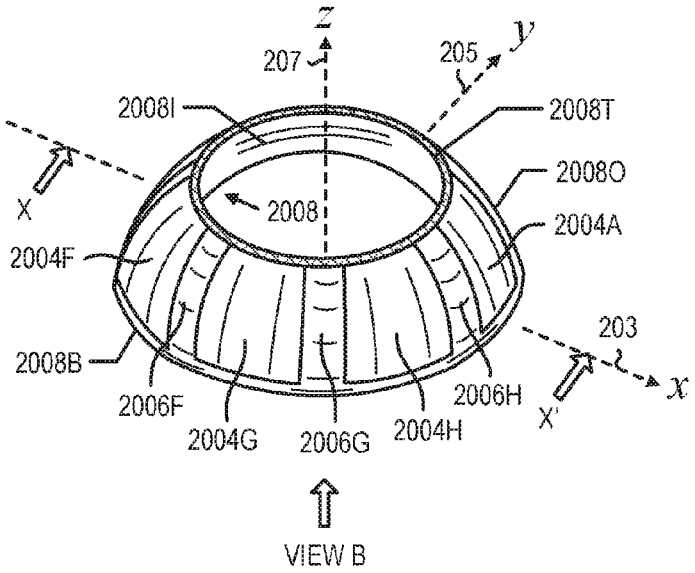
FIG. 20A
VIEW P
FIG. 20B
VIEW X-X'
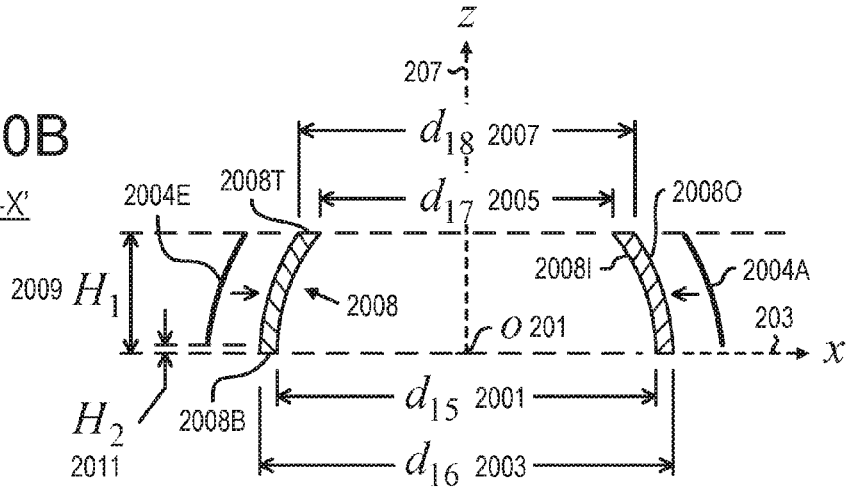
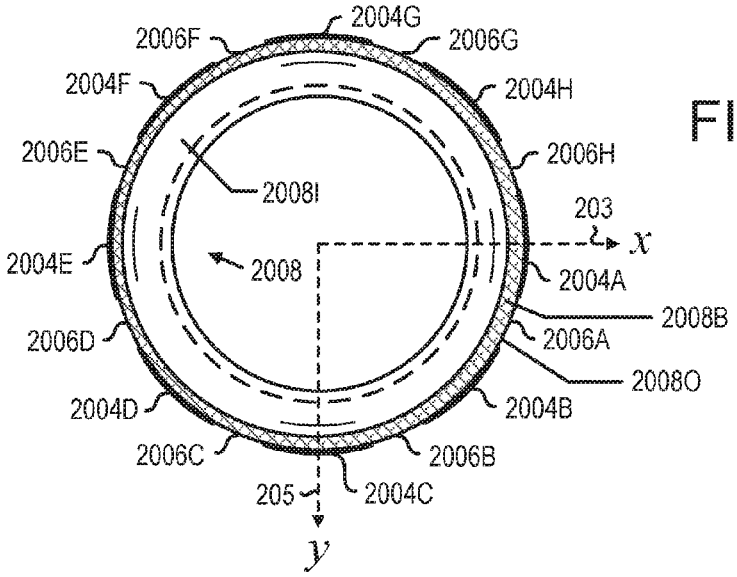
FIG. 20C
VIEW B

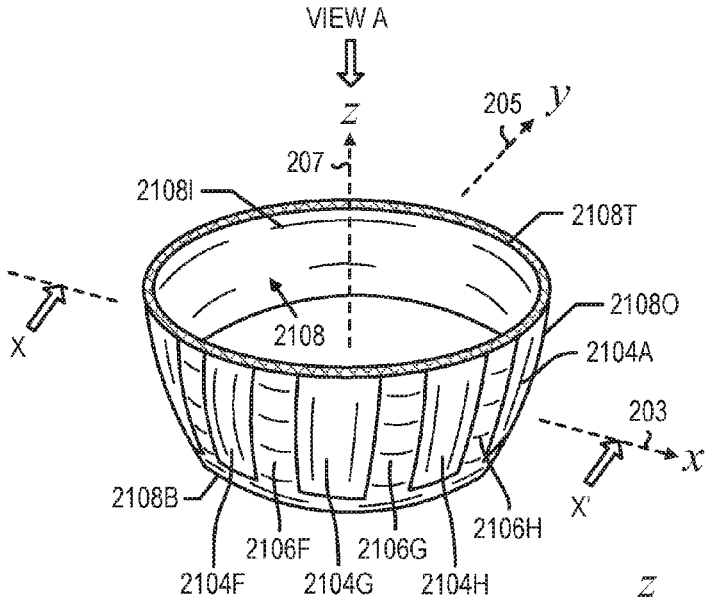
FIG. 21A
VIEW P
FIG. 21B
VIEW X-X'
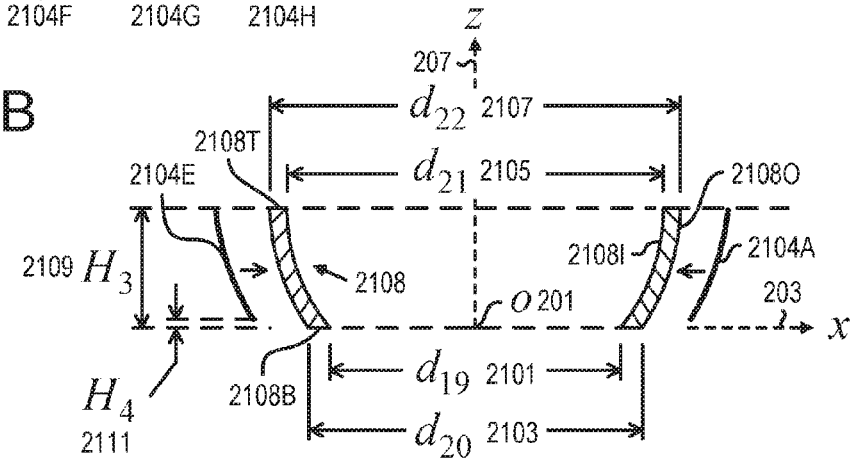
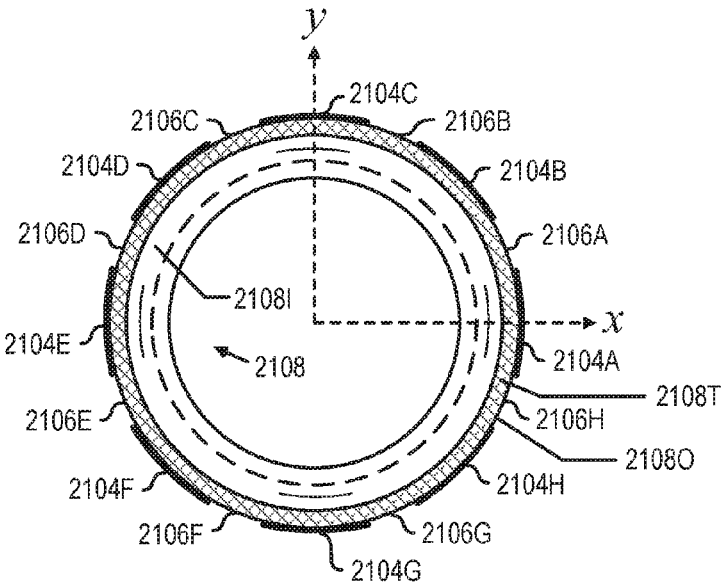
FIG. 21C
VIEW A

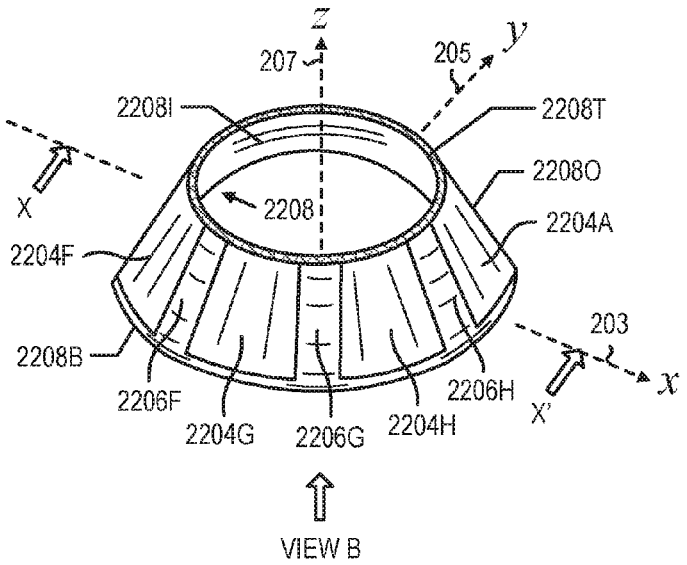
FIG. 22A
VIEW P
FIG. 22B
VIEW X-X'
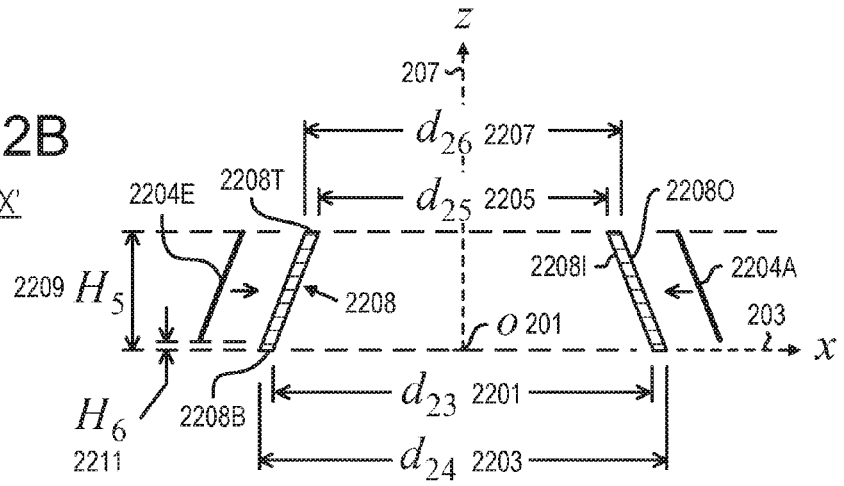
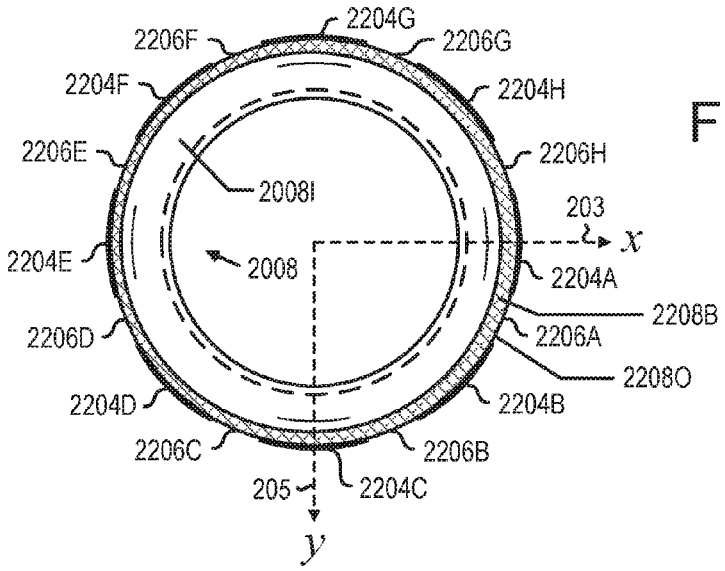
FIG. 22C
VIEW B

VIEW P

VIEW X-X'

VIEW A

VIEW P

VIEW X-X'

VIEW B

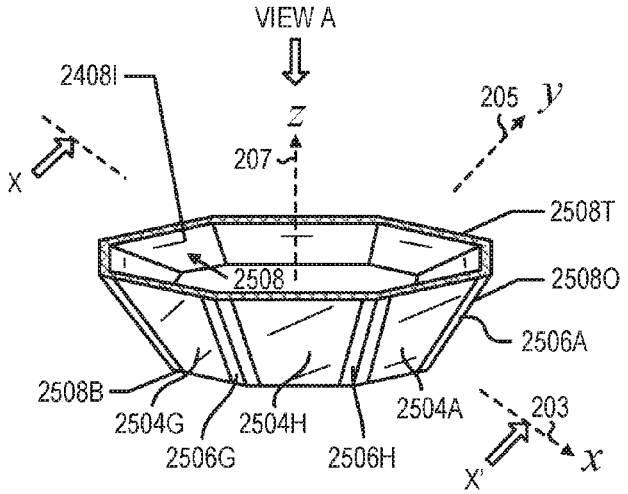
FIG. 25A
VIEW P
FIG. 25B
VIEW X-X'
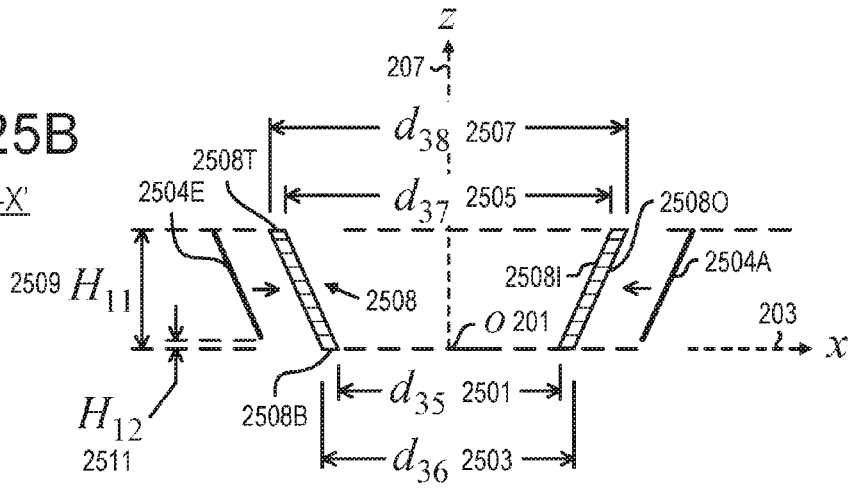
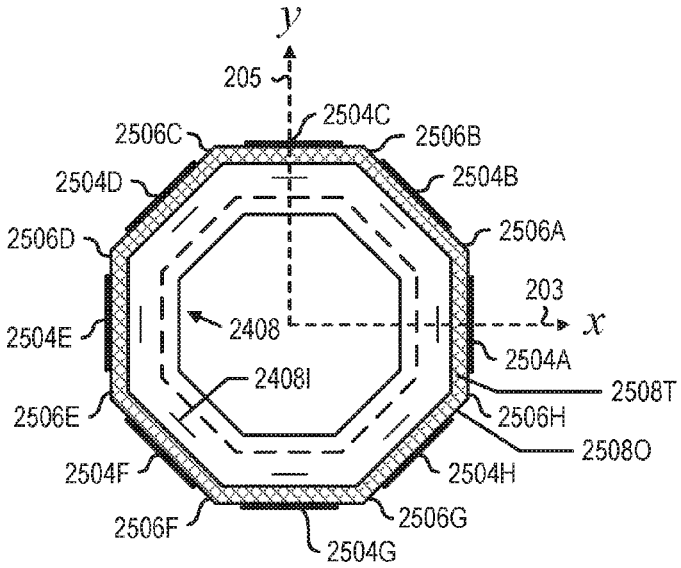
FIG. 25C
VIEW A

VIEW P

VIEW X-X'

VIEW P

VIEW P

VIEW P

VIEW P

VIEW P

VIEW P

VIEW P

VIEW X-X' + VIEW C

VIEW X-X' + VIEW C

VIEW A

VIEW A

VIEW X-X'

VIEW A

COMPACT BROADBAND ANTENNA SYSTEM WITH ENHANCED MULTIPATH REJECTION

CROSS-REFERENCE TO RELATED APPLICATIONS

This application is a national stage (under 35 U.S.C. 371) of International Patent Application No. PCT/RU2015/000597, filed Sep. 23, 2015, which is herein incorporated by reference in its entirety.

BACKGROUND OF THE INVENTION

The present invention relates generally to antennas, and more particularly to antennas for global navigation satellite systems.

Global navigation satellite systems (GNSSs) can determine positions with high accuracy. In a GNSS, a GNSS antenna receives electromagnetic signals transmitted from a constellation of GNSS satellites located within a line-of-sight of the antenna. The received electromagnetic signals are then processed by a GNSS receiver to determine the precise position of the GNSS antenna.

BRIEF SUMMARY OF THE INVENTION

In an embodiment of the invention, an antenna includes a planar ground plane, a planar exciter, and a plurality of passive elements. The planar ground plane and the planar exciter are disposed orthogonal to a longitudinal axis of the antenna. The planar exciter is spaced apart from the ground plane. The planar exciter is configured to excite right-hand circularly-polarized electromagnetic radiation. The planar exciter is configured to excite first currents orthogonal to the longitudinal axis; and the planar exciter is configured to excite substantially no current parallel to the longitudinal axis.

The plurality of passive elements is symmetrically disposed azimuthally about the longitudinal axis. The plurality of passive elements is spaced apart from the planar exciter. The plurality of passive elements is electromagnetically coupled to the planar exciter. The plurality of passive elements is configured to excite second currents parallel to the longitudinal axis and third currents orthogonal to the longitudinal axis.

These and other advantages of the invention will be apparent to those of ordinary skill in the art by reference to the following detailed description and the accompanying drawings.

BRIEF DESCRIPTION OF THE DRAWINGS

FIG. 20A-FIG. 20C show schematics of an embodiment of passive elements disposed on a dielectric substrate;

FIG. 21A-FIG. 21C show schematics of an embodiment of passive elements disposed on a dielectric substrate;

FIG. 22A-FIG. 22C show schematics of an embodiment of passive elements disposed on a dielectric substrate;

FIG. 25A-FIG. 25C show schematics of an embodiment of passive elements disposed on a dielectric substrate;

DETAILED DESCRIPTION

Figure 1:
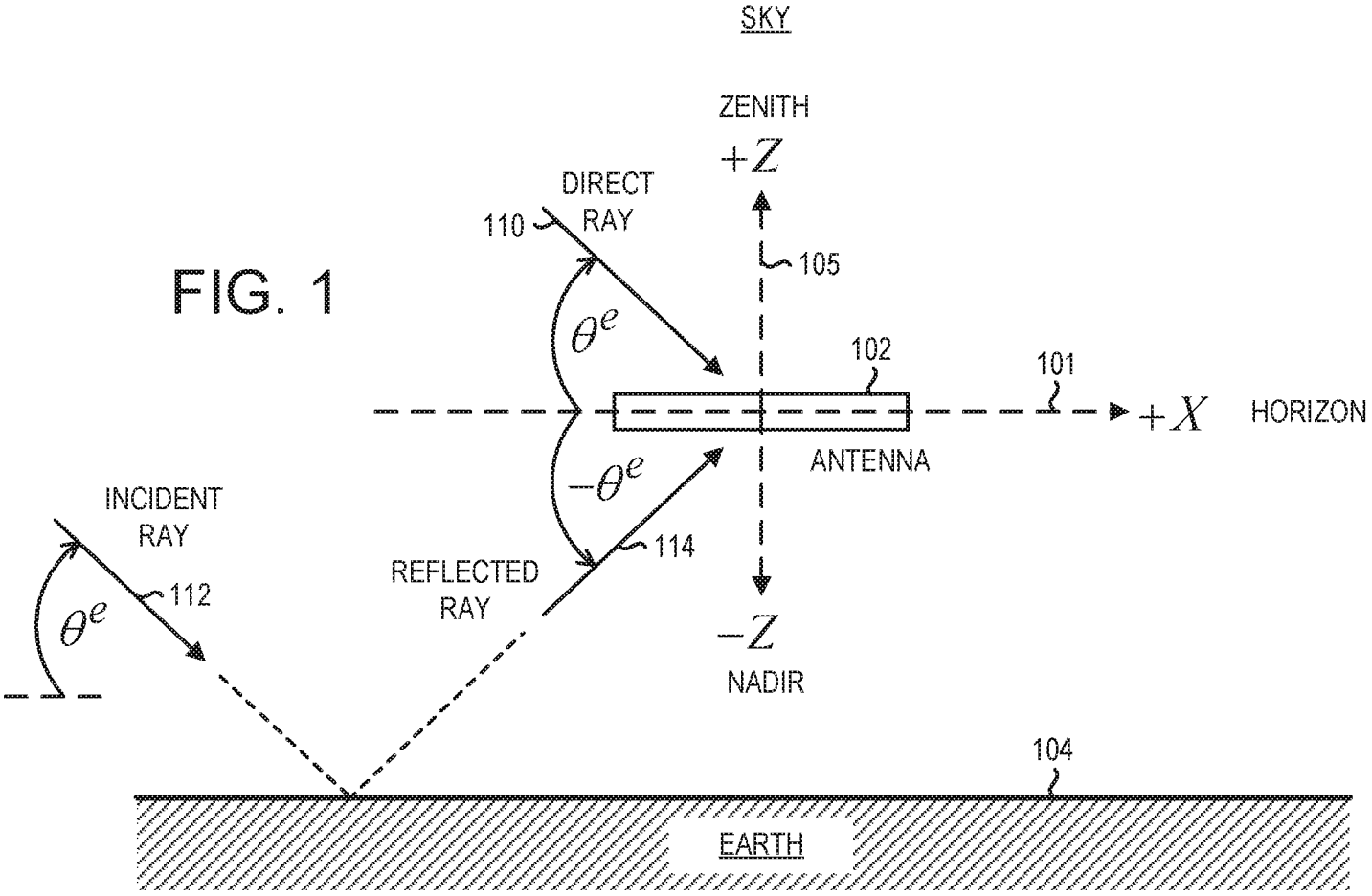
FIG. 1 shows a schematic of the direct signal region and the multipath signal region.

FIG. 1 shows a schematic of a global navigation satellite system (GNSS) antenna 102 positioned above the Earth 104. Herein, the term Earth includes both land and water environments. To avoid confusion with "electrical" ground (as used in reference to a ground plane), "geographical" ground (as used in reference to land) is not used herein. To simplify the drawing, supporting structures for the antenna are not shown. Shown is a reference Cartesian coordinate system with X-axis 101 and Z-axis 105. The Y-axis (not shown) points into the plane of the figure. In an open-air environment, the +Z (up) direction, referred to as the zenith, points towards the sky, and the −Z (down) direction, referred to as the nadir, points towards the Earth. The X-Y plane lies along the local horizon plane.

In FIG. 1, electromagnetic waves (carrying electromagnetic signals) are represented by rays with an elevation angle $\theta^e$ with respect to the horizon. The horizon corresponds to $\theta^e$=0 deg; the zenith corresponds to $\theta^e$=+90 deg; and the nadir corresponds to $\theta^e$=−90 deg. Rays incident from the open sky, such as ray 110 and ray 112, have positive values of elevation angle. Rays reflected from the Earth 104, such as ray 114, have negative values of elevation angle. Herein, the region of space with positive values of elevation angle is referred to as the direct signal region and is also referred to as the forward (or top) hemisphere. Herein, the region of space with negative values of elevation angle is referred to as the multipath signal region and is also referred to as the backward (or bottom) hemisphere. Ray 110 impinges directly on the antenna 102 and is referred to as the direct ray 110; the angle of incidence of the direct ray 110 with respect to the horizon is $\theta^e$. Ray 112 impinges directly on the Earth 104; the angle of incidence of the ray 112 with respect to the horizon is $\theta^e$. Assume ray 112 is specularly reflected. Ray 114, referred to as the reflected ray 114, impinges on the antenna 102; the angle of incidence of the reflected ray 114 with respect to the horizon is $-\theta^e$.

To numerically characterize the capability of an antenna to mitigate the reflected signal, the following ratio is commonly used:

$$DU(\theta^e) = \frac{F(-\theta^e)}{F(\theta^e)}. \tag{E1}$$

The parameter DU ($\theta^e$) (down/up ratio) is equal to the ratio of the antenna pattern level F($-\theta^e$) in the backward hemisphere to the antenna pattern level F($\theta^e$) in the forward hemisphere at the mirror angle, where F represents a voltage level. Expressed in dB, the ratio is:

$$DU(\theta^e)(\text{dB}) = 20 \log DU(\theta^e). \tag{E2}$$

A commonly used characteristic parameter is the down/up ratio at $\theta^e$=+90 deg:

$$DU_{90} = DU(\theta^e = 90°) = \frac{F(-90°)}{F(90°)}. \tag{E3}$$

In a GNSS, the antenna receives signals from a constellation of navigation satellites. The accuracy of position determination is improved as the antenna receives signals from a larger constellation of navigation satellites; in particular, from low-elevation navigation satellites (~10-15 deg above the horizon). A strong antenna pattern level over nearly the entire forward hemisphere is therefore desirable.

A major source of errors uncorrected by signal processing is multipath reception by the receiving antenna. In addition to receiving direct signals from the navigation satellites, the antenna receives signals reflected from the environment around the antenna. The reflected signals are processed along with the direct signals and cause errors in time delay measurements and errors in carrier phase measurements. These errors subsequently cause errors in position determination. An antenna that strongly suppresses the reception of multipath signals is therefore desirable.

Each navigation satellite in a GNSS can transmit right-hand circularly-polarized (RHCP) signals on one or more frequency bands (for example, on the L1, L2, and L5 frequency bands). A single-band navigation receiver receives and processes signals on one frequency band (such as L1); a dual-band navigation receiver receives and processes signals on two frequency bands (such as L1 and L2); and a multi-band navigation receiver receives and processes signals on three or more frequency bands (such as L1, L2, and L5). A single-system navigation receiver receives and processes signals from a single GNSS [such as the US Global Positioning System (GPS)]; a dual-system navigation receiver receives and processes signals from two GNSSs (such as GPS and the Russian GLONASS); and a multi-system navigation receiver receives and processes signals from three or more systems (such as GPS, GLONASS, and the planned European GALILEO). The operational frequency bands can be different for different systems. An antenna that receives signals over the full frequency range assigned to GNSSs is therefore desirable. The full frequency range assigned to GNSSs is divided into two frequency bands: the low-frequency band (about 1164 to about 1300 MHz) and the high-frequency band (about 1525 to about 1610 MHz).

For portable navigation receivers, compact size and light weight are important design factors. Low-cost manufacture is usually an important factor for commercial products. For a portable GNSS navigation receiver, therefore, an antenna with the following design factors would be desirable: high sensitivity for right-hand circularly-polarized (RHCP) signals; low sensitivity for left-hand circularly-polarized (LHCP) signals; operating frequency over the low-frequency band (about 1164 to about 1300 MHz) and the high-frequency band (about 1525 to about 1610 MHz); strong antenna pattern level over most of the forward hemisphere; strong suppression of multipath signals (weak antenna pattern level over the backward hemisphere); compact size; light weight; and low manufacturing cost.

Signals from the antenna are typically transmitted to a low-noise amplifier (LNA). The amplified signals from the LNA are then transmitted to a GNSS receiver. To minimize signal loss, the signal path between the antenna and the LNA is kept as short as possible; in advantageous embodiments, the LNA is integrated with the antenna. The LNA can be coupled to the GNSS receiver with a run of coax cable. For overall compact assembly, however, it is advantageous in some applications for the antenna (or the antenna and LNA) to be mounted directly on the case (housing) of the GNSS receiver.

In embodiments of antenna systems described herein, geometrical conditions are satisfied if they are satisfied within specified tolerances; that is, ideal mathematical conditions are not implied. The tolerances are specified, for example, by an antenna engineer. The tolerances are specified depending on various factors, such as available manufacturing tolerances and trade-offs between performance and cost. As examples, two lengths are equal if they are equal to within a specified tolerance, two planes are parallel if they are parallel within a specified tolerance, two lines are orthogonal if the angle between them is equal to 90 deg within a specified tolerance, and a circle is a circle within an associated "out-of-round" tolerance. Unless otherwise stipulated, all dimensions specified below are design choices.

For GNSS receivers, the antenna is operated in the receive mode (receive electromagnetic radiation or signals). Following standard antenna engineering practice, however, antenna performance characteristics are specified in the transmit mode (transmit electromagnetic radiation or signals). This practice is well accepted because, according to the well-known antenna reciprocity theorem, antenna performance characteristics in the receive mode correspond to antenna performance characteristics in the transmit mode.

Figure 2:
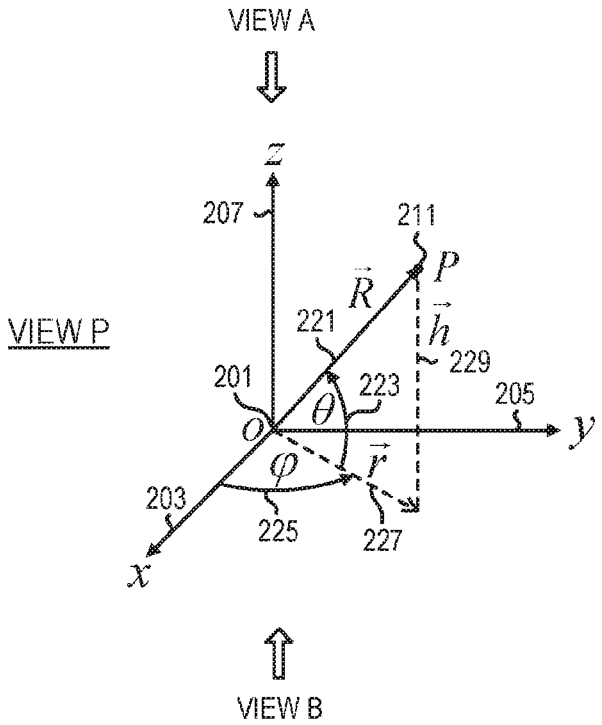
FIG. 2 shows a schematic of an antenna reference coordinate system.

The geometry of antenna systems is described with respect to the Cartesian coordinate system shown in FIG. 2 (View P, perspective view). The Cartesian coordinate system has origin o 201, x-axis 203, y-axis 205, and $z$-axis 207. The coordinates of the point P 211 are then P(x,y,$z$). Let $\vec{R}$ 221 represent the vector from o to P. The vector $\vec{R}$ can be decomposed into the vector $\vec{r}$ 227 and the vector $\vec{h}$ 229, where $\vec{r}$ is the projection of $\vec{R}$ onto the x-y plane, and $\vec{h}$ is the projection of $\vec{R}$ onto the $z$-axis.

The coordinates of P can also be expressed in the spherical coordinate system and in the cylindrical coordinate system. In the spherical coordinate system, the coordinates of P are P(R,θ,ϕ), where R=$|\vec{R}|$ is the radius, θ 223 is the polar angle measured from the x-y plane, and ϕ 225 is the azimuthal angle measured from the x-axis. In the cylindrical coordinate system, the coordinates of P are P(r,ϕ,h), where r=$|\vec{r}|$ is the radius, ϕ is the azimuthal angle, and h=$|\vec{h}|$ is the height measured parallel to the $z$-axis. In the cylindrical coordinate axis, the $z$-axis is referred to as the longitudinal axis. In geometrical configurations that are azimuthally symmetric about the $z$-axis, the $z$-axis is referred to as the longitudinal axis of symmetry, or simply the axis of symmetry if there is no other axis of symmetry under discussion.

The polar angle θ is more commonly measured down from the +$z$-axis (0≤θ≤π). Here, the polar angle θ 223 is measured from the x-y plane for the following reason. If the $z$-axis 207 refers to the $z$-axis of an antenna system, and the $z$-axis 207 is aligned with the geographic Z-axis 105 in FIG. 1, then the polar angle θ 223 will correspond to the elevation angle $\theta^e$ in FIG. 1; that is, −90°≤θ≤+90°, where θ=0° corresponds to the horizon, θ=+90° corresponds to the zenith, and θ=−90° corresponds to the nadir.

In illustrating embodiments of antenna systems, various views are used in the figures. View A is a top (plan) view, sighted along the −$z$-axis. View B is a bottom view, sighted along the +$z$-axis. Other views are defined as needed below.

Figure 3:
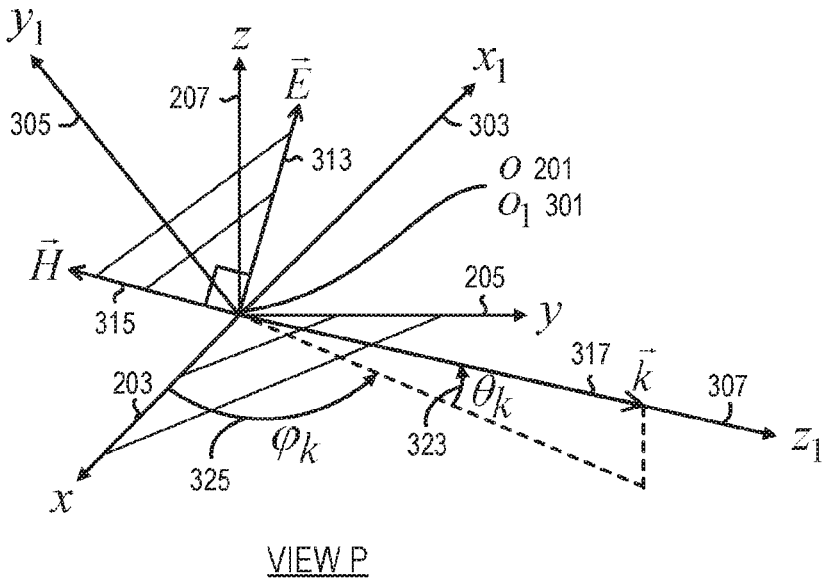
FIG. 3 shows a schematic of a linearly-polarized electromagnetic wave.

A circularly-polarized wave can be generated by the superposition of two linearly-polarized waves. Refer to FIG. 3. A linearly-polarized wave can be represented by an electric-field vector $\vec{E}$ 313, a magnetic-field vector $\vec{H}$ 315, and a wavevector $\vec{k}$ 317. The magnetic-field vector $\vec{H}$ is perpendicular to the electric-field vector $\vec{E}$; and the wavevector $\vec{k}$ is orthogonal to the plane of $\vec{E}$ and $\vec{H}$ (the wavevector $\vec{k}$ points along the direction of the vector cross product $\vec{E}\times\vec{H}$). The polar angle $\theta_k$ 323 is the polar angle of the wavevector $\vec{k}$ with respect to the x-y plane; and the azimuthal angle $\phi_k$ 325 is the azimuthal angle of the wavevector $\vec{k}$ with respect to the x-axis.

Shown in FIG. 3 is another Cartesian coordinate system defined by the origin $o_1$ 301, $x_1$-axis 303, $y_1$-axis 305, and $z_1$-axis 307. The origin $o_1$ is coincident with the origin o; the $x_1$-axis and the $y_1$-axis lie in the E-H plane; and the $z_1$-axis lies along the wavevector $\vec{k}$.

Consider a first linearly-polarized wave with the electric-field vector pointing along the unit vector $\hat{x}_1$:

$$\vec{E}_{x1}(z_1,t)=E_0\hat{x}_1\cos(kz_1-\omega t). \tag{E4}$$

Here, $E_0$ is the magnitude of the electric-field vector; ω is the angular frequency, where θ=2πf, and f is the frequency; k is the wavenumber, where k=$|\vec{k}|$=2π/λ, and λ is the wavelength; and t is the time.

Now consider a second linearly-polarized wave with the electric-field vector pointing along the unit vector $\hat{y}_1$:

$$\vec{E}_{y1}(z_1,t)=E_0\hat{y}_1\sin(kz_1-\omega t). \tag{E5}$$

The second linearly-polarized wave and the first linearly-polarized wave have the same magnitude of the electric-field vector $E_0$, the same angular frequency ω, and the same wavenumber k. The phase of the second linearly-polarized is shifted by π/4 (90 deg) with respect to the first linearly-polarized wave.

Superposition of the first linearly-polarized wave and the second linearly-polarized wave then yields the right-hand circularly-polarized (RHCP) wave with the electric field:

$$\begin{aligned}\vec{E}(z_1,t)&=\vec{E}_{x1}(z_1,t)+\vec{E}_{y1}(z_1,t)\\&=E_0[\hat{x}_1\cos(kz_1-\omega t)+\hat{y}_1\sin(kz_1-\omega t)].\end{aligned} \tag{E6}$$

Assume that the x-y-$z$ axes in FIG. 3 are parallel to the X-Y-Z axes in FIG. 1, respectively; then, for the antenna pattern to have high sensitivity over the entire forward hemisphere, the antenna pattern needs to have high sensitivity over the full range of polar angles of $0\le\theta_k\le\pi/2$ and over the full range of azimuthal angles of $0\le\phi_k\le2\pi$. In particular, when the wavevector $\vec{k}$ points along the horizon ($\theta_k$=0), the E-H plane is orthogonal to the x-y plane of the horizon.

In prior-art antennas, horizontal currents (currents parallel to the x-y plane) are provided by a radiator patch, and vertical currents (orthogonal to the x-y plane) are provided by polarization currents or currents flowing through capacitive elements. These designs are narrow-band and do not provide sufficient multipath suppression.

Figure 4:
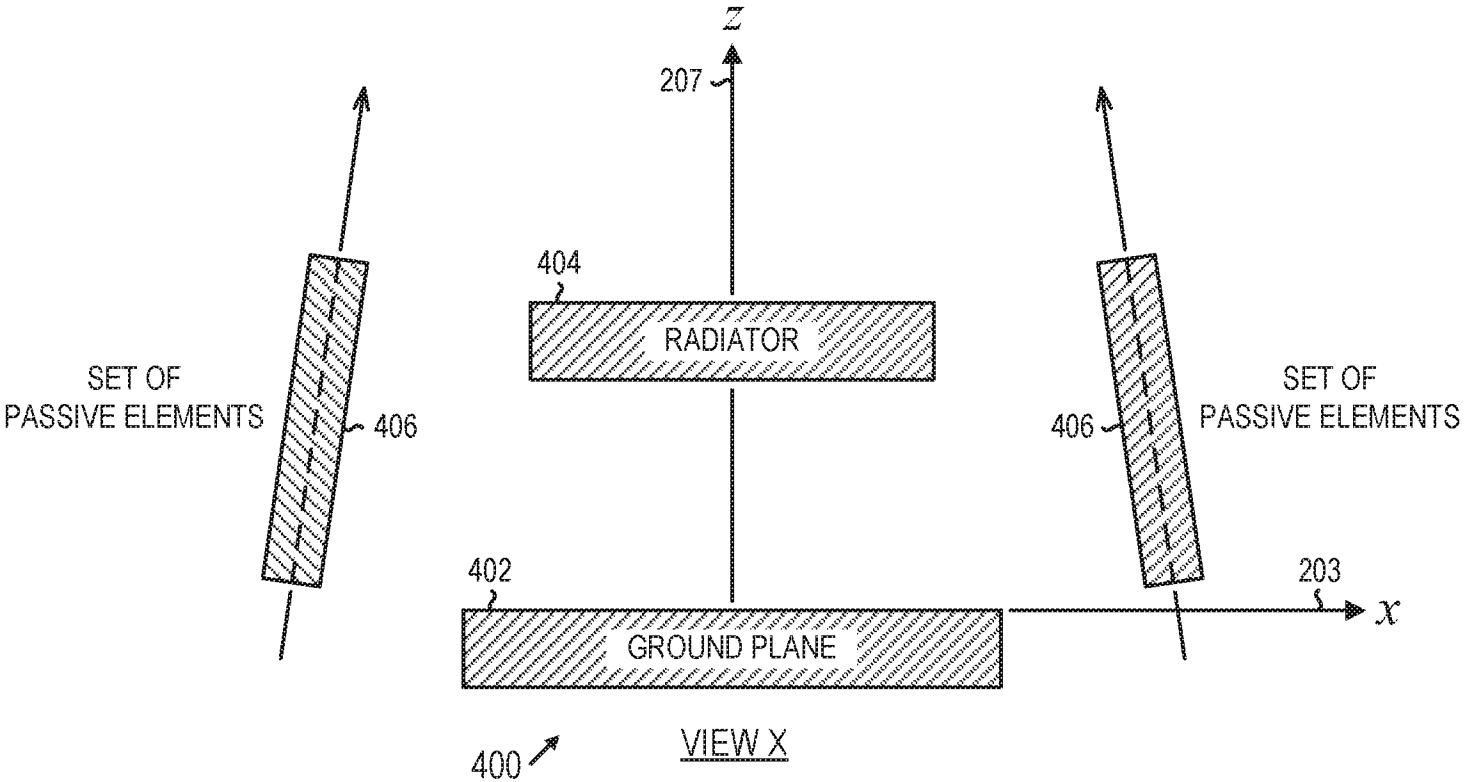
FIG. 4 shows a schematic of an embodiment of an antenna system.

FIG. 4 shows an embodiment of an antenna system, referenced as the antenna system 400. FIG. 4 shows the basic functional blocks; more details are shown in other figures below. FIG. 4 shows View X, a cross-sectional view in the x-$z$ plane, viewed along the +y-axis. The $z$-axis is referred to the longitudinal axis; the x-axis and the y-axis are referred to as lateral axes. Planes parallel to the x-y plane are referred to as lateral or horizontal planes. Planes orthogonal to the x-y plane are referred to as longitudinal or vertical planes.

The antenna system 400 includes the ground plane 402, the radiator 404, and the set of passive elements 406. The ground plane 402 and the radiator 404 form a patch antenna: the ground plane 402 is a planar conductive structure parallel to the x-y plane, and the radiator 404 is a planar conductive structure parallel to the x-y plane. The set of passive elements 406 can be a set of planar conductive structures not parallel to the x-y plane or a set of non-planar conductive structures. Herein, the term "conductive" refers to "electrically conductive".

The radiator generates horizontal currents and substantially no vertical currents (the ratio of vertical currents to horizontal currents is −20 dB or less). The set of passive elements is electromagnetically coupled to the radiator. The set of passive elements generates both horizontal currents and vertical currents. The currents generated by the set of passive elements are induced by the fields generated by the radiator. The combined fields of the currents from the radiator and the set of passive elements yield a strong antenna pattern in the forward hemisphere and a weak antenna pattern in the backward hemisphere. Wide-band operation is supported.

Projected onto the x-y plane, the ground plane 402 has the geometry of a circle or of a regular polygon with N sides, where N is an integer greater than or equal to 4. Embodiments of the ground plane 402 are described below.

Figure 5A:
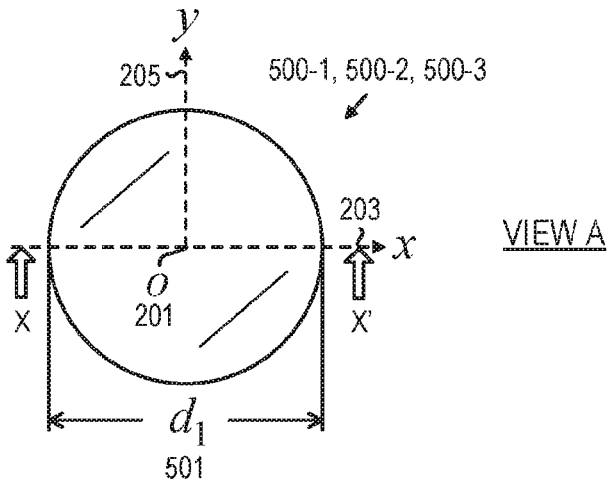
FIG. 5A-FIG. 5D show schematics of embodiments of a ground plane with a circular geometry.

Refer to FIG. 5A, which shows View A (sighted along the $-z$-axis) of three embodiments of the ground plane, referenced as the ground plane 500-1, the ground plane 500-2, and the ground plane 500-3. The ground planes have a circular geometry with a diameter $d_1$ 501, measured along the x-y plane.

View X-X' is a cross-sectional view, sighted along the +y-axis; the plane of the View X-X' is the x-$z$ plane.

Figure 5B:
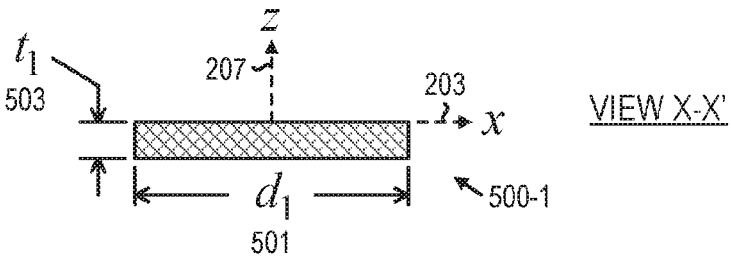

Refer to FIG. 5B. The ground plane 500-1 is fabricated from a solid conductive material, such as sheet metal. Herein, conductive materials include both metallic conductors and non-metallic conductors. Herein, conductive materials include both homogeneous materials (such as sheet copper) and heterogeneous materials (such as composites). The ground plane 500-1 has a thickness $t_1$ 503, measured along the $z$-axis.

Figure 5C:
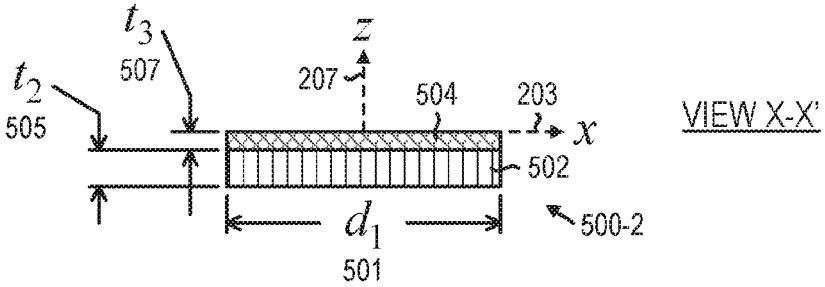

Refer to FIG. 5C. The ground plane 500-2 is fabricated from a thin film 504 of a solid conductive material, such as metal, disposed on the top surface of a dielectric substrate 502. The dielectric substrate 502, for example, can be a printed circuit board (PCB). The dielectric substrate 502 has a thickness $t_2$ 505; and the thin film 504 has a thickness $t_3$ 507.

Figure 5D:
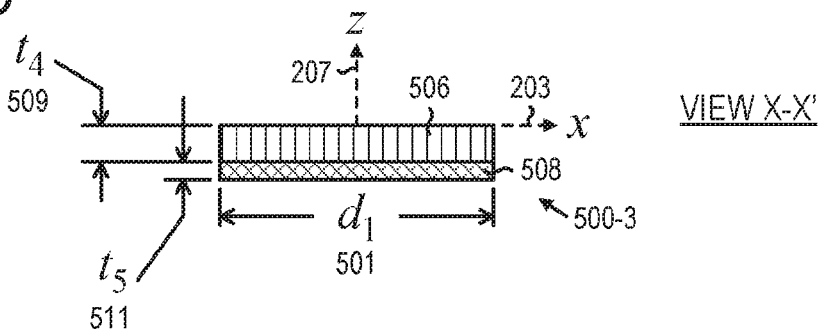

Refer to FIG. 5D. The ground plane 500-3 is fabricated from a thin film 508 of a solid conductive material, such as metal, disposed on the bottom surface of a dielectric substrate 506. The dielectric substrate 506, for example, can be a printed circuit board (PCB). The dielectric substrate 506 has a thickness $t_4$ 509; and the thin film 508 has a thickness $t_5$ 511.

Figure 6A:
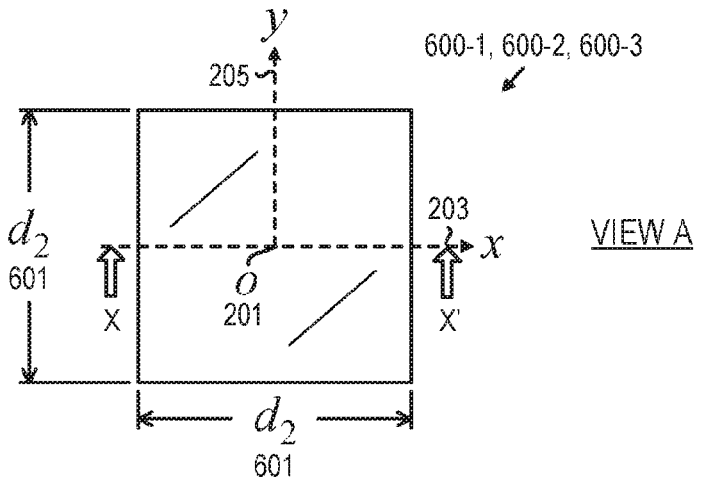
FIG. 6A-FIG. 6D show schematics of embodiments of a ground plane with a square geometry.

Refer to FIG. 6A, which shows View A (sighted along the $-z$-axis) of three embodiments of the ground plane, referenced as the ground plane 600-1, the ground plane 600-2, and the ground plane 600-3. The ground planes have a square geometry with a side length $d_2$ 601, measured along the x-y plane.

View X-X' is a cross-sectional view, sighted along the +y-axis; the plane of the View X-X' is the x-$z$ plane.

Figure 6B:
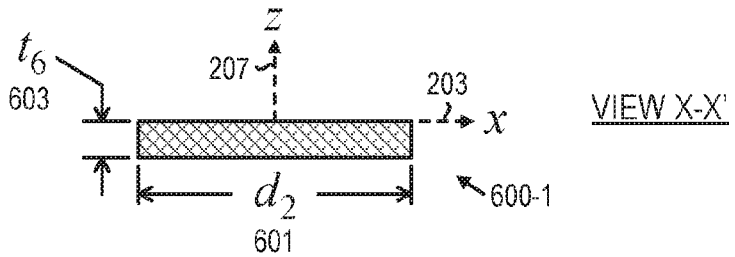

Refer to FIG. 6B. The ground plane 600-1 is fabricated from a solid conductive material, such as sheet metal. The ground plane 600-1 has a thickness $t_6$ 603, measured along the $z$-axis.

Figure 6C:
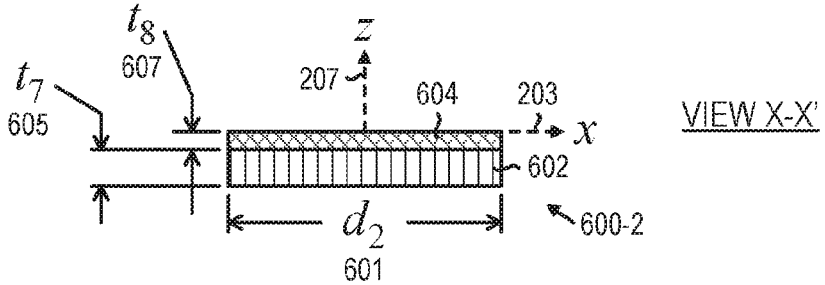

Refer to FIG. 6C. The ground plane 600-2 is fabricated from a thin film 604 of a solid conductive material, such as metal, disposed on the top surface of a dielectric substrate 602. The dielectric substrate 602, for example, can be a printed circuit board (PCB). The dielectric substrate 602 has a thickness $t_7$ 605; and the thin film 604 has a thickness $t_8$ 607.

Figure 6D:
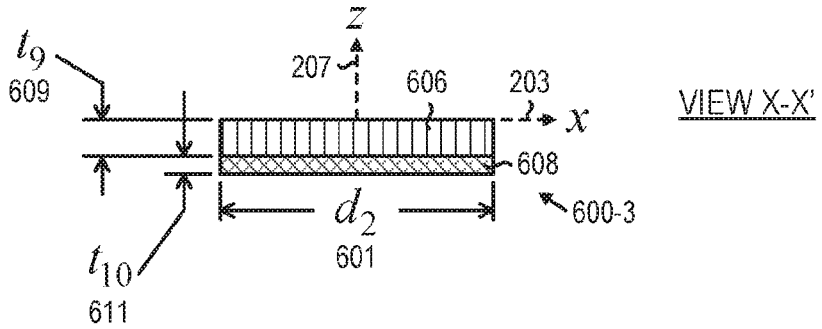

Refer to FIG. 6D. The ground plane 600-3 is fabricated from a thin film 608 of a solid conductive material, such as metal, disposed on the bottom surface of a dielectric substrate 606. The dielectric substrate 606, for example, can be a printed circuit board (PCB). The dielectric substrate 606 has a thickness $t_9$ 609; and the thin film 608 has a thickness $t_{10}$ 611.

Figure 7A:
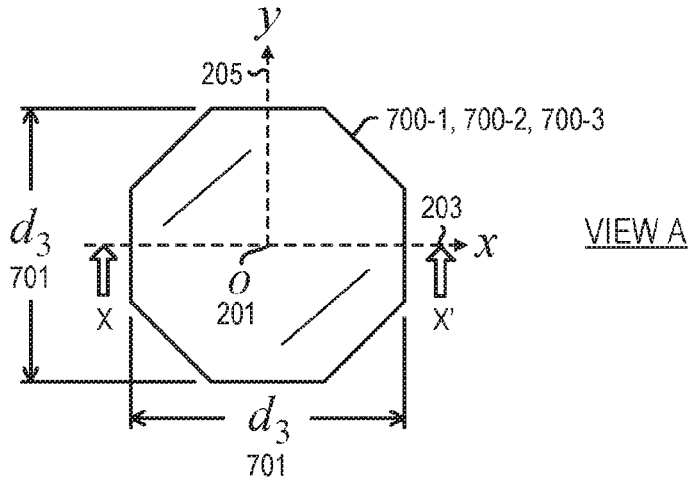
FIG. 7A-FIG. 7D show schematics of embodiments of a ground plane with an octagonal geometry.

Refer to FIG. 7A, which shows View A (sighted along the $-z$-axis) of three embodiments of the ground plane, referenced as the ground plane 700-1, the ground plane 700-2, and the ground plane 700-3. The ground planes have a regular octagonal geometry. The distance across a pair of opposite sides, measured perpendicular to the sides along the x-y plane, is $d_3$ 701.

View X-X' is a cross-sectional view, sighted along the +y-axis; the plane of the View X-X' is the x-$z$ plane.

Figure 7B:
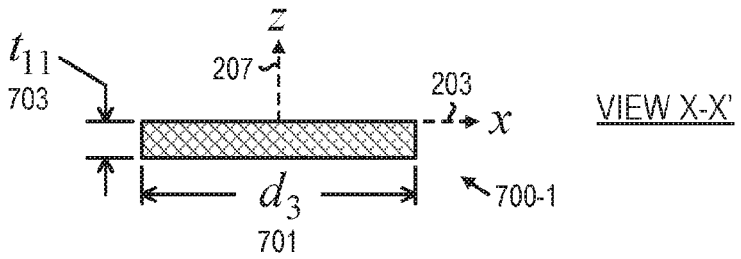

Refer to FIG. 7B. The ground plane 700-1 is fabricated from a solid conductive material, such as sheet metal. The ground plane 700-1 has a thickness $t_{11}$ 703, measured along the $z$-axis.

Figure 7C:
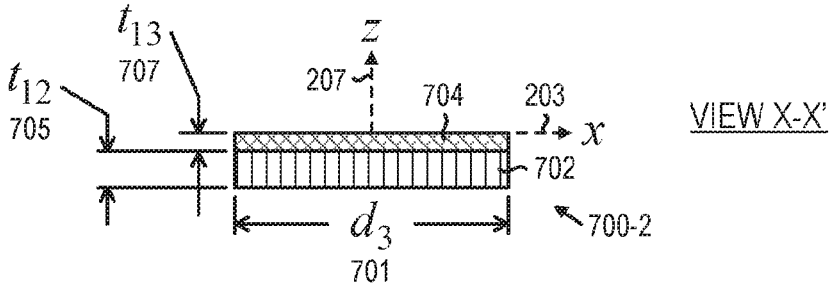

Refer to FIG. 7C. The ground plane 700-2 is fabricated from a thin film 704 of a solid conductive material, such as metal, disposed on the top surface of a dielectric substrate 702. The dielectric substrate 702, for example, can be a printed circuit board (PCB). The dielectric substrate 702 has a thickness $t_{12}$ 705; and the thin film 704 has a thickness $t_{13}$ 707.

Figure 7D:
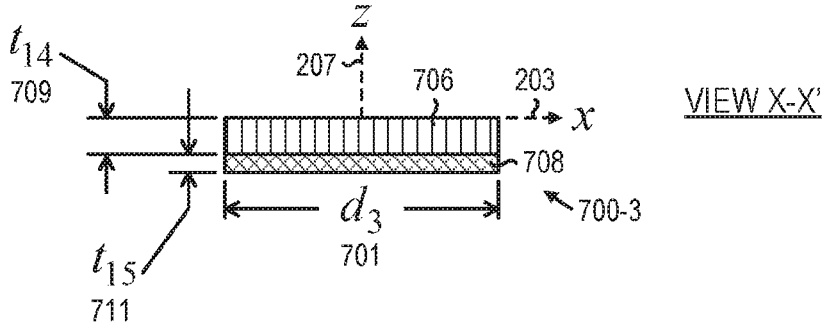

Refer to FIG. 7D. The ground plane 700-3 is fabricated from a thin film 708 of a solid conductive material, such as metal, disposed on the bottom surface of a dielectric substrate 706. The dielectric substrate 706, for example, can be a printed circuit board (PCB). The dielectric substrate 706 has a thickness $t_{14}$ 709; and the thin film 708 has a thickness $t_{15}$ 711.

Figure 8A:
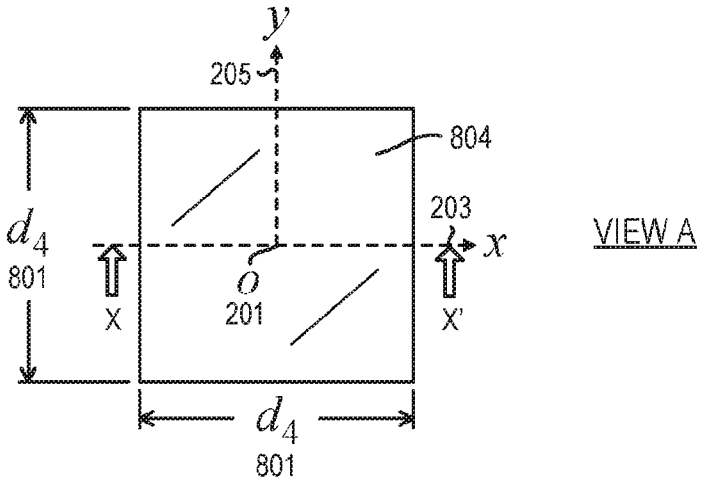
FIG. 8A-FIG. 8C show schematics of an embodiment of a ground plane integrated with a low-noise amplifier.
Figure 8B:
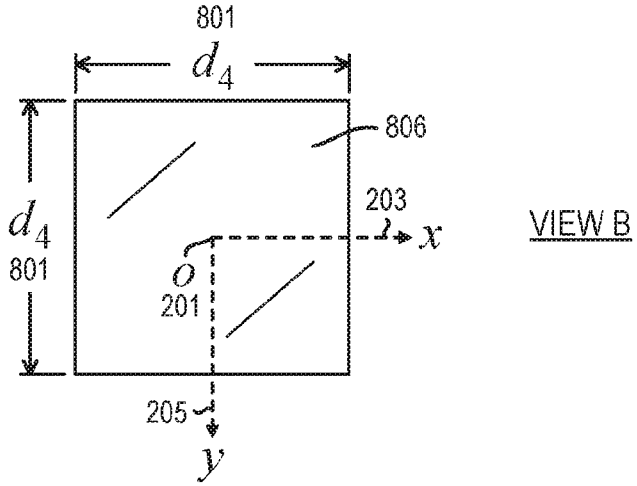
Figure 8C:
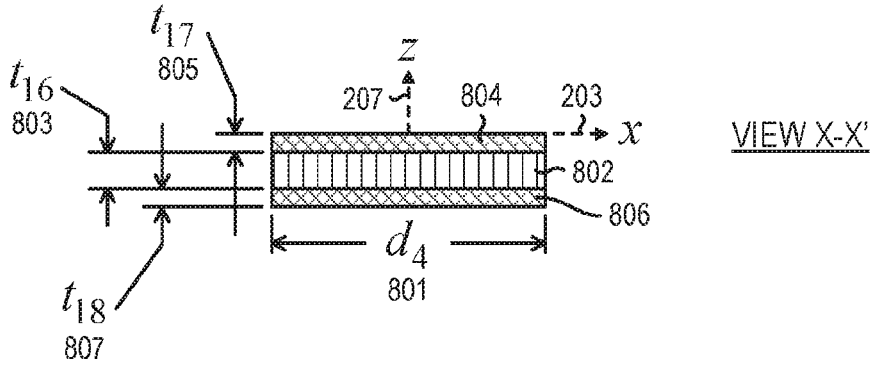

In an embodiment, the ground plane is integrated on a double-sided PCB with a low-noise amplifier (LNA). Refer to FIG. 8C, which shows a cross-sectional view (View X-X') of an integrated ground plane and LNA. The PCB 802 is double sided, with the ground plane 804 fabricated on the top metallization, and the LNA 806 fabricated on the bottom metallization. The thickness (measured along the $z$-axis) of the PCB 802 is $t_{16}$ 803; the thickness of the ground plane 804 is $t_{17}$ 805; and the thickness of the LNA 806 is $t_{18}$ 807. FIG. 8A shows the top view (View A) of the ground plane 804. FIG. 8B shows the bottom view (View B) of the LNA 806; to simplify the drawing, the traces and the components of the LNA are not shown. Low-noise amplifiers are well-known in the art, and further details are not described. In the embodiment shown in FIG. 8A, the ground plane 804 has the geometry of a square, with a side length $d_4$ 801. In general, the geometry of the ground plane can any one of the ground-plane geometries previously described. The geometry of the LNA is arbitrary.

In another embodiment, the LNA is fabricated on the top metallization, and the ground plane is fabricated on the bottom metallization. In this case, to minimize vertical polarization currents, the maximum thickness of the PCB is about 0.005λ, where λ is a representative wavelength of the electromagnetic radiation that the antenna system operates with. In practice, the thickness of the PCB is about 0.8 mm. This thickness of PCB is also used for other PCBs discussed below when needed to minimize vertical polarization currents.

Projected onto the x-y plane, the radiator 404 (FIG. 4) has a four-fold symmetry about the $z$ -axis. All embodiments of a radiator include an exciter. Other embodiments of a radiator include an auxiliary patch in addition to an exciter. Embodiments of exciters and auxiliary patches are described below.

The exciters described below have different performance characteristics. For example, the exciter 900 has the most narrow-band operation; and the exciter 1400 has the best antenna pattern azimuthal symmetry, as well as the smallest dimension.

Figure 9A:
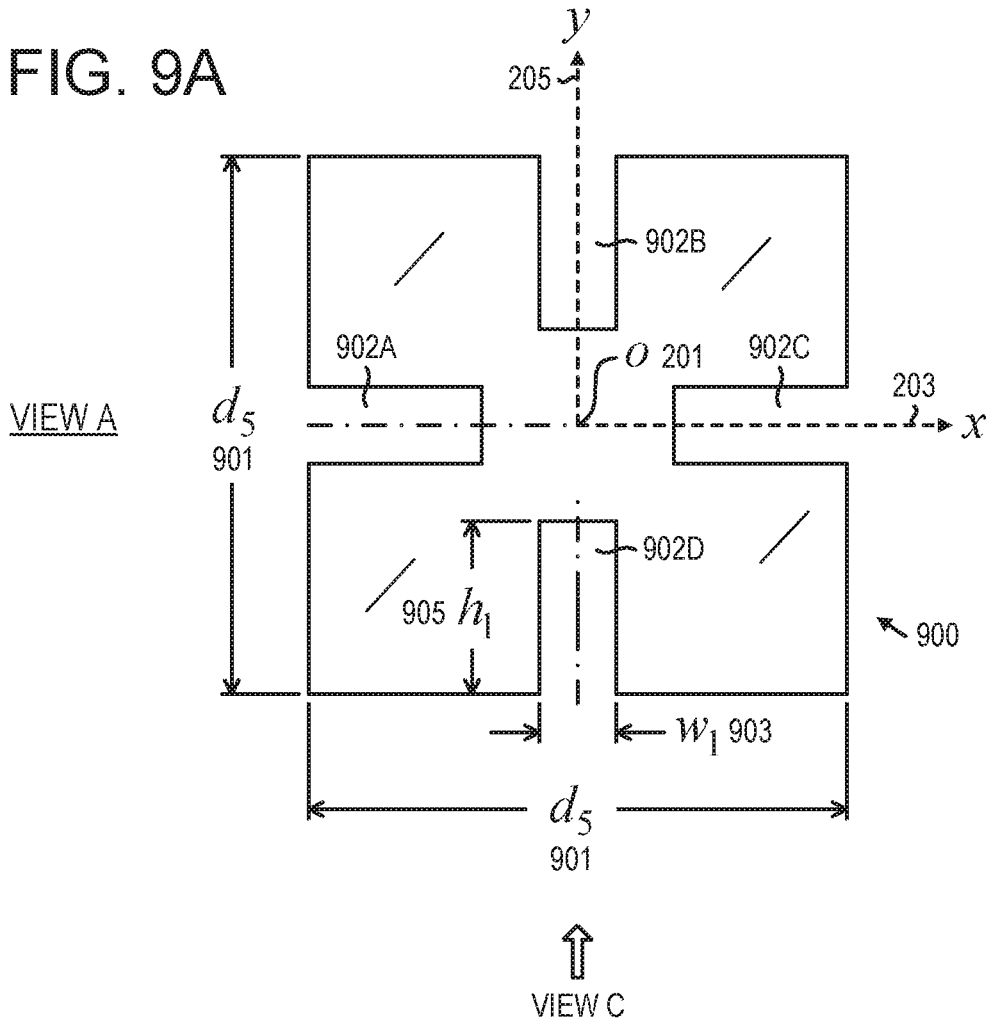
FIG. 9A and FIG. 9B show schematics of an embodiment of an exciter.
Figure 9B:
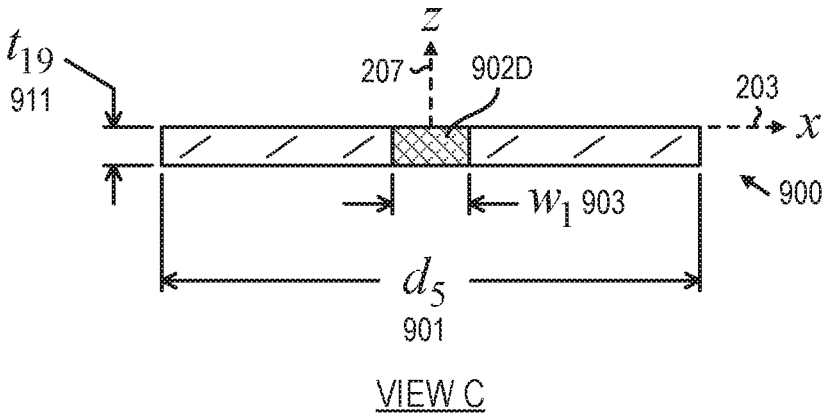

Refer to FIG. 9A and FIG. 9B. FIG. 9A shows the top view (View A, sighted along the $-z$ -axis), and FIG. 9B shows the side view (View C, sighted along the +y-axis), of the exciter 900. As shown in FIG. 9A, the exciter 900 has the general geometry of a square, with a side length $d_5$ 901. There are four slots, referenced as slot 902A-slot 902D. Each slot is symmetric about an axis perpendicular to a side of the square and intersecting the center of the side. In the embodiment shown in FIG. 9A, each slot is rectangular, with a width $w_1$ 903 and a height $h_1$ 905. In general, the slots can have other geometries, including curvilinear boundaries. The slot geometry is selected to provide a desired impedance match. The exciter 900 is fabricated from a solid conductive material, such as sheet metal. As shown in FIG. 9B, the exciter 900 has a thickness $t_{19}$ 911, measured along the $z$ -axis.

Figure 10A:
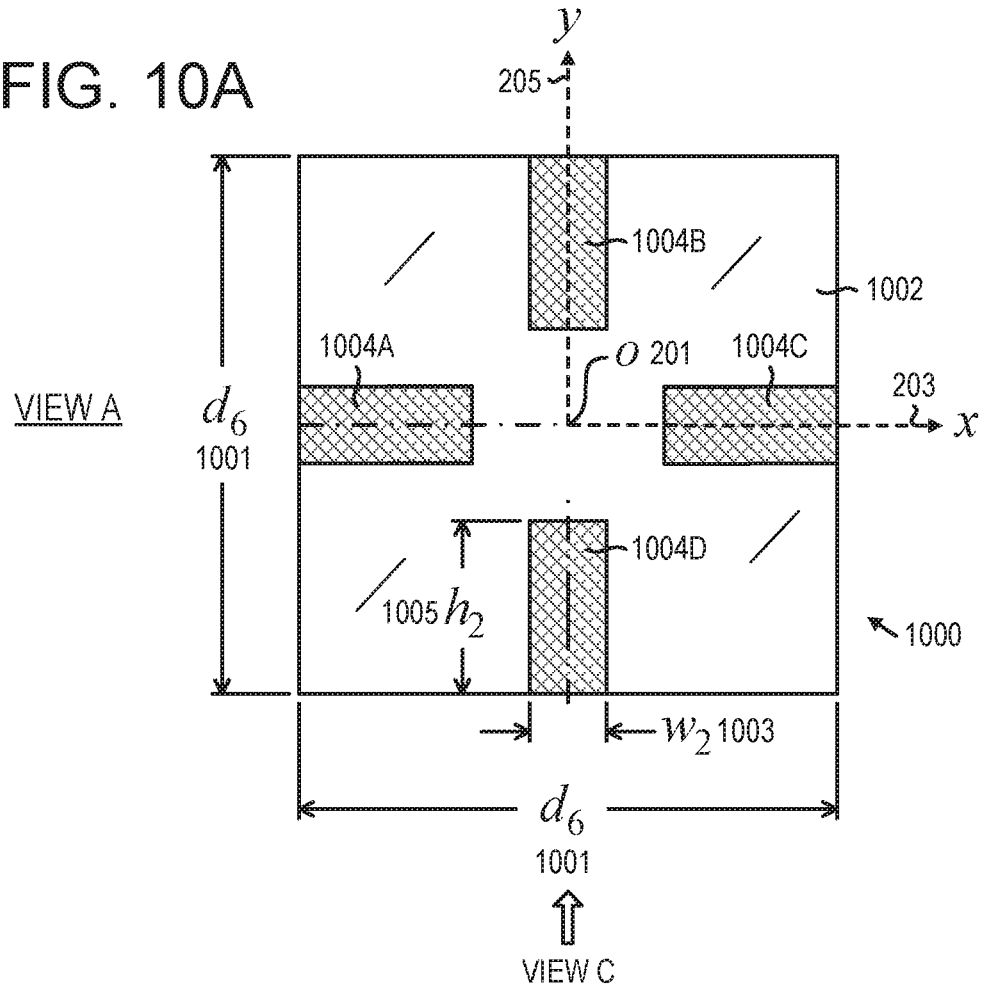
FIG. 10A and FIG. 10B show schematics of an embodiment of an exciter.
Figure 10B:
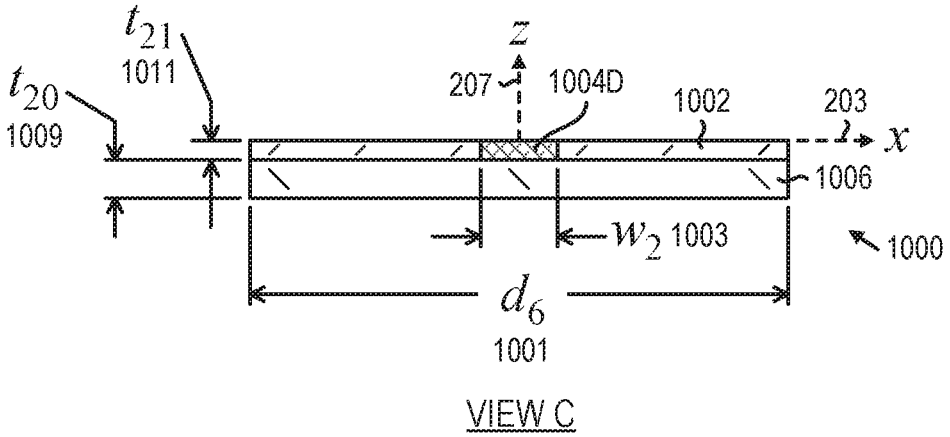

Refer to FIG. 10A and FIG. 10B. FIG. 10A shows the top view (View A, sighted along the $-z$ -axis) and FIG. 10B shows the side view (View C, sighted along the +y-axis), of the exciter 1000. As shown in FIG. 10A, the exciter 1000 has the general geometry of a square, with a side length $d_6$ 1001. Refer to FIG. 10B. The exciter 1000 is fabricated from a thin film 1002 of a conductive material, such as metal, disposed on the top surface of a dielectric substrate 1006. The dielectric substrate 1006, for example, can be a printed circuit board (PCB). The dielectric substrate 1006 has a thickness $t_{20}$ 1009, measured along the $z$ -axis; and the thin film 1002 has a thickness $t_{21}$ 1011. Refer back to FIG. 10A. There are four slots, referenced as slot 1004A-slot 1004D, through the thin film 1002. Each slot is symmetric about an axis perpendicular to a side of the square and intersecting the center of the side. In the embodiment shown in FIG. 10A, each slot is rectangular, with a width $w_2$1003 and a height $h_2$1005.

Figure 11A:
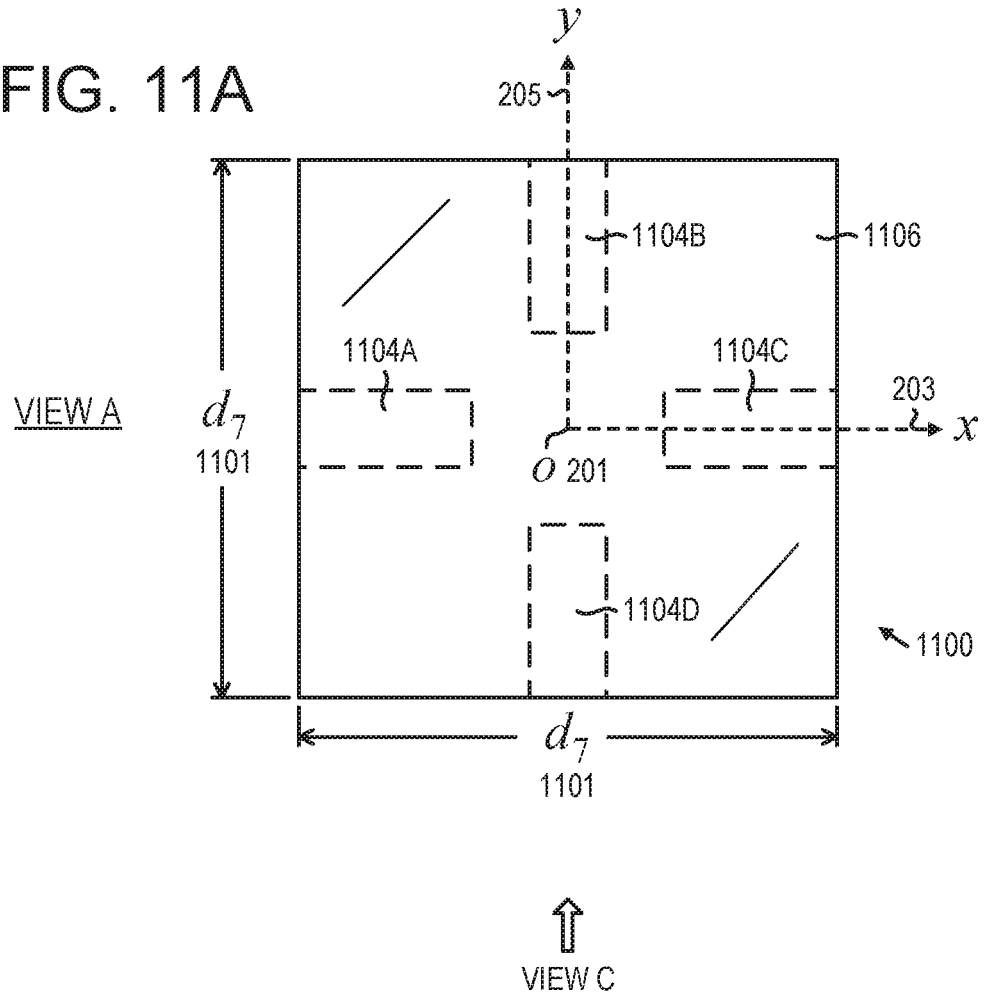
FIG. 11A-FIG. 11C show schematics of an embodiment of an exciter.
Figure 11B:
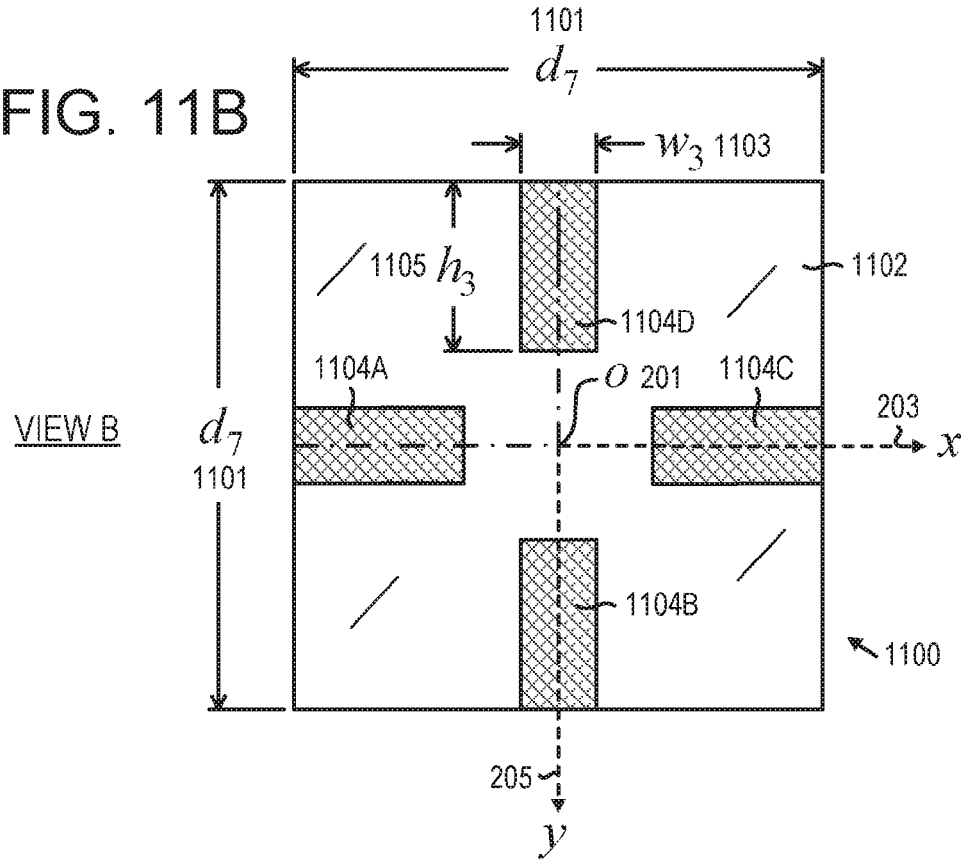
Figure 11C:
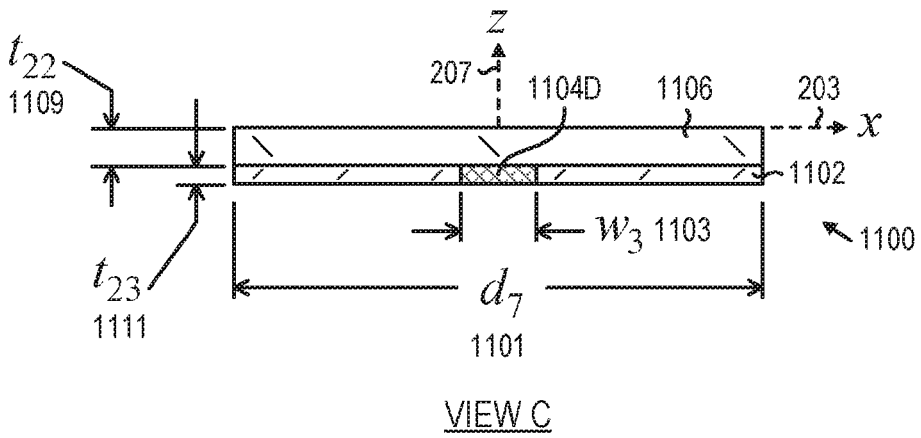

Refer to FIG. 11A-FIG. 11C. FIG. 11A shows the top view (View A, sighted along the $-z$ -axis). FIG. 11B shows the bottom view (View B, sighted along the $+z$ -axis), and FIG. 11C shows the side view (View C, sighted along the +y-axis), of the exciter 1100. As shown in FIG. 11A and FIG. 11B, the exciter 1100 has the general geometry of a square, with a side length $d_7$ 1101. Refer to FIG. 11C. The exciter 1100 is fabricated from a thin film 1102 of a conductive material, such as metal, disposed on the bottom surface of a dielectric substrate 1106. The dielectric substrate 1106, for example, can be a printed circuit board (PCB). The dielectric substrate 1106 has a thickness $t_{22}$ 1109, measured along the $z$ -axis; and the thin film 1102 has a thickness $t_{23}$ 1111. Refer back to FIG. 11B. There are four slots, referenced as slot 1104A-slot 1104D, through the thin film 1102. Each slot is symmetric about an axis perpendicular to a side of the square and intersecting the center of the side. In the embodiment shown in FIG. 11B, each slot is rectangular, with a width $w_3$ 1103 and a height $h_3$ 1105.

Figure 12A:
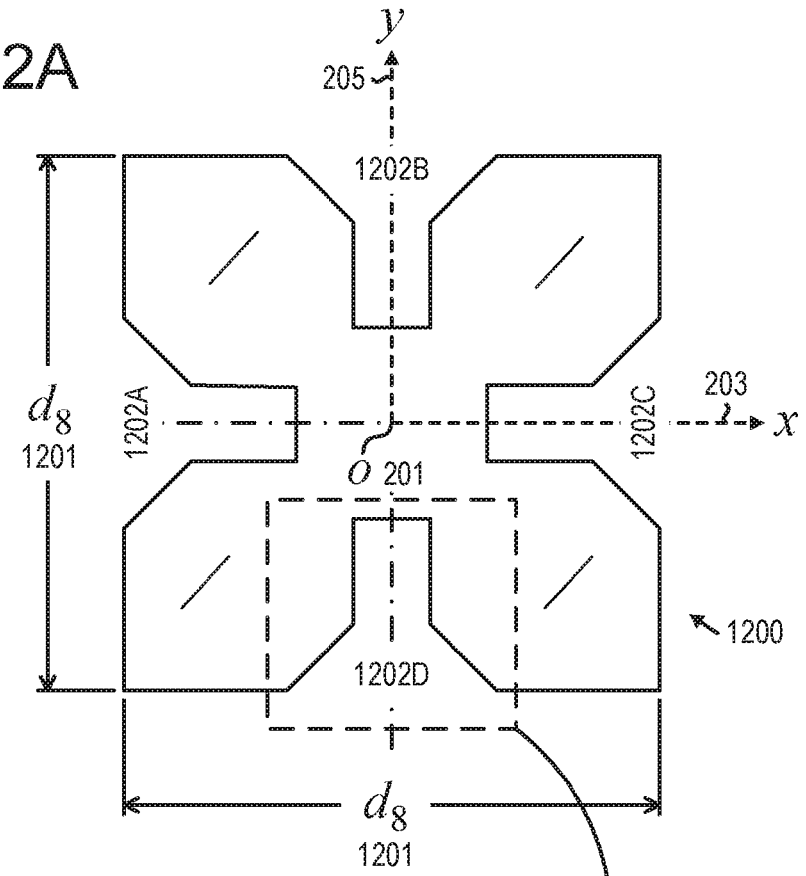
FIG. 12A and FIG. 12B show schematics of an embodiment of an exciter.
Figure 12B:
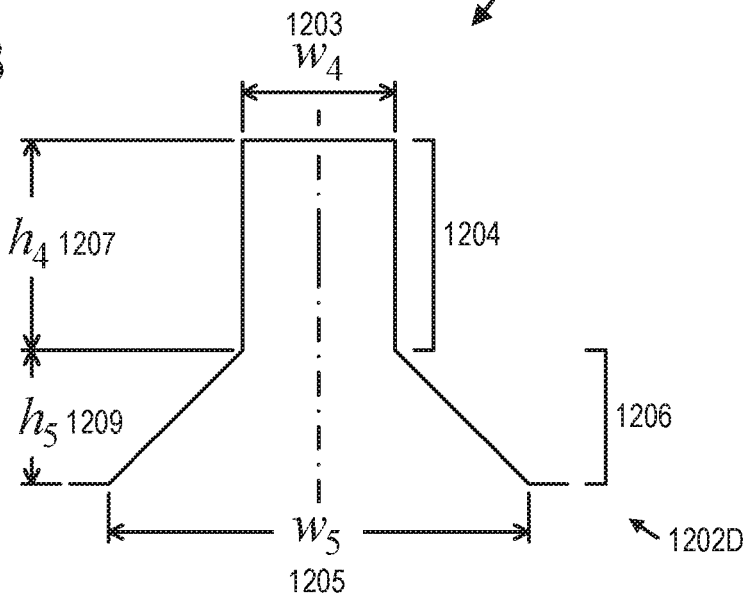

Refer to FIG. 12A and FIG. 12B. FIG. 12A shows a top view (View A) of the exciter 1200. As shown in FIG. 12A, the exciter 1200 has the general geometry of a square, with a side length $d_8$ 1201. There are four slots, referenced as slot 1202A-slot 1202D. Each slot is symmetric about an axis perpendicular to a side of the square and intersecting the center of the side. Refer to FIG. 12B, which shows an enlarged view of a representative slot, slot 1202D. The slot 1202D has a partially rectangular portion 1204 with a width $w_4$ 1203 and a height $h_4$ 1207 and a partially triangular portion with a width $w_5$ 1205 and a height $h_5$ 1209. The width $w_5$ is greater than the width $w_4$. The exciter can be fabricated from a solid conductive material, from a thin film of a solid conductive material disposed on the top surface of a dielectric substrate, or from a thin film of a solid conductive material disposed on the bottom surface of a dielectric substrate.

Figure 13A:
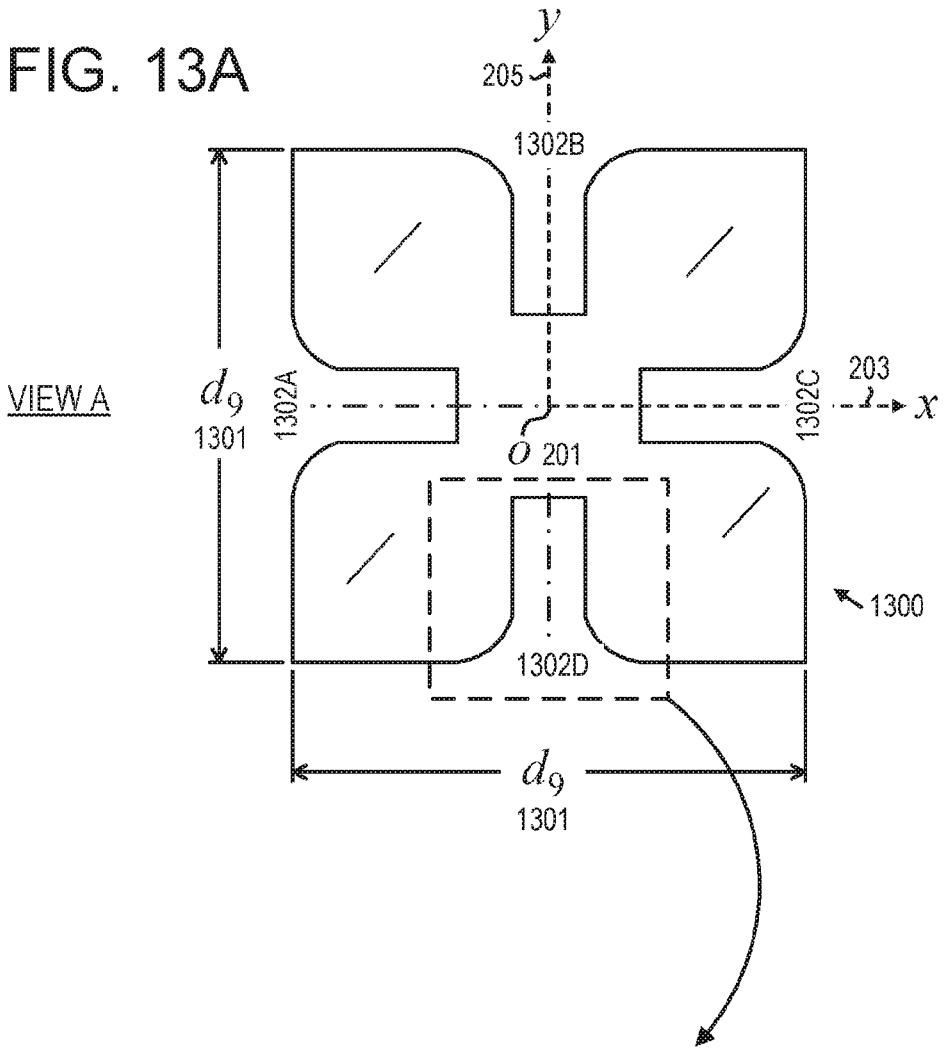
FIG. 13A and FIG. 13B show schematics of an embodiment of an exciter.
Figure 13B:
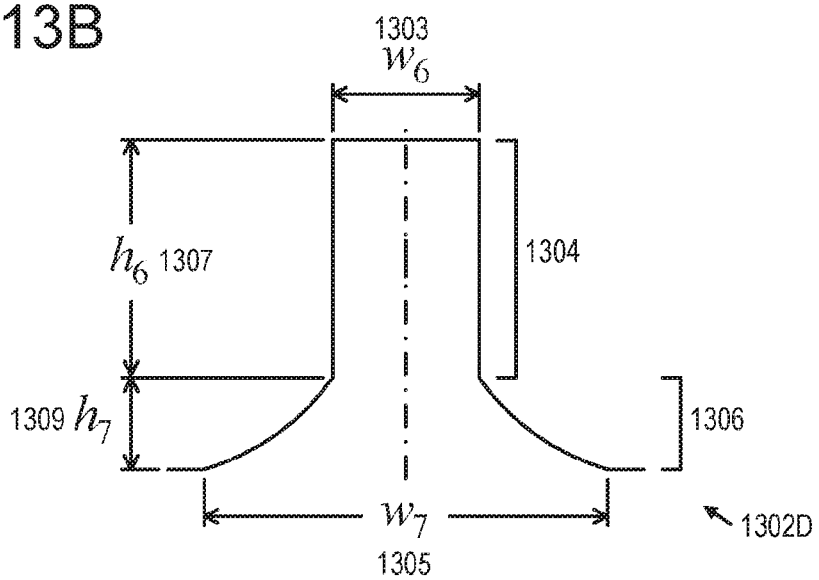

Refer to FIG. 13A and FIG. 13B. FIG. 13A shows a top view (View A) of the exciter 1300. As shown in FIG. 13A, the exciter 1300 has the general geometry of a square, with a side length $d_9$ 1301. There are four slots, referenced as slot 1302A-slot 1302D. Each slot is symmetric about an axis perpendicular to a side of the square and intersecting the center of the side. Refer to FIG. 13B, which shows an enlarged view of a representative slot, slot 1302D. The slot 1302D has a partially rectangular portion 1304 with a width $w_6$ 1303 and a height $h_6$ 1307 and a partially curvilinear portion with a width $w_7$ 1305 and a height $h_7$ 1309. The width $w_7$ is greater than the width $w_6$. The exciter can be fabricated from a solid conductive material, from a thin film of a solid conductive material disposed on the top surface of a dielectric substrate, or from a thin film of a solid conductive material disposed on the bottom surface of a dielectric substrate.

Figure 14A:
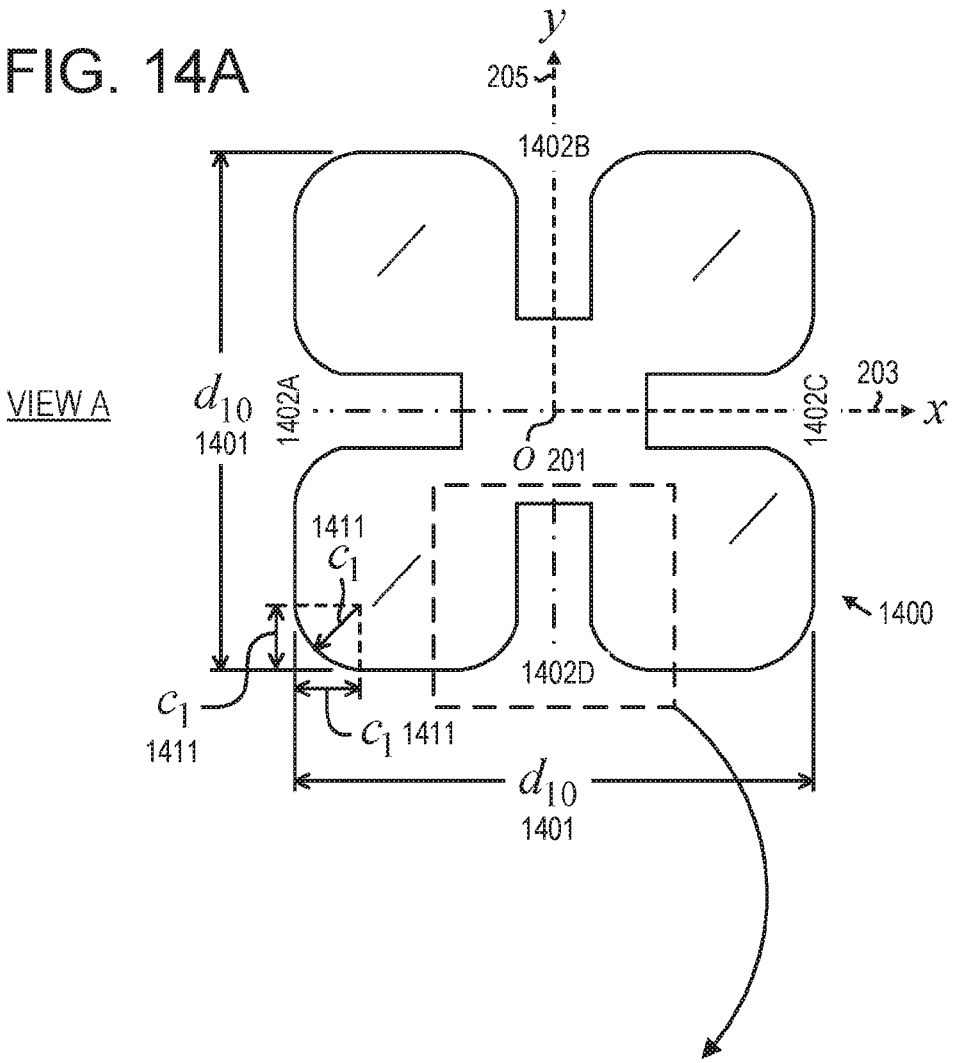
FIG. 14A and FIG. 14B show schematics of an embodiment of an exciter.
Figure 14B:
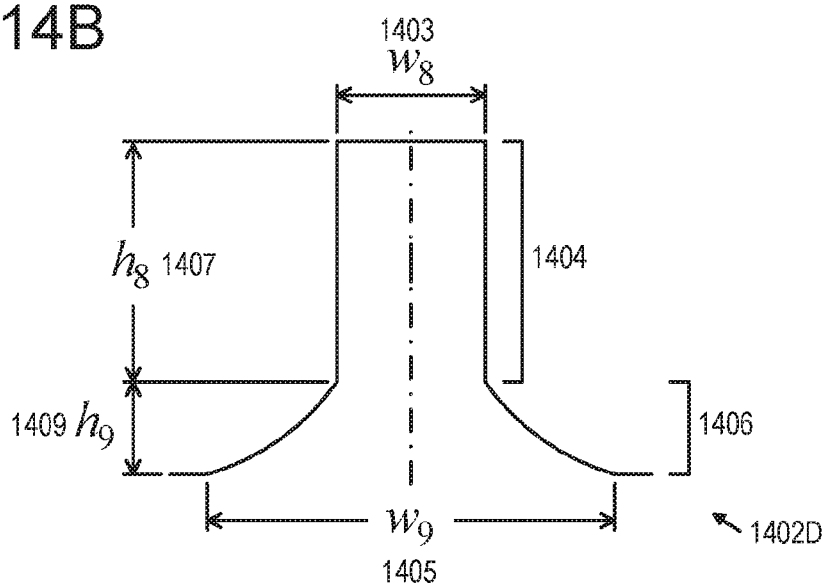

Refer to FIG. 14A and FIG. 14B. FIG. 14A shows a top view (View A) of the exciter 1400. As shown in FIG. 14A, the exciter 1400 has the general geometry of a square, with a side length $d_{10}$ 1401. The corners of the square are rounded, with a radius of curvature $c_1$ 1411. There are four slots, referenced as slot 1402A-slot 1402D. Each slot is symmetric about an axis perpendicular to a side of the square and intersecting the center of the side. Refer to FIG. 14B, which shows an enlarged view of a representative slot, slot 1402D. The slot 1402D has a partially rectangular portion 1404 with a width $w_8$ 1403 and a height $h_8$ 1407 and a partially curvilinear portion with a width $w_9$ 1405 and a height $h_9$ 1409. The width $w_9$ is greater than the width $w_8$. The exciter can be fabricated from a solid conductive material, from a thin film of a solid conductive material disposed on the top surface of a dielectric substrate, or from a thin film of a solid conductive material disposed on the bottom surface of a dielectric substrate.

Figure 38A:
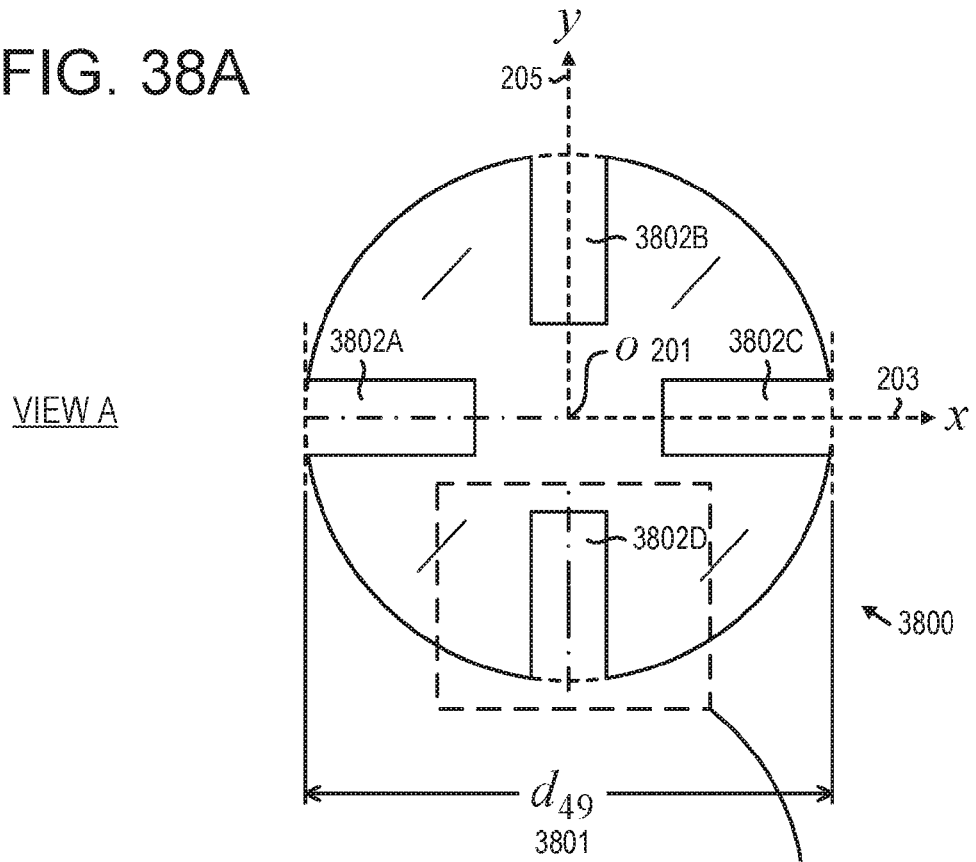
FIG. 38A and FIG. 38B show schematics of an embodiment of an exciter.
Figure 38B:
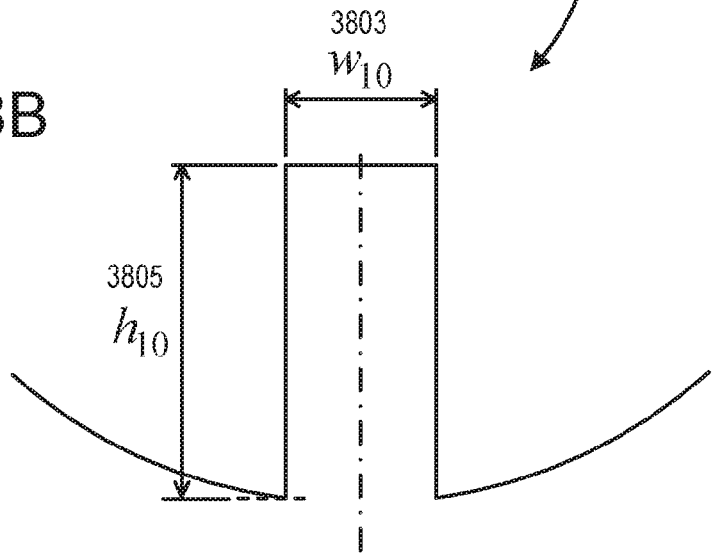

Refer to FIG. 38A and FIG. 38B. FIG. 38A shows a top view (View A) of the exciter 3800. As shown in FIG. 38A, the exciter 3800 has the general geometry of a circle, with a diameter $d_{49}$ 3801. There are four slots, referenced as slot 3802A-slot 3802D. Each slot is symmetric about an axis passing through the origin of circle. The slots are disposed 90 deg apart about the $z$-axis (not shown). Refer to FIG. 38B, which shows an enlarged view of a representative slot, slot 3802D. The slot 3802D is rectangular with a width $w_{10}$ 3803 and a height $h_{10}$ 3805. In general, other slot geometries can be used. The exciter can be fabricated from a solid conductive material, from a thin film of a solid conductive material disposed on the top surface of a dielectric substrate, or from a thin film of a solid conductive material disposed on the bottom surface of a dielectric substrate.

Figure 15A:
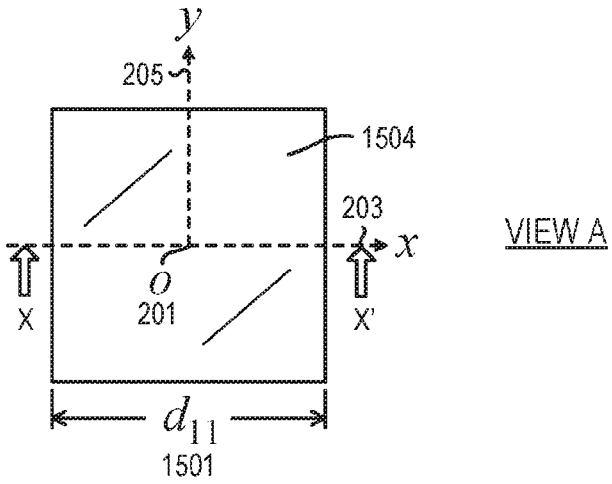
FIG. 15A-FIG. 15C show schematics of an embodiment of an exciter integrated with an excitation circuit.
Figure 15B:
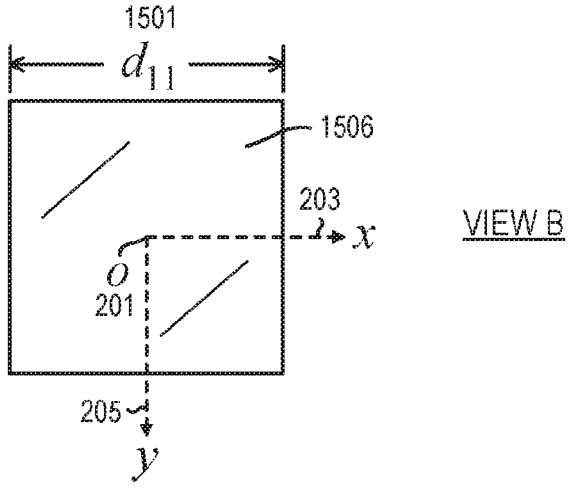
Figure 15C:
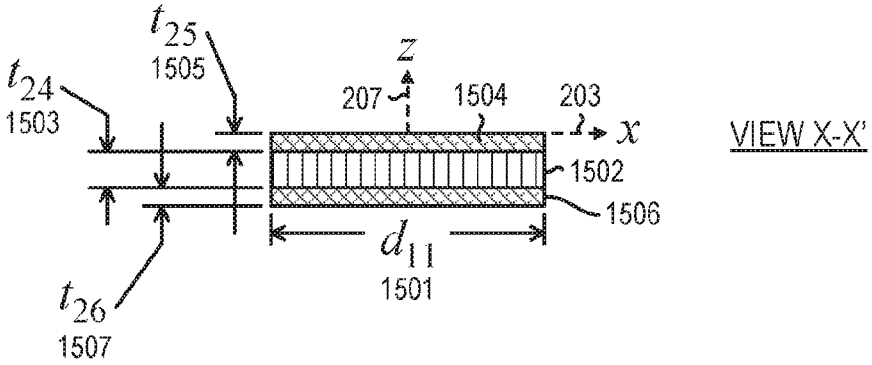

In an embodiment, the exciter is integrated on a double-sided PCB with an excitation circuit. Refer to FIG. 15C, which shows a cross-sectional view (View X-X') of an integrated exciter and excitation circuit. The PCB 1502 is double sided, with the exciter 1504 fabricated on the top metallization, and the excitation circuit 1506 fabricated on the bottom metallization. The thickness of the PCB 1502 is $t_{24}$ 1503, measured along the $z$-axis; the thickness of the exciter 1504 is $t_{25}$ 1505; and the thickness of the excitation circuit 1506 is $t_{26}$ 1507. FIG. 15A shows the top view (View A) of the exciter 1504. FIG. 15B shows the bottom view (View B) of the excitation circuit 1506; to simplify the drawing, the traces and the components of the excitation circuit are not shown (details of the excitation circuit are described below). In the embodiment shown in FIG. 15A and FIG. 15C, the exciter 1504 is represented by a square, with a side length $d_{11}$ 1501. To simplify the drawing, details of the exciter 1504 are not shown. Here the exciter 1504 represents any one of the exciters previously described. The geometry of the excitation circuit is arbitrary.

In another embodiment, the exciter is fabricated on the bottom metallization, and the excitation circuit is fabricated on the top metallization.

Figure 16A:
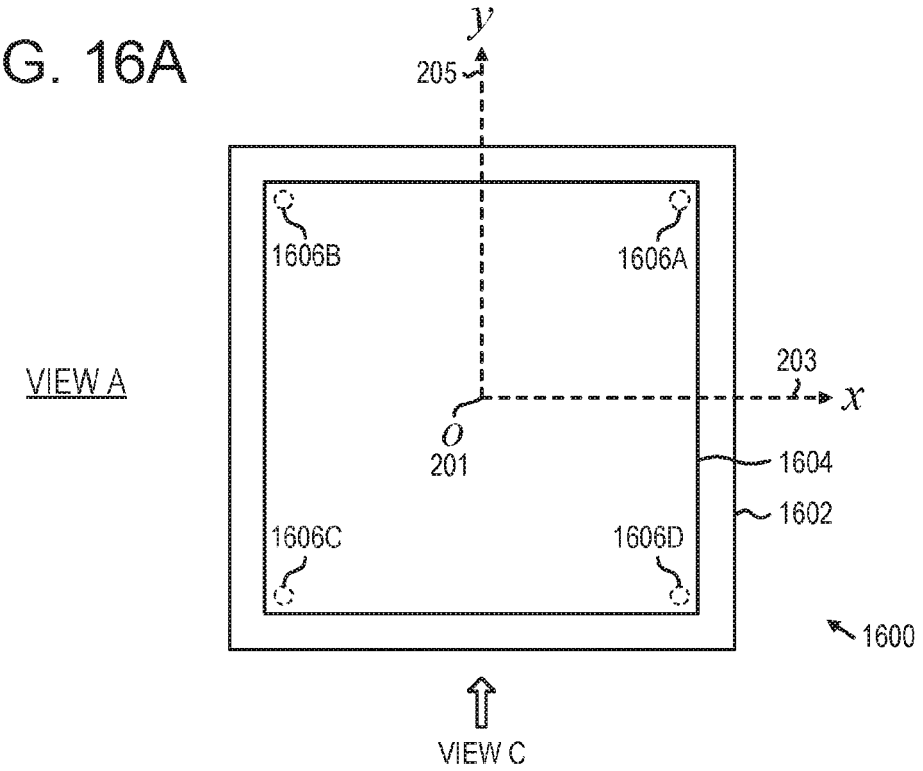
FIG. 16A and FIG. 16B show schematics of an embodiment of a radiator including an exciter and an auxiliary patch.
Figure 16B:
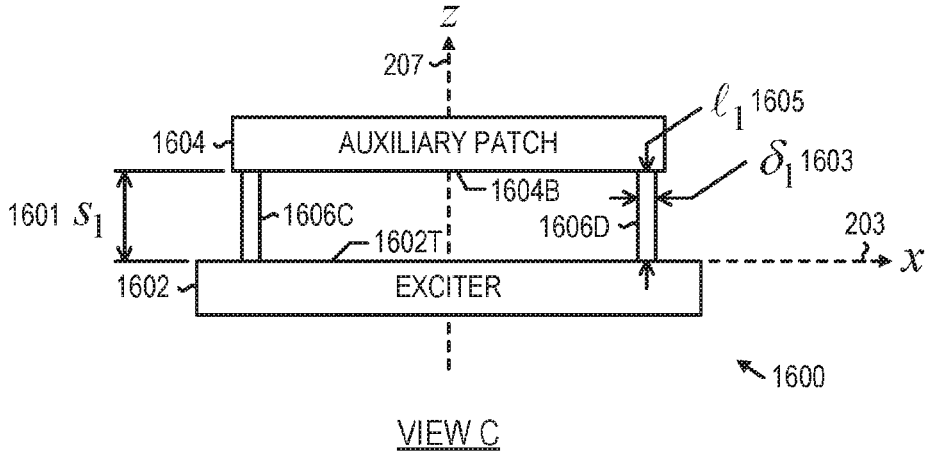

In some embodiments, the radiator 404 (FIG. 4) includes an auxiliary patch in addition to an exciter. The auxiliary patch widens the frequency band of the antenna system. Refer to FIG. 16A and FIG. 16B. FIG. 16A shows the top view (View A, sighted along the $-z$-axis), and FIG. 16B shows the side view (View C, sighted along the +y-axis), of the radiator 1600. The radiator 1600 includes the exciter 1602 and the auxiliary patch 1604. In FIG. 16A and FIG. 16B, the exciter and the auxiliary patch are represented by rectangles, details are not shown. Here the exciter 1602 represents any one of the exciters previously described. Embodiments of the auxiliary patch 1604 are described below. In general, the auxiliary patch is a planar conductor oriented parallel to the exciter and disposed above the exciter at a specified distance; the auxiliary patch and the exciter are separated by an air gap. Refer to FIG. 16B. The distance between the top surface 1602T of the exciter 1602 and the bottom surface 1604B of the auxiliary patch 1604 is the distance $s_1$ 1601, measured along the $z$-axis.

In the embodiment shown in FIG. 16A and FIG. 16B, the auxiliary patch is electromagnetically coupled to the exciter, but is not electrically connected to the exciter. For example, the auxiliary patch can be supported above the exciter by one or more thin dielectric posts. In the embodiment shown in FIG. 16A and FIG. 16B, four dielectric posts, referenced as dielectric post 1606A-dielectric post 1606D, are used; one dielectric post is placed at each corner of the auxiliary patch. The top end of each dielectric post is attached to the auxiliary patch, and the bottom end of each dielectric post is attached to the exciter. Attachment can be performed, for example, with adhesive or mechanical fasteners (examples of mechanical fasteners include screws and rivets). In general, the number and placement of the dielectric posts are design choices. The geometry of the dielectric posts is a design choice. In the embodiment shown in FIG. 16A and FIG. 16B, each dielectric post is cylindrical, with a diameter $\delta_1$ 1603 and a length $l_1$ 1605, where $l_1=s_1$. Values of $\delta_1$ and $l_1$ are design choices; the volume of the solid dielectric relative to the volume of the air gap is small (for example, in some embodiments, the ratio of the volume of the solid dielectric to the volume of the air gap is 0.02 or less). With commercially available dielectric posts, values of $\delta_1$ range from about 2 mm to about 6 mm, and values of $l_1$ range from about 3 mm to about 15 mm.

Projected onto the x-y plane, the auxiliary patch 1604 has four-fold symmetry about the $z$-axis (for example, the geometry of a circle or of a regular polygon with 4N sides, where N is an integer greater than or equal to one). Embodiments of the auxiliary patch 1604 are described below.

Figure 17A:
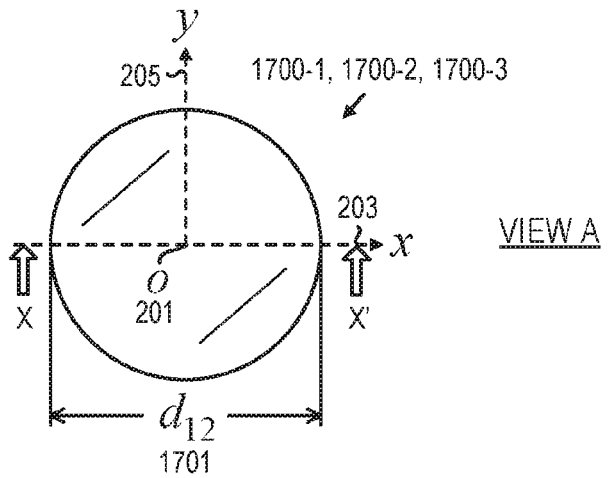
FIG. 17A-FIG. 17D show schematics of embodiments of an auxiliary patch with a circular geometry.

Refer to FIG. 17A, which shows View A (sighted along the $-z$-axis) of three embodiments of the auxiliary patch, referenced as the auxiliary patch 1700-1, the auxiliary patch 1700-2, and the auxiliary patch 1700-3. The auxiliary patches have a circular geometry with a diameter $d_{12}$ 1701, measured along the x-y plane.

View X-X' is a cross-sectional view, sighted along the +y-axis; the plane of the View X-X' is the x-$z$ plane.

Figure 17B:
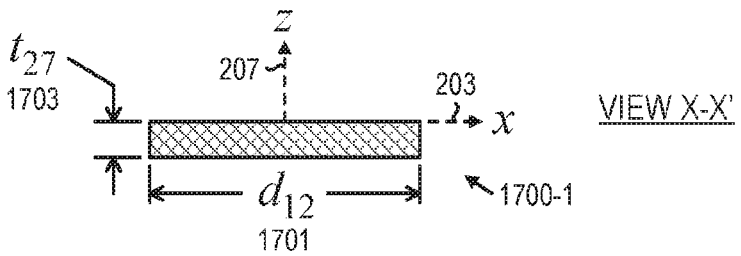

Refer to FIG. 17B. The auxiliary patch 1700-1 is fabricated from a solid conductive material, such as sheet metal. The auxiliary patch 1700-1 has a thickness $t_{27}$ 1703, measured along the $z$-axis.

Figure 17C:
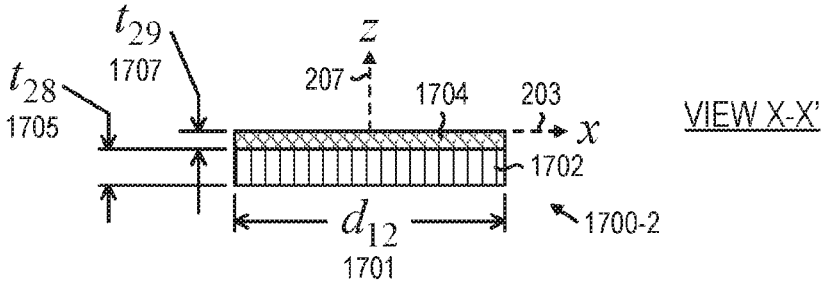

Refer to FIG. 17C. The auxiliary patch 1700-2 is fabricated from a thin film 1704 of a solid conductive material, such as metal, disposed on the top surface of a dielectric substrate 1702. The dielectric substrate 1702, for example, can be a printed circuit board (PCB). The dielectric substrate 1702 has a thickness $t_{28}$ 1705; and the thin film 1704 has a thickness $t_{29}$ 1707.

Figure 17D:
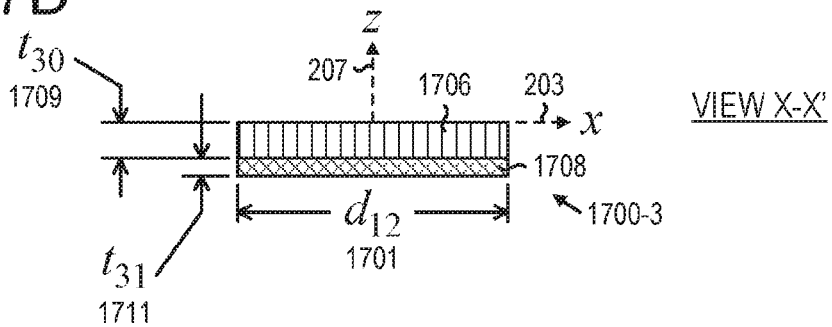

Refer to FIG. 17D. The auxiliary patch 1700-3 is fabricated from a thin film 1708 of a solid conductive material, such as metal, disposed on the bottom surface of a dielectric substrate 1706. The dielectric substrate 1706, for example, can be a printed circuit board (PCB). The dielectric substrate 1706 has a thickness $t_{30}$ 1709; and the thin film 1708 has a thickness $t_{31}$ 1711.

Figure 18A:
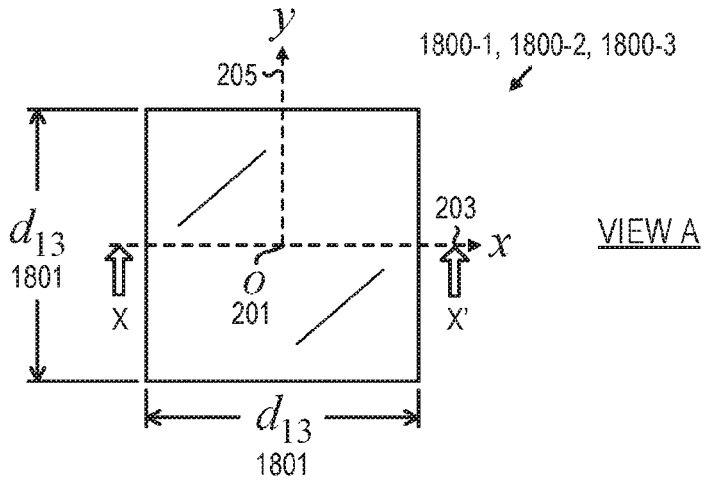
FIG. 18A-FIG. 18D show schematics of embodiments of an auxiliary patch with a square geometry.

Refer to FIG. 18A, which shows View A (sighted along the $-z$-axis) of three embodiments of the auxiliary patch, referenced as the auxiliary patch 1800-1, the auxiliary patch 1800-2, and the auxiliary patch 1800-3. The auxiliary patches have a square geometry with a side length $d_{13}$ 1801, measured along the x-y plane.

View X-X' is a cross-sectional view, sighted along the +y-axis; the plane of the View X-X' is the x-$z$ plane.

Figure 18B:
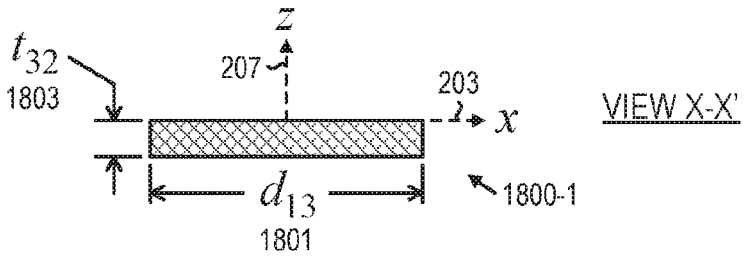

Refer to FIG. 18B. The auxiliary patch 1800-1 is fabricated from a solid conductive material, such as sheet metal. The auxiliary patch 1800-1 has a thickness $t_{32}$ 1803, measured along the $z$-axis.

Figure 18C:
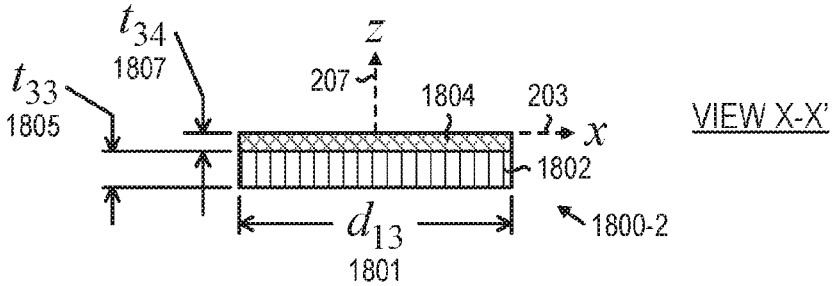

Refer to FIG. 18C. The auxiliary patch 1800-2 is fabricated from a thin film 1804 of a solid conductive material, such as metal, disposed on the top surface of a dielectric substrate 1802. The dielectric substrate 1802, for example, can be a printed circuit board (PCB). The dielectric substrate 1802 has a thickness $t_{33}$ 1805; and the thin film 1804 has a thickness $t_{34}$ 1807.

Figure 18D:
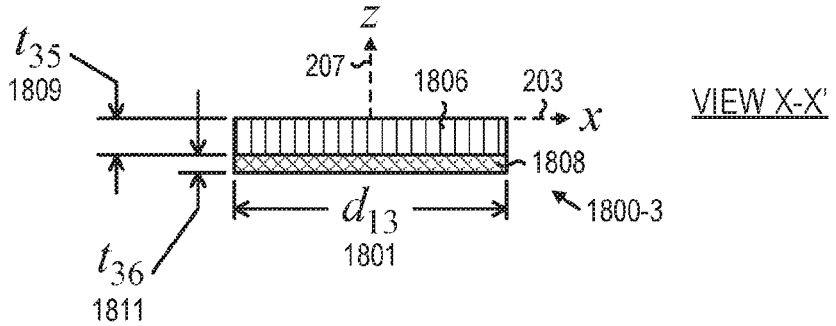

Refer to FIG. 18D. The auxiliary patch 1800-3 is fabricated from a thin film 1808 of a solid conductive material, such as metal, disposed on the bottom surface of a dielectric substrate 1806. The dielectric substrate 1806, for example, can be a printed circuit board (PCB). The dielectric substrate 1806 has a thickness $t_{35}$ 1809; and the thin film 1808 has a thickness $t_{36}$ 1811.

Figure 19A:
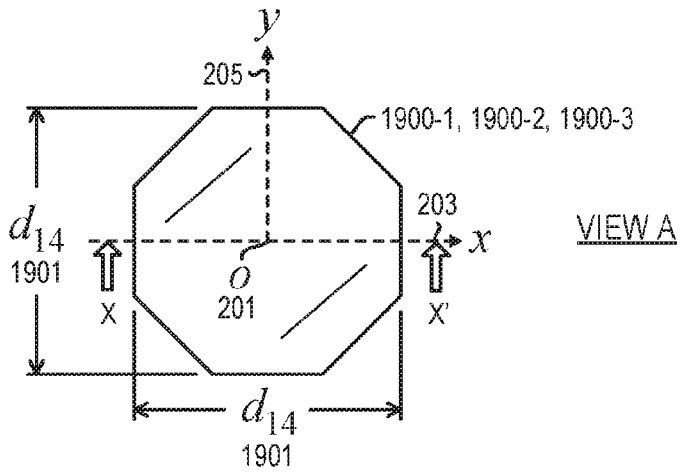
FIG. 19A-FIG. 19D show schematics of embodiments of an auxiliary patch with an octagonal geometry.

Refer to FIG. 19A, which shows View A (sighted along the $-z$ -axis) of three embodiments of the auxiliary patch, referenced as the auxiliary patch 1900-1, the auxiliary patch 1900-2, and the auxiliary patch 1900-3. The auxiliary patches have a regular octagonal geometry. The distance across a pair of opposite sides, measured perpendicular to the sides along the x-y plane, is $d_{14}$ 1901.

View X-X' is a cross-sectional view sighted along the +y-axis; the plane of the View X-X' is the x-$z$ plane.

Figure 19B:
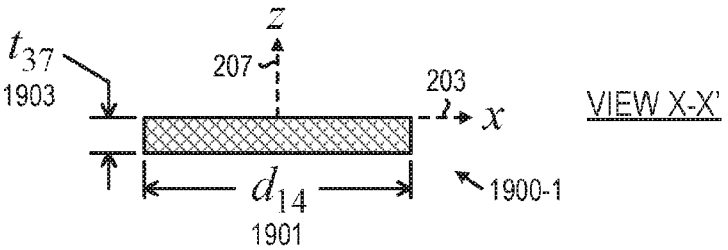

Refer to FIG. 19B. The auxiliary patch 1900-1 is fabricated from a solid conductive material, such as sheet metal. The auxiliary patch 1900-1 has a thickness $t_{37}$ 1903, measured along the $z$ -axis.

Figure 19C:
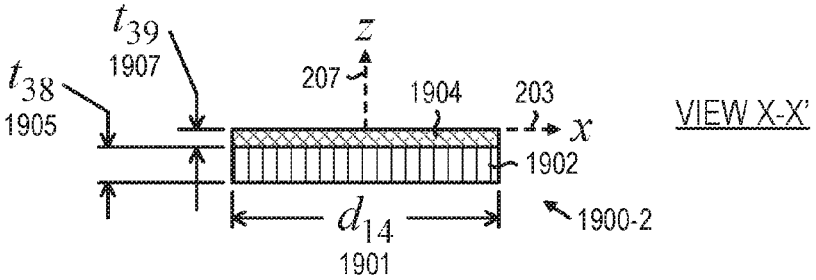

Refer to FIG. 19C. The auxiliary patch 1900-2 is fabricated from a thin film 1904 of a solid conductive material, such as metal, disposed on the top surface of a dielectric substrate 1902. The dielectric substrate 1902, for example, can be a printed circuit board (PCB). The dielectric substrate 1902 has a thickness $t_{38}$ 1905; and the thin film 1904 has a thickness $t_{39}$ 1907.

Figure 19D:
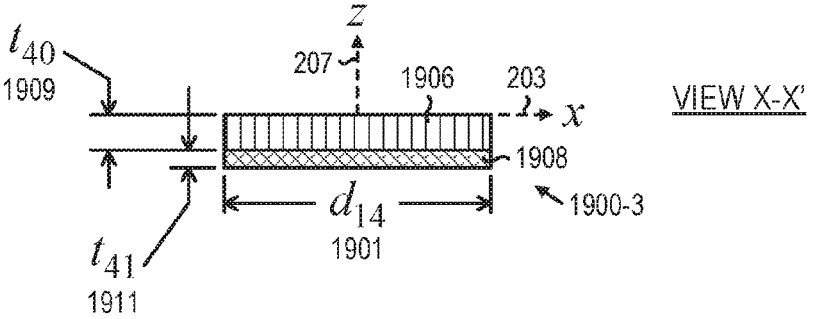

Refer to FIG. 19D. The auxiliary patch 1900-3 is fabricated from a thin film 1908 of a solid conductive material, such as metal, disposed on the bottom surface of a dielectric substrate 1906. The dielectric substrate 1906, for example, can be a printed circuit board (PCB). The dielectric substrate 1906 has a thickness $t_{40}$ 1909; and the thin film 1908 has a thickness $t_{41}$ 1911.

In general, the geometries of the ground plane, the exciter, and the auxiliary patch are independent. The geometries of all three can be different; the geometries of any two can be the same; or the geometries of all three can be the same.

Embodiments of the set of passive elements 406 (FIG. 4) are described below. The passive elements are symmetrically disposed about the $z$ -axis. The number of passive elements is an integer greater than or equal to 8. In practice, 18 to 20 results in the best performance. Each passive element is fabricated from a conductive material, such as metal. Each passive element is electromagnetically coupled to the exciter, but is not electrically connected to the exciter. In some embodiments, each passive element is electromagnetically coupled to the ground plane, but is not electrically connected to the ground plane. In other embodiments, each passive element is electromagnetically coupled to the ground plane and electrically connected to the ground plane.

Refer to FIG. 20A-FIG. 20C. FIG. 20A shows a perspective view (View P); FIG. 20B shows a cross-sectional view (View X-X', sighted along the +y-axis; the plane of the View X-X' is the x-$z$ plane); and FIG. 20C shows a bottom view (View B, sighted along the $+z$ -axis). The dielectric substrate 2008 has the geometry of a truncated hollow dome with a bottom face 2008B, a top face 2008T, an outer surface 2008O, and an inner surface 2008I. In the embodiment shown, the truncated hollow dome is a segment of a spherical shell. Refer to FIG. 20B. The bottom face 2008B has an inner diameter $d_{15}$ 2001 and an outer diameter $d_{16}$ 2003. The top face 2008T has an inner diameter $d_{17}$ 2005 and an outer diameter $d_{18}$ 2007. In the embodiment shown, the bottom face is wider than the top face ($d_{15}>d_{17}$; $d_{16}>d_{18}$). The height of the dielectric substrate 2008, measured from the bottom face 2008B to the top face 2008T along the $z$ -axis, is $H_1$ 2009.

Disposed on the outer surface 2008O is a set of eight passive elements, referenced as passive element 2004A-passive element 2004H. Each passive element is fabricated from a conductive material, such as metal. As one example, each passive element can be fabricated from sheet metal or metal foil and attached to the dielectric substrate with adhesive or mechanical fasteners. As another example, each passive element can be fabricated from metal film that is deposited or plated onto the dielectric substrate. These examples of fabrication methods also apply to the passive elements described below with reference to FIG. 21A-FIG. 21C, FIG. 22A-FIG. 22C, FIG. 23A-FIG. 23C, FIG. 24A-FIG. 24C, and FIG. 25A-FIG. 25C. The passive elements are dielectrically isolated from each other: on the outer surface 2008O, the passive elements 2004A-2004H are separated by the dielectric segments 2006A-2006H, respectively. The geometries and dimensions of the passive elements and dielectric segments are design choices. Refer to FIG. 20B. The distance between the bottom face 2008B of the dielectric substrate and the bottom edges of the passive elements is $H_2$ 2011; the value of $H_2$ ranges from a minimum value of zero.

Refer to FIG. 21A-FIG. 21C. FIG. 21A shows a perspective view (View P); FIG. 21B shows a cross-sectional view (View X-X', sighted along the +y-axis; the plane of the View X-X' is the x-$z$ plane); and FIG. 21C shows a top view (View A, sighted along the $-z$ -axis). The dielectric substrate 2108 has the geometry of a truncated hollow dome with a bottom face 2108B, a top face 2108T, an outer surface 2108O, and an inner surface 2108I. In the embodiment shown, the truncated hollow dome is a segment of a spherical shell. Refer to FIG. 21B. The bottom face 2108B has an inner diameter $d_{19}$ 2101 and an outer diameter $d_{20}$ 2103. The top face 2108T has an inner diameter $d_{21}$ 2105 and an outer diameter $d_{22}$ 2107. In the embodiment shown, the top face is wider than the bottom face ($d_{21}>d_{19}$; $d_{22}>d_{20}$). The height of the dielectric substrate 2108, measured from the bottom face 2108B to the top face 2108T along the $z$ -axis, is $H_3$ 2109.

Disposed on the outer surface 2108O is a set of eight passive elements, referenced as passive element 2104A-passive element 2104H. Each passive element is fabricated from a conductive material, such as metal. The passive elements are dielectrically isolated from each other: on the outer surface 2108O, the passive elements 2104A-2104H are separated by the dielectric segments 2106A-2106H, respectively. The geometries and dimensions of the passive elements and dielectric segments are design choices. Refer to FIG. 21B. The distance between the bottom face 2108B of the dielectric substrate and the bottom edges of the passive elements is $H_4$ 2111; the value of $H_4$ ranges from a minimum value of zero.

Refer to FIG. 22A-FIG. 22C. FIG. 22A shows a perspective view (View P); FIG. 22B shows a cross-sectional view (View X-X', sighted along the +y-axis; the plane of the View X-X' is the x-$z$ plane); and FIG. 22C shows a bottom view (View B, sighted along the $+z$ -axis). The dielectric substrate 2208 has the geometry of a truncated hollow dome with a bottom face 2208B, a top face 2208T, an outer surface 2208O, and an inner surface 2208I. In the embodiment shown, the truncated hollow dome is a segment of a conical shell. Refer to FIG. 22B. The bottom face 2208B has an inner diameter $d_{23}$ 2201 and an outer diameter $d_{24}$ 2203. The top face 2208T has an inner diameter $d_{25}$ 2205 and an outer diameter $d_{26}$ 2207. In the embodiment shown, the bottom face is wider than the top face ($d_{23}>d_{25}$; $d_{24}>d_{26}$). The height of the dielectric substrate 2208, measured from the bottom face 2208B to the top face 2208T along the $z$ -axis, is $H_5$ 2209.

Disposed on the outer surface 2208O is a set of eight passive elements, referenced as passive element 2204A-passive element 2204H. Each passive element is fabricated from a conductive material, such as metal. The passive elements are dielectrically isolated from each other: on the outer surface 2208O, the passive elements 2204A-2204H are separated by the dielectric segments 2206A-2206H, respectively. The geometries and dimensions of the passive elements and dielectric segments are design choices. Refer to FIG. 22B. The distance between the bottom face 2208B of the dielectric substrate and the bottom edges of the passive elements is $H_6$ 2211; the value of $H_6$ ranges from a minimum value of zero.

Figure 23A:
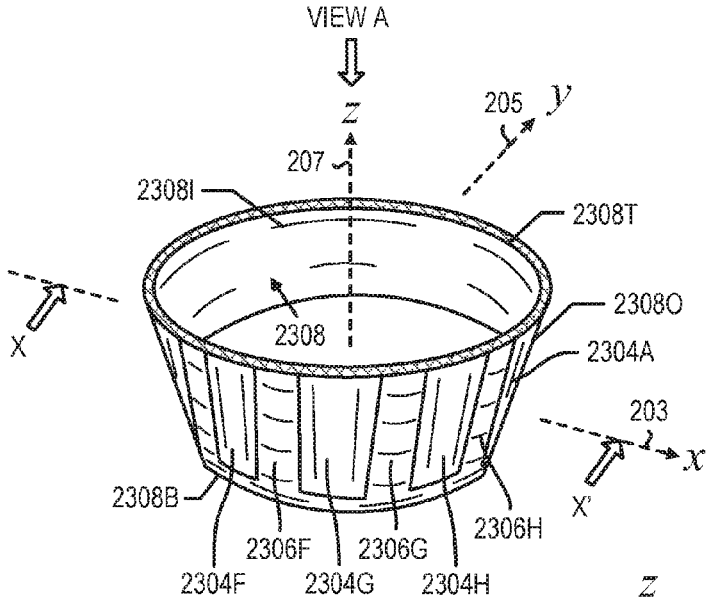
FIG. 23A-FIG. 23C show schematics of an embodiment of passive elements disposed on a dielectric substrate.
Figure 23B:
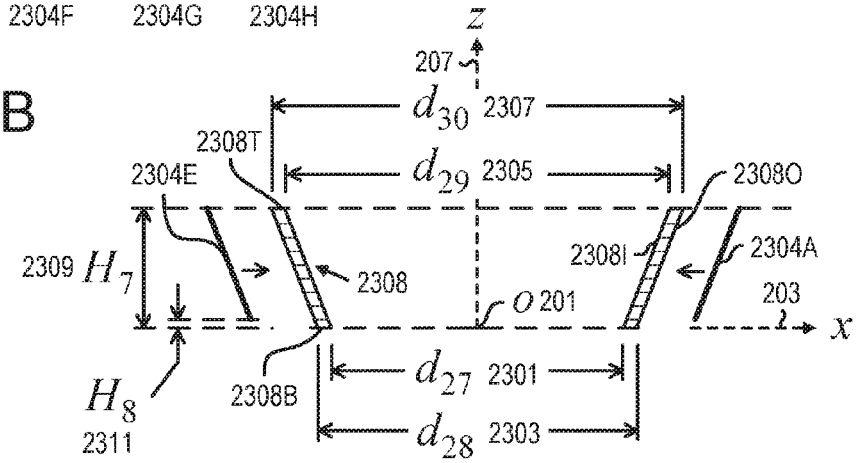
Figure 23C:
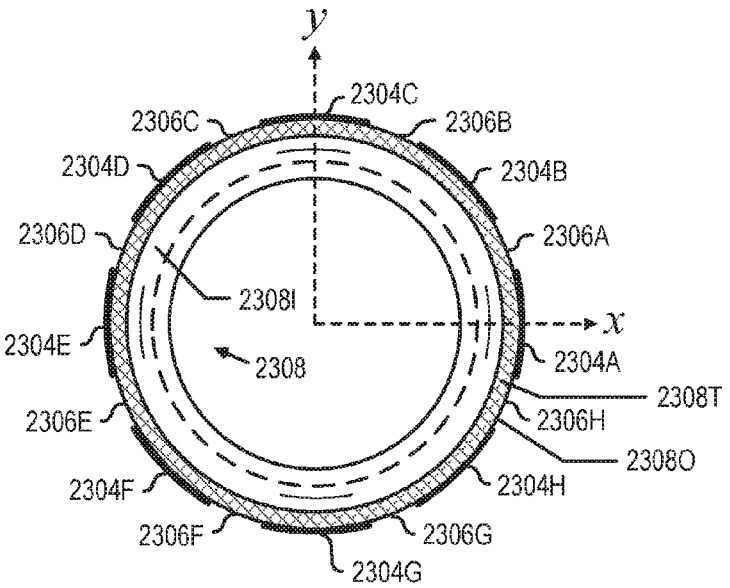

Refer to FIG. 23A-FIG. 23C. FIG. 23A shows a perspective view (View P); FIG. 23B shows a cross-sectional view (View X-X', sighted along the +y-axis; the plane of the View X-X' is the x-$z$ plane); and FIG. 23C shows a top view (View A, sighted along the $-z$-axis). The dielectric substrate 2308 has the geometry of a truncated hollow dome with a bottom face 2308B, a top face 2308T, an outer surface 2308O, and an inner surface 2308I. In the embodiment shown, the truncated hollow dome is a segment of a conical shell. Refer to FIG. 23B. The bottom face 2308B has an inner diameter $d_{27}$ 2301 and an outer diameter $d_{28}$ 2303. The top face 2308T has an inner diameter $d_{29}$ 2305 and an outer diameter $d_{30}$ 2307. In the embodiment shown, the top face is wider than the bottom face ($d_{29}>d_{27}$; $d_{30}>d_{28}$). The height of the dielectric substrate 2308, measured from the bottom face 2308B to the top face 2308T along the $z$-axis, is $H_7$ 2309.

Disposed on the outer surface 2308O is a set of eight passive elements, referenced as passive element 2304A-passive element 2304H. Each passive element is fabricated from a conductive material, such as metal. The passive elements are dielectrically isolated from each other: on the outer surface 2308O, the passive elements 2304A-2304H are separated by the dielectric segments 2306A-2306H, respectively. The geometries and dimensions of the passive elements and dielectric segments are design choices. Refer to FIG. 23B. The distance between the bottom face 2308B of the dielectric substrate and the bottom edges of the passive elements is $H_8$ 2311; the value of $H_8$ ranges from a minimum value of zero.

Figure 24A:
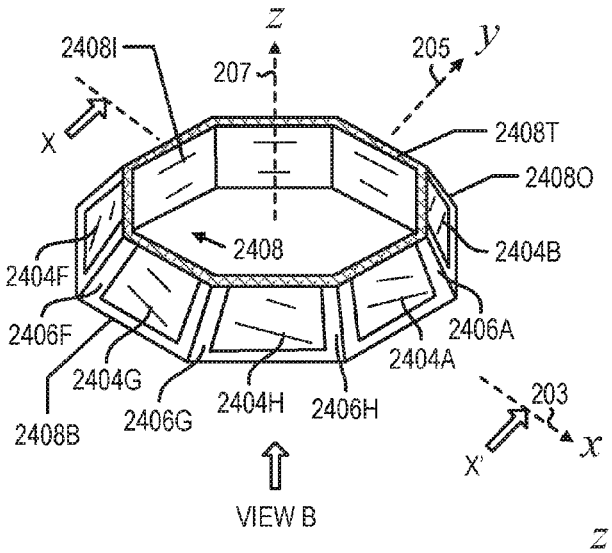
FIG. 24A-FIG. 24C show schematics of an embodiment of passive elements disposed on a dielectric substrate.
Figure 24B:
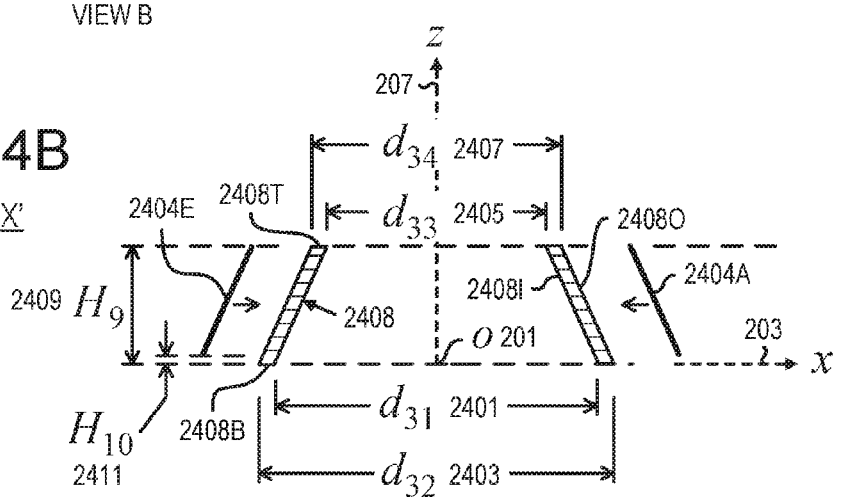
Figure 24C:
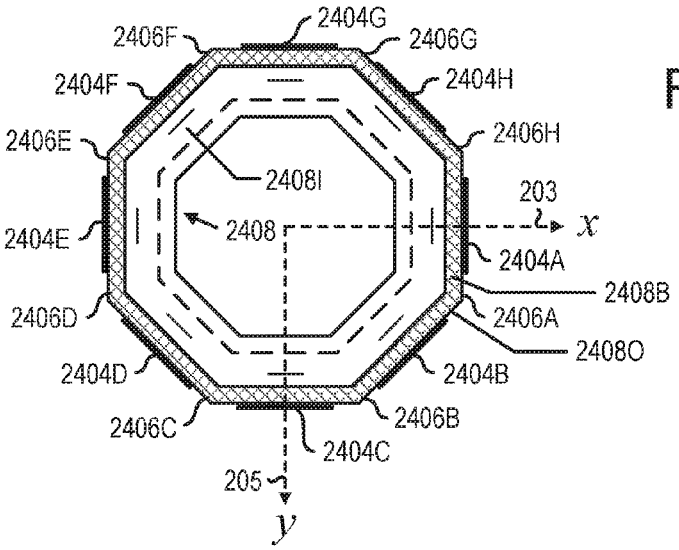

Refer to FIG. 24A-FIG. 24C. FIG. 24A shows a perspective view (View P); FIG. 24B shows a cross-sectional view (View X-X', sighted along the +y-axis; the plane of the View X-X' is the x-$z$ plane); and FIG. 24C shows a bottom view (View B, sighted along the $+z$-axis). The dielectric substrate 2408 has the geometry of a truncated hollow dome with a bottom face 2408B, a top face 2408T, an outer surface 2408O, and an inner surface 2408I. In the embodiment shown, the truncated hollow dome is a segment of a pyramidal shell. Refer to FIG. 24B. The bottom face 2408B has an inner width $d_{31}$ 2401 (measured across a pair of opposite sides of the bottom face) and an outer width $d_{32}$ 2403. The top face 2408T has an inner width $d_{33}$ 2405 and an outer width $d_{34}$ 2407. In the embodiment shown, the bottom face is wider than the top face ($d_{31}>d_{33}$; $d_{32}>d_{34}$). The height of the dielectric substrate 2408, measured from the bottom face 2408B to the top face 2408T along the $z$-axis, is $H_9$ 2409.

Disposed on the outer surface 2408O is a set of eight passive elements, referenced as passive element 2404A-passive element 2404H. Each passive element is fabricated from a conductive material, such as metal. The passive elements are dielectrically isolated from each other: on the outer surface 2408O, the passive elements 2404A-2404H are separated by the dielectric segments 2406A-2406H, respectively. The geometries and dimensions of the passive elements and dielectric segments are design choices. Refer to FIG. 24B. The distance between the bottom face 2408B of the dielectric substrate and the bottom edges of the passive elements is $H_{10}$ 2411; the value of $H_{10}$ ranges from a minimum value of zero.

Refer to FIG. 25A-FIG. 25C. FIG. 25A shows a perspective view (View P); FIG. 25B shows a cross-sectional view (View X-X', sighted along the +y-axis; the plane of the View X-X' is the x-$z$ plane); and FIG. 25C shows a top view (View A, sighted along the $-z$-axis. The dielectric substrate 2508 has the geometry of a truncated hollow dome with a bottom face 2508B, a top face 2508T, an outer surface 2508O, and an inner surface 2508I. In the embodiment shown, the truncated hollow dome is a segment of a pyramidal shell. Refer to FIG. 25B. The bottom face 2508B has an inner width $d_{35}$ 2501 (measured across a pair of opposite sides of the bottom face) and an outer width $d_{36}$ 2503. The top face 2508T has an inner width $d_{37}$ 2505 and an outer width $d_{38}$ 2507. In the embodiment shown, the top face is wider than the bottom face ($d_{37}>d_{35}$; $d_{38}>d_{36}$). The height of the dielectric substrate 2508, measured from the bottom face 2508B to the top face 2508T along the $z$-axis, is $H_{11}$ 2509.

Disposed on the outer surface 2508O is a set of eight passive elements, referenced as passive element 2504A-passive element 2504H. Each passive element is fabricated from a conductive material, such as metal. The passive elements are dielectrically isolated from each other: on the outer surface 2508O, the passive elements 2504A-2504H are separated by the dielectric segments 2506A-2506H, respectively. The geometries and dimensions of the passive elements and dielectric segments are design choices. Refer to FIG. 25B. The distance between the bottom face 2508B of the dielectric substrate and the bottom edges of the passive elements is $H_{12}$ 2511; the value of $H_{12}$ ranges from a minimum value of zero.

Figure 26:
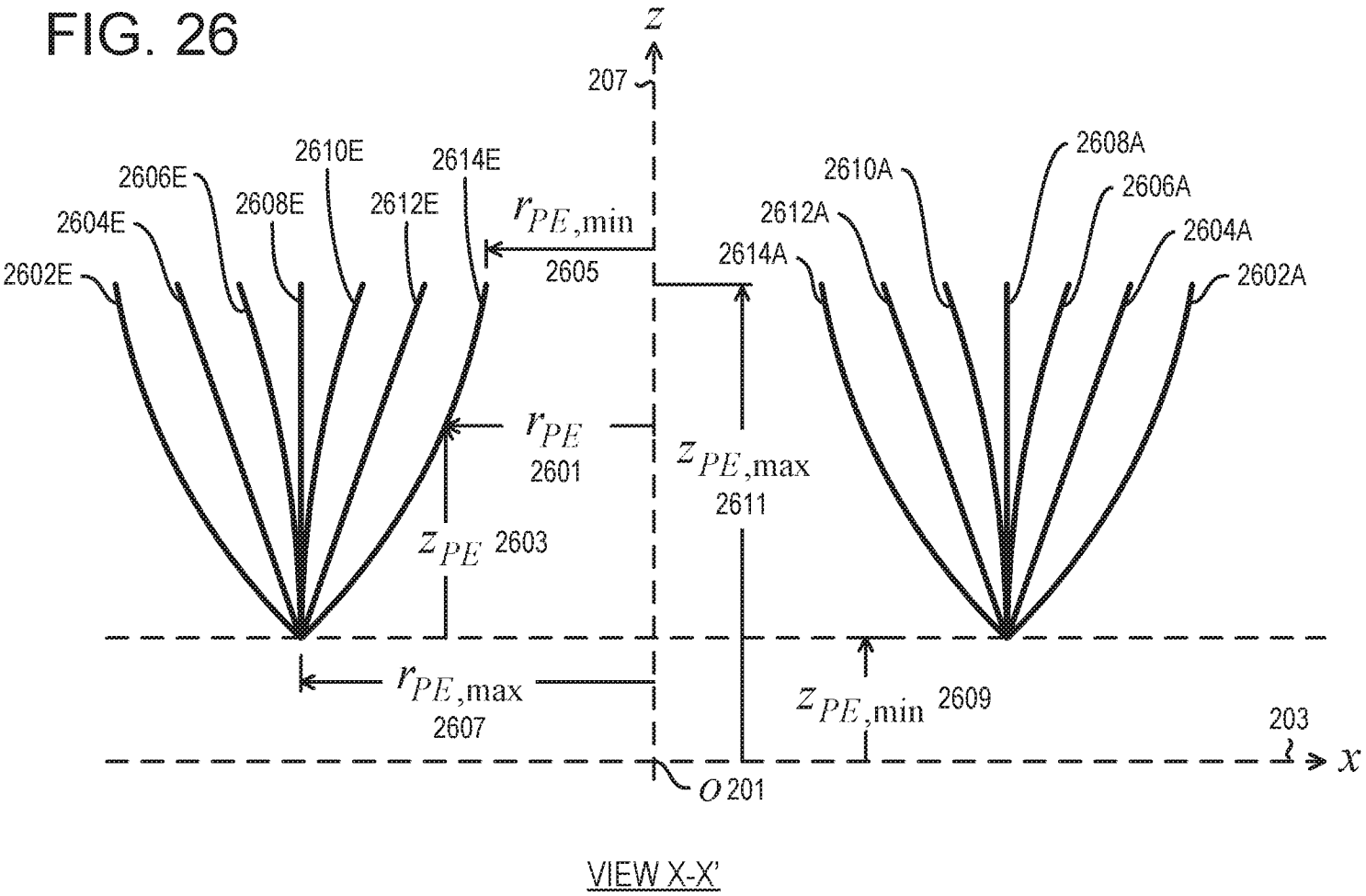
FIG. 26 show profiles of embodiments of passive elements.

FIG. 26 summarizes the profile geometries of embodiments of passive elements. FIG. 26 shows a cross-sectional view (View X-X', sighted along the +y-axis; the plane of the View X-X' is the x-$z$ plane). For each profile geometry, a pair of passive elements ("A" and "E") are shown. Seven representative profile geometries of passive elements are shown: passive elements 2602A and 2602E, passive elements 2604A and 2604E, passive elements 2606A and 2606E, passive elements 2608A and 2608E, passive elements 2610A and 2610E, passive elements 2612A and 2612E, and passive elements 2614A and 2614E. The profile geometries of passive elements 2602A and 2602E, passive elements 2606A and 2606E, passive elements 2610A and 2610E, and passive elements 2614A and 2614E are curvilinear segments. The profile geometries of passive elements 2604A and 2604E, passive elements 2608A and 2608E, and passive elements 2612A and 2612E are straight-line segments. The straight-line segments can represent either a portion of a planar surface or a portion of a conical surface. The passive elements 2608A and 2608E are orthogonal to the x-y plane.

The profile geometry of a passive element is specified by a function $r_{PE}=f(z\ E)$, where $r_{PE,min}\leq r_{PE}\leq r_{PE,max}$ and $z_{PE,min}\leq z_{PE}\leq z_{PE,max}$. Here $r_{PE}$ is the radial distance measured orthogonal to the $z$-axis at a value $z=z_{PE}$; f is a design function; $r_{PE,min}$ and $r_{PE,max}$ are the minimum and maximum values, respectively, of $r_{PE}$; and $z_{PE,min}$ and $z_{PE,max}$ are the minimum and maximum values, respectively, of $z_{PE}$. In FIG. 26, representative values are shown for the passive element 2614E: $r_{PE}$ 2601, $z_{PE}$ 2603, $r_{PE,min}$ 2605, $r_{PE,max}$ 2607, $z_{PE,min}$ 2609, and $z_{PE,max}$ 2611.

Figure 27A:
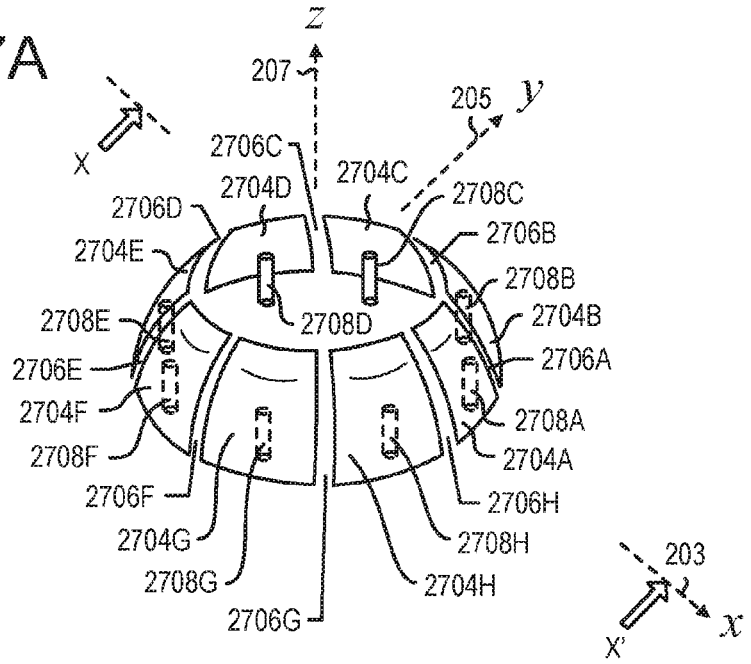
FIG. 27A and FIG. 27B show schematics of an embodiment of passive elements attached to dielectric posts.

Instead of being disposed on a dielectric substrate, each passive element can be attached to an individual dielectric post. Refer to FIG. 27A, which shows a perspective view (View P), and FIG. 27B which shows a cross-sectional view (View X-X', sighted along the +y-axis; the plane of the View X-X' is the x-$z$ plane). As discussed above, the number of passive elements is an integer greater than or equal to eight. For the embodiment shown in FIG. 27A and FIG. 27B, there is a set of eight passive elements, referenced as passive element 2704A-passive element 2704H, symmetrically disposed about the $z$-axis. The geometry of the passive elements shown is similar to those shown previously in FIG. 20A-FIG. 20C. In general, the geometry of a passive element can be any one of those previously described above.

Each passive element is fabricated from a conductive material, such as solid sheet metal or metal film disposed on a dielectric substrate. Each passive element is attached to a corresponding dielectric post. Attachment can be performed, for example, with adhesive or mechanical fasteners. The set of dielectric posts is referenced as dielectric post 2708A-dielectric post 2708H, respectively. Each passive element is separated from its neighboring passive element by an air gap. The set of air gaps is referenced as air gap 2706A-air gap 2706H, respectively.

Figure 27B:
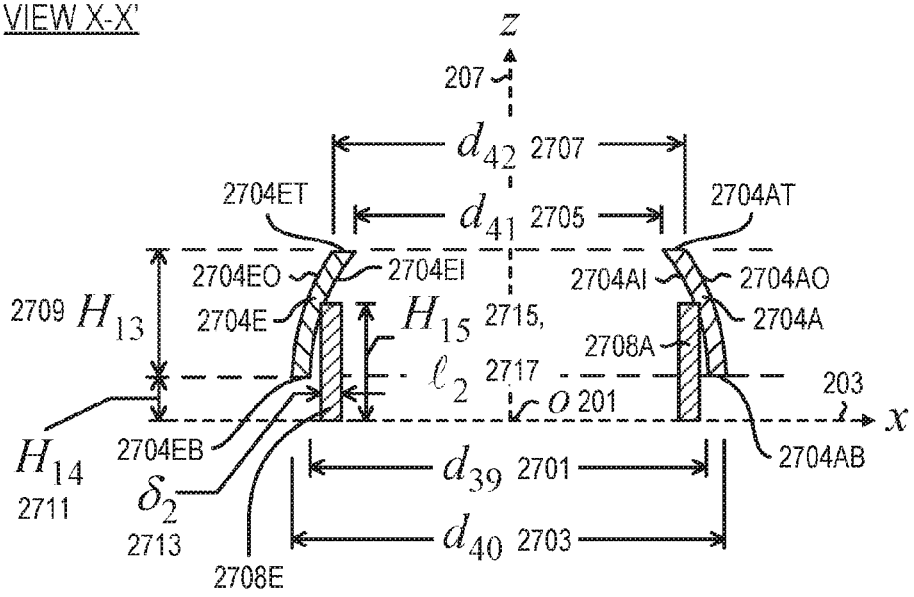

Refer to FIG. 27B. Shown is a pair of passive elements, passive element 2704A and passive element 2704E. The passive element 2704A has a bottom face 2704AB, a top face 2704AT, an inner surface 2704AI, and an outer surface 2704AO. Similarly, the passive element 2704E has a bottom face 2704EB, a top face 2704ET, an inner surface 2704EI, and an outer surface 2704AEO. The passive element 2704A is attached to the dielectric post 2708A; and the passive element 2704E is attached to the dielectric post 2708E. The geometry and dimensions of a dielectric post are a design choice. In the embodiment shown, the dielectric posts have a cylindrical geometry.

Measured at the bottom faces of the passive elements, the distance between the inside surfaces of the passive elements is $d_{39}$ 2701, and the distance between the outer surfaces of the passive elements is $d_{40}$ 2703. Measured at the top faces of the passive elements, the distance between the inside surfaces of the passive elements is $d_{41}$ 2705, and the distance between the outer surfaces of the passive elements is $d_{42}$ 2707. Measured on the x-$z$ plane along the $z$-axis, the height of the bottom faces of the passive elements is $H_{14}$ 2711, the height of the top faces of the passive elements is $H_{13}$ 2709, and the height of the top faces of the dielectric posts is $H_{15}$ 2715 (equal to the length $l_2$ 2717 of a dielectric post). The diameter of a dielectric post is $\delta_2$ 2713.

The set of passive elements can be mounted onto the ground plane in various configurations. As discussed above, in some embodiments, the set of passive elements is not electrically connected to the ground plane; in other embodiments, the set of passive elements is electrically connected to the ground plane.

Figure 28:
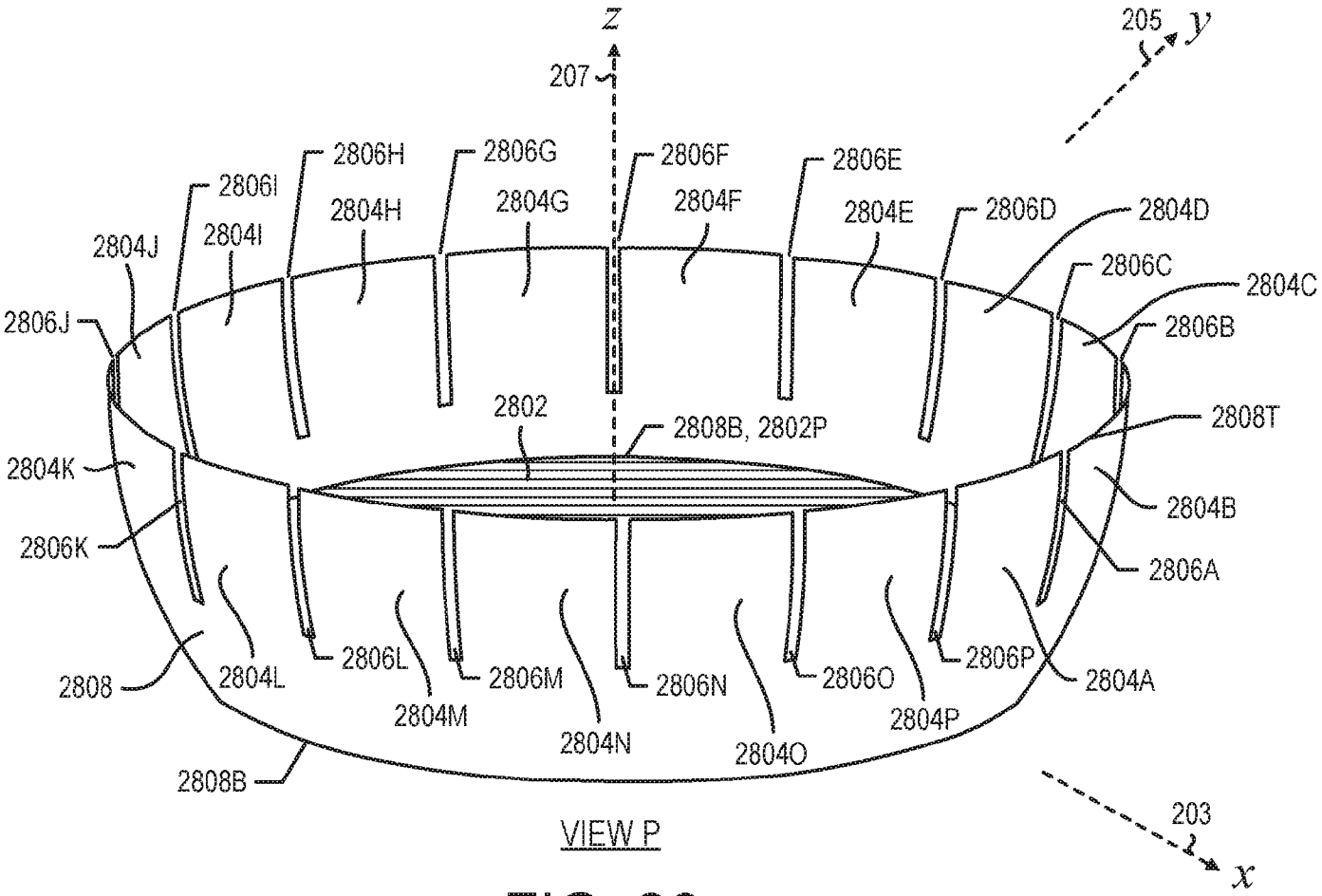
FIG. 28 shows a schematic of a set of passive elements attached to a ground plane.

Refer to FIG. 28, which shows a perspective view (View P) of a ground plane 2802 and a set of sixteen passive elements, referenced as passive element 2804A-passive element 2804P. In the embodiment shown, the ground plane 2802 has the geometry of a circular disc with a periphery 2802P, and the set of passive elements are fabricated on the sidewall 2808 with a bottom face 2808B and a top face 2808T. In the embodiment shown, the sidewall 2808 has the geometry of a segment of a spherical shell. The set of passive elements are fabricated by cutting a set of grooves, referenced as groove 2806A-groove 2806P, into the sidewall 2808. In one embodiment, the sidewall 2808 and the ground plane 2802 are fabricated as two separate pieces and attached (for example, the bottom face 2808B of the sidewall 2808 is attached to the periphery 2802P of the ground plane 2802). For example, the two separate pieces can be attached by soldering, welding, conductive adhesive, or mechanical fasteners. In an advantageous embodiment, the sidewall 2808 and the ground plane 2802 are fabricated as a single piece; for example, they can be fabricated from a single piece of sheet metal.

Figure 29:
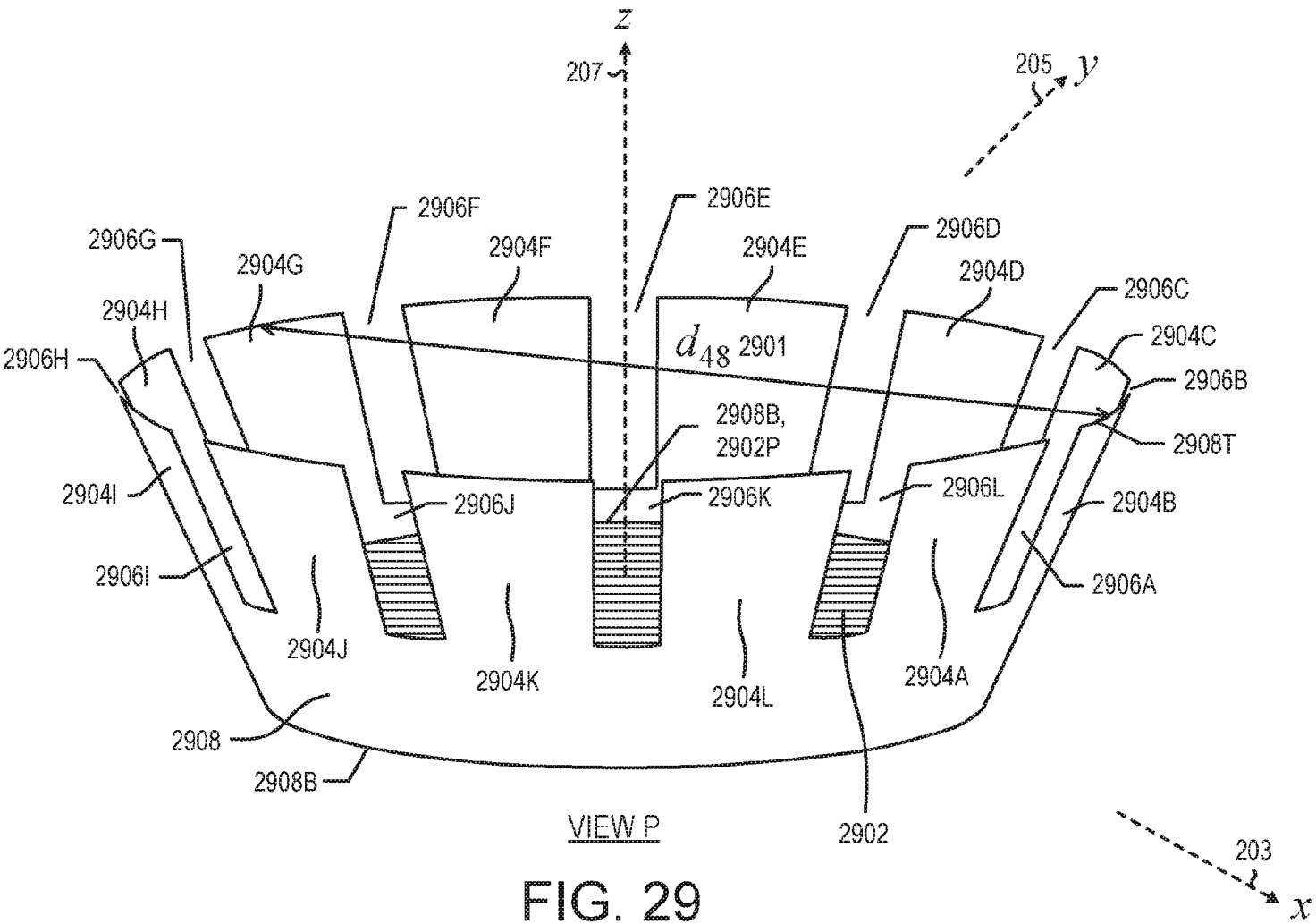
FIG. 29 shows a schematic of a set of passive elements attached to a ground plane.

Refer to FIG. 29, which shows a perspective view (View P) of a ground plane 2902 and a set of twelve passive elements, referenced as passive element 2904A-passive element 2904L. In the embodiment shown, the ground plane 2902 has the geometry of a circular disc with a periphery 2902P, and the set of passive elements are fabricated on the sidewall 2908 with a bottom face 2908B and a top face 2908T. In the embodiment shown, the sidewall 2908 has the geometry of a segment of a conical shell. The inside diameter of the conical shell at the top face is referenced as $d_{48}$ 2901. The set of passive elements are fabricated by cutting a set of grooves, referenced as groove 2906A-groove 2006L, into the sidewall 2908. In one embodiment, the sidewall 2908 and the ground plane 2902 are fabricated as two separate pieces and attached (for example, the bottom face 2908B of the sidewall 2908 is attached to the periphery 2902P of the ground plane 2902). For example, the two separate pieces can be attached by soldering, welding, conductive adhesive, or mechanical fasteners. In an advantageous embodiment, the sidewall 2908 and the ground plane 2902 are fabricated as a single piece; for example, they can be fabricated from a single piece of sheet metal.

In general, the geometry of the ground plane can be any one of those previously described, and the geometry of the passive elements can be any one of those previously described (as long as the geometry of the ground plane and the geometry of the passive elements are compatible).

Figure 30:
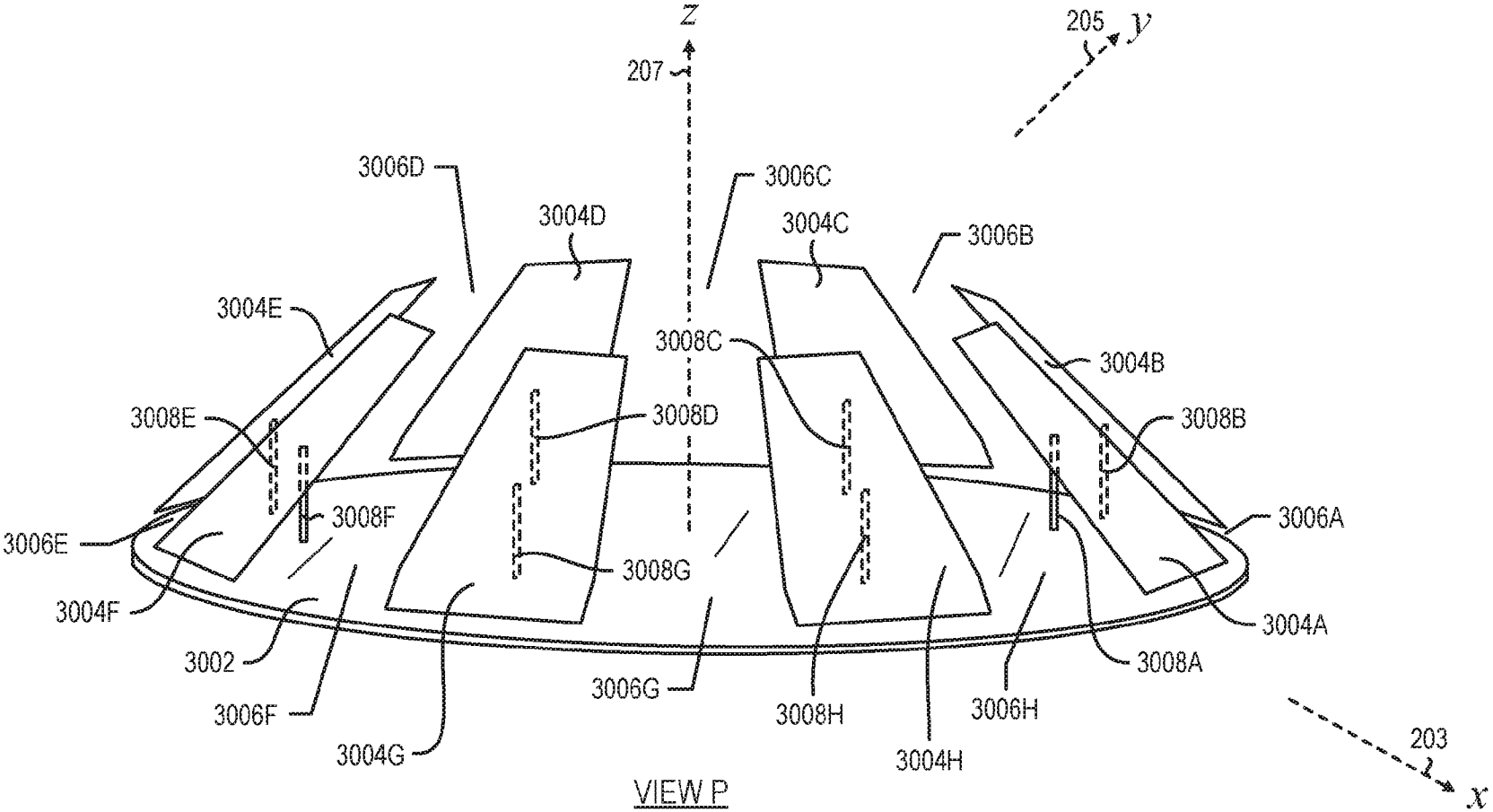
FIG. 30 shows a schematic of a set of passive elements attached to a ground plane.

Refer to FIG. 30, which shows a perspective view (View P) of a ground plane 3002 and a set of eight passive elements, referenced as passive element 3004A-passive element 3004H. In the embodiment shown, the ground plane 3002 has the geometry of a circular disc. Each passive element in the set of passive elements is attached to the ground plane by a corresponding dielectric post in a set of dielectric posts; the dielectric posts 3008A-3008H correspond to the passive elements 3004A-3004H, respectively. The top end of each dielectric post is attached to a passive element, and the bottom end of each dielectric post is attached to the ground plane. Attachment can be performed, for example, with adhesive or mechanical fasteners. The bottom edge of each passive element is separated from the ground plane by an air gap. Each passive element is separated from a neighboring passive element by an air gap; the air gaps 3006A-3006H correspond to the passive elements 3004A-3004H, respectively.

In general, the geometry of the ground plane can be any one of those previously described, and the geometry of the passive elements can be any one of those previously described (as long as the geometry of the ground plane and the geometry of the passive elements are compatible).

Figure 31A:
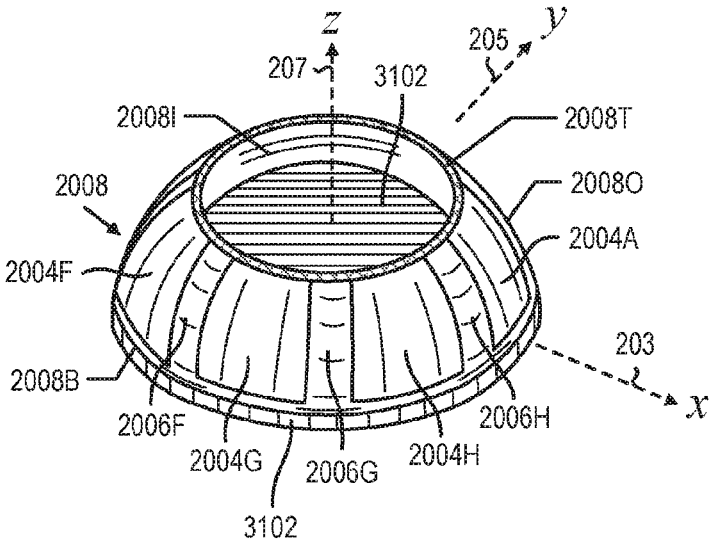
FIG. 31A shows a schematic of a set of passive elements attached to a ground plane.

Refer to FIG. 31A, which shows a perspective view (View P) of a ground plane 3102 and a set of eight passive elements. The set of eight passive elements, referenced as passive element 2004A-passive element 2004H, is disposed on the outer surface of the dielectric substrate 2008; this configuration was previously described with reference to FIG. 20. The bottom face 2008B of the dielectric substrate 2008 is attached to the top surface of the ground plane 3102. Attachment is performed, for example, with adhesive or mechanical fasteners. In the embodiment shown in FIG. 31A, the passive elements are not electrically connected to the ground plane 3102. Refer to FIG. 20. The value $H_2$ is greater than zero, and the bottom edge of the passive elements do not contact the ground plane.

In general, the geometry of the ground plane can be any one of those previously described, and the geometry of the passive elements can be any one of those previously described (as long as the geometry of the ground plane and the geometry of the passive elements are compatible).

Figure 31B:
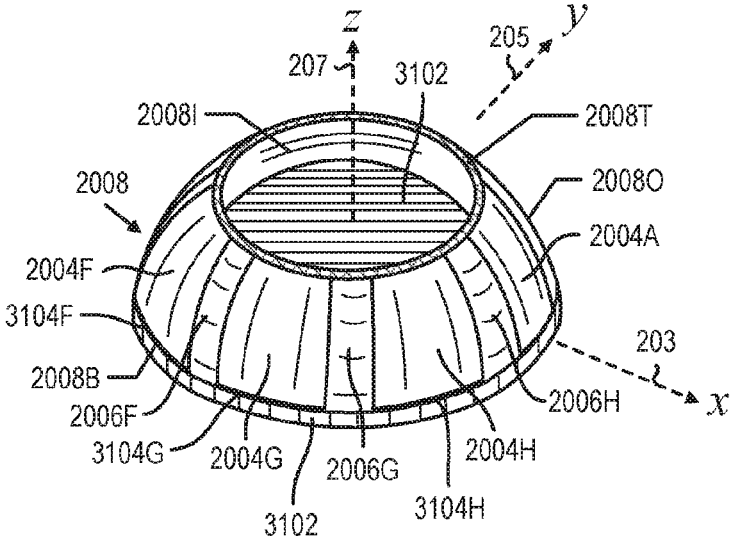
FIG. 31B shows a schematic of a set of passive elements attached to a ground plane.

Refer to FIG. 31B. The configuration shown in FIG. 31B is similar to the configuration shown in FIG. 31A, except the passive elements are electrically connected to the ground plane 3102. The value $H_2$ is equal to zero. The bottom edge of each passive element is electrically connected to the ground plane with, for example, solder or conductive adhesive. In FIG. 31B, shown are three representative solder joints: solder joint 3104F electrically connects the bottom edge of the passive element 2004F to the ground plane 3102, solder joint 3104G electrically connects the bottom edge of the passive element 2004G to the ground plane 3102, and solder joint 3104H electrically connects the bottom edge of the passive element 2004H to the ground plane 3102.

In general, the geometry of the ground plane can be any one of those previously described, and the geometry of the passive elements can be any one of those previously described (as long as the geometry of the ground plane and the geometry of the passive elements are compatible).

Figure 32:
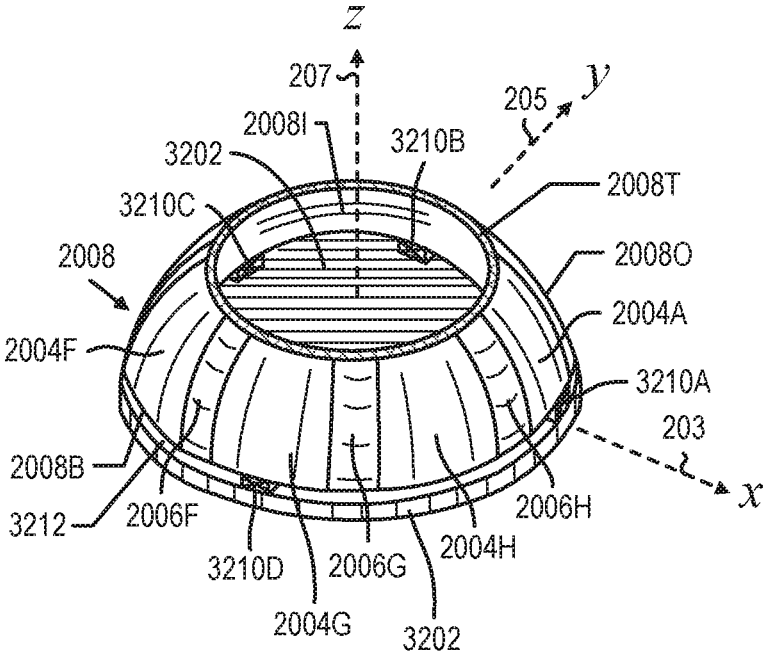
FIG. 32 shows a schematic of a set of passive elements attached to a ground plane.

Refer to FIG. 32. The configuration shown in FIG. 32 is similar to the configuration shown in FIG. 31B, except the passive elements are not electrically connected to the ground plane 3202. The value $H_2$ is equal to zero. The bottom face 2008B of the dielectric substrate 2800 is attached to the top surface of the ground plane 3202 by one or more dielectric spacers. In the embodiment shown, there are four dielectric spacers, referenced as dielectric spacer 3210A-dielectric spacer 3210D. The top end of each dielectric spacer is attached to the bottom face 2008B of the dielectric substrate 2008, and the bottom end of each dielectric spacer is attached to the ground plane 3202. Attachment can be performed, for example, with adhesive or mechanical fasteners.

In general, the geometry of the ground plane can be any one of those previously described, and the geometry of the passive elements can be any one of those previously described (as long as the geometry of the ground plane and the geometry of the passive elements are compatible).

Figure 33:
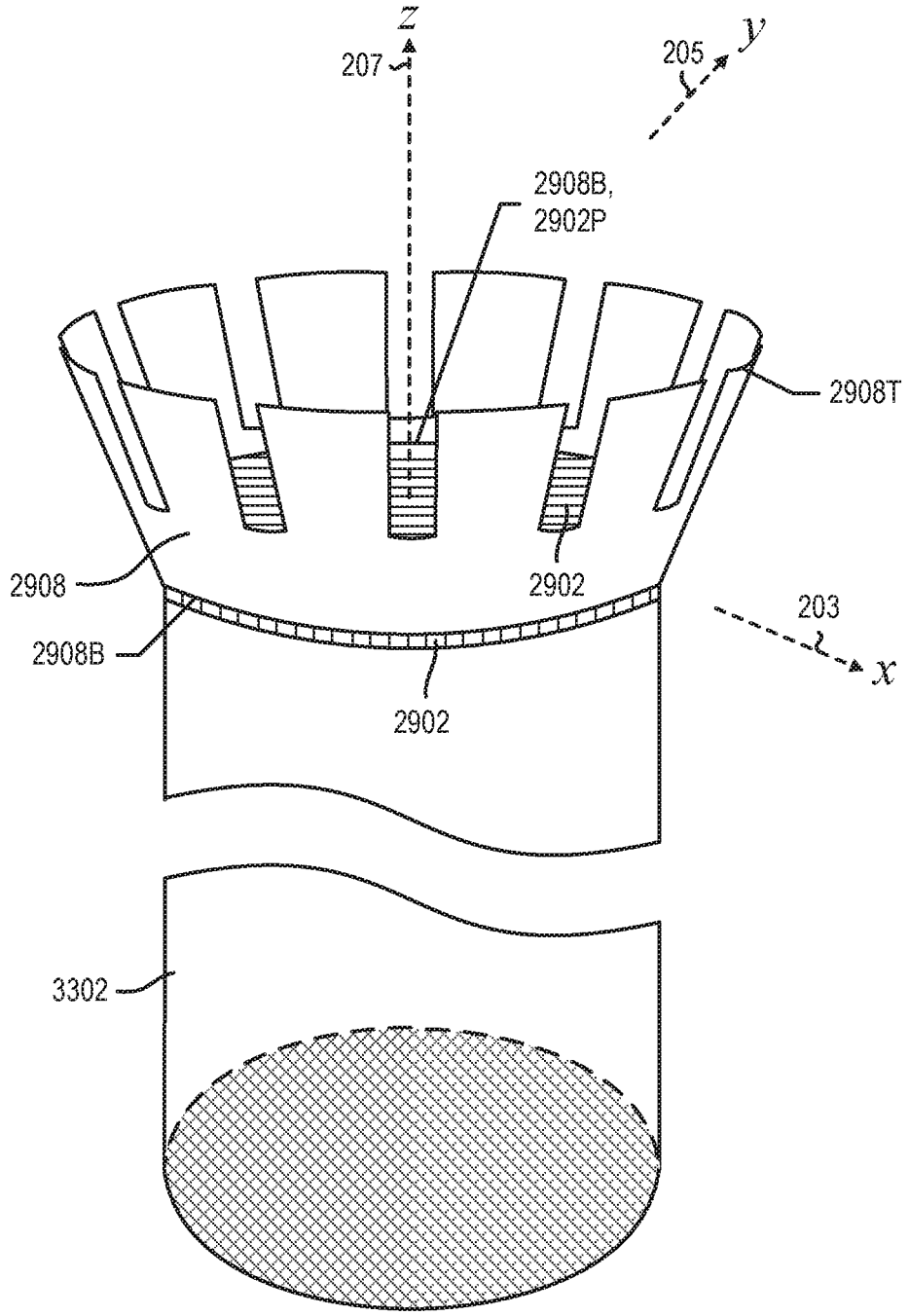
FIG. 33 shows a schematic of a set of passive elements and a ground plane integrated with a case for a global navigation satellite system receiver.

In some embodiments, the ground plane and the set of passive elements are integrated with the case (housing) of a GNSS receiver. Refer to FIG. 33, which shows a perspective view (View P). The ground plane 2902 and the sidewall 2908 were previously described above with reference to FIG. 29. Here the ground plane 2902 is integrated with the case 3302, which is fabricated from a conductive material, such as sheet metal.

In general, the geometry of the ground plane can be any one of those previously described, the geometry of the passive elements can be any one of those previously described, and the geometry of the case is a design choice (as long as the geometries are all compatible).

Figure 34:
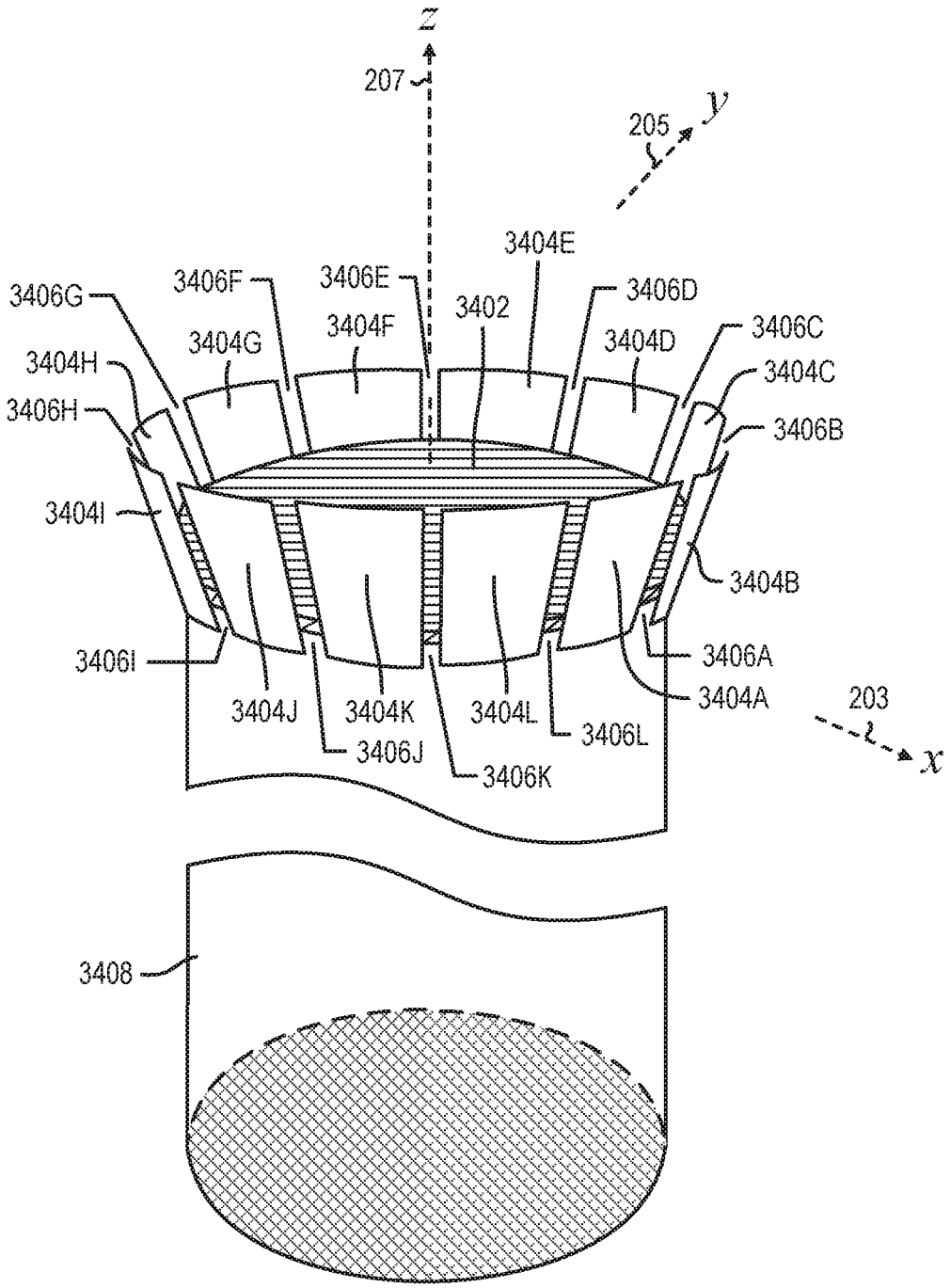
FIG. 34 shows a schematic of a set of passive elements and a ground plane integrated with a case for a global navigation satellite system receiver.

Refer to FIG. 34, which shows a perspective view (View P). The ground plane 3402 is integrated with the case 3408, which is fabricated from a conductive material, such as metal. The set of twelve passive elements, referenced as passive element 3404A-3404L, are attached to the sidewall of the case 3408, below the ground plane 3402. The set of passive elements 3404A-3404L are separated by the set of air gaps 3406A-3406L, respectively. Attachment can be performed, for example, with soldering, welding, mechanical fasteners, or conductive adhesive.

In general, the geometry of the ground plane can be any one of those previously described, the geometry of the passive elements can be any one of those previously described, and the geometry of the case is a design choice (as long as the geometries are all compatible).

Similarly, passive elements disposed on a dielectric substrate and passive elements mounted on dielectric posts can be configured with a ground plane that is integrated with a case of a GNSS receiver.

Figure 35A:
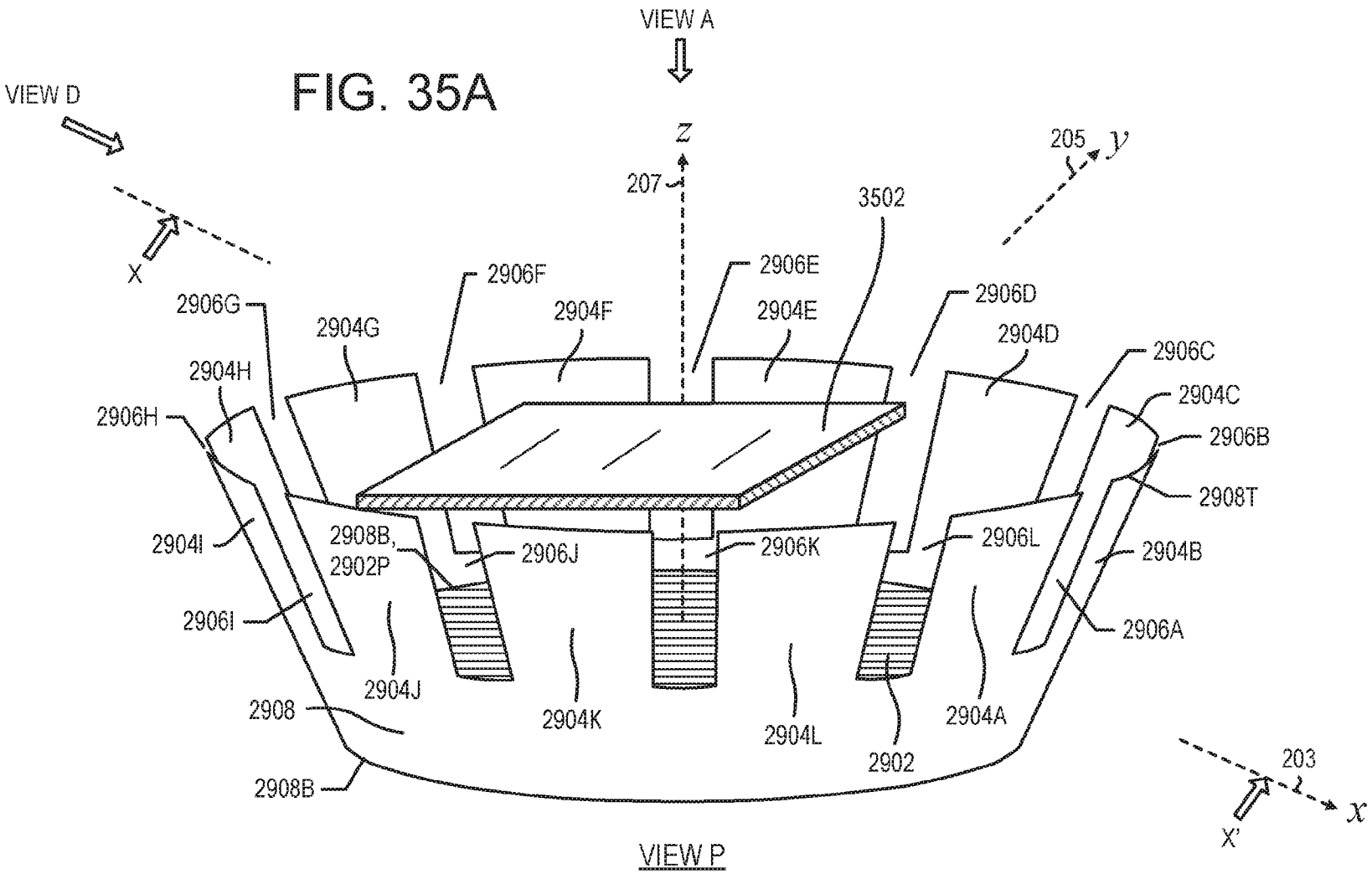
FIG. 35A-FIG. 35I show schematics of an embodiment of an antenna system.

Refer to FIG. 35A, which shows a perspective view (View P) of an assembly including an exciter 3502 combined with the ground plane 2902 and the set of passive elements 2904A-2904L. To simplify the drawing, mounting posts are not shown (see further drawings below). In general, the exciter 3502 represents any one of the exciters previously described, the geometry of the ground plane can be any one of those previously described, and the geometry of the passive elements can be any one of those previously described (as long as the geometry of the ground plane and the geometry of the passive elements are compatible). To simplify the drawing, the exciter is represented by a square plate. The exciter 3502 is disposed above the ground plane 2902 and oriented parallel to the ground plane 2902.

Figure 35B:
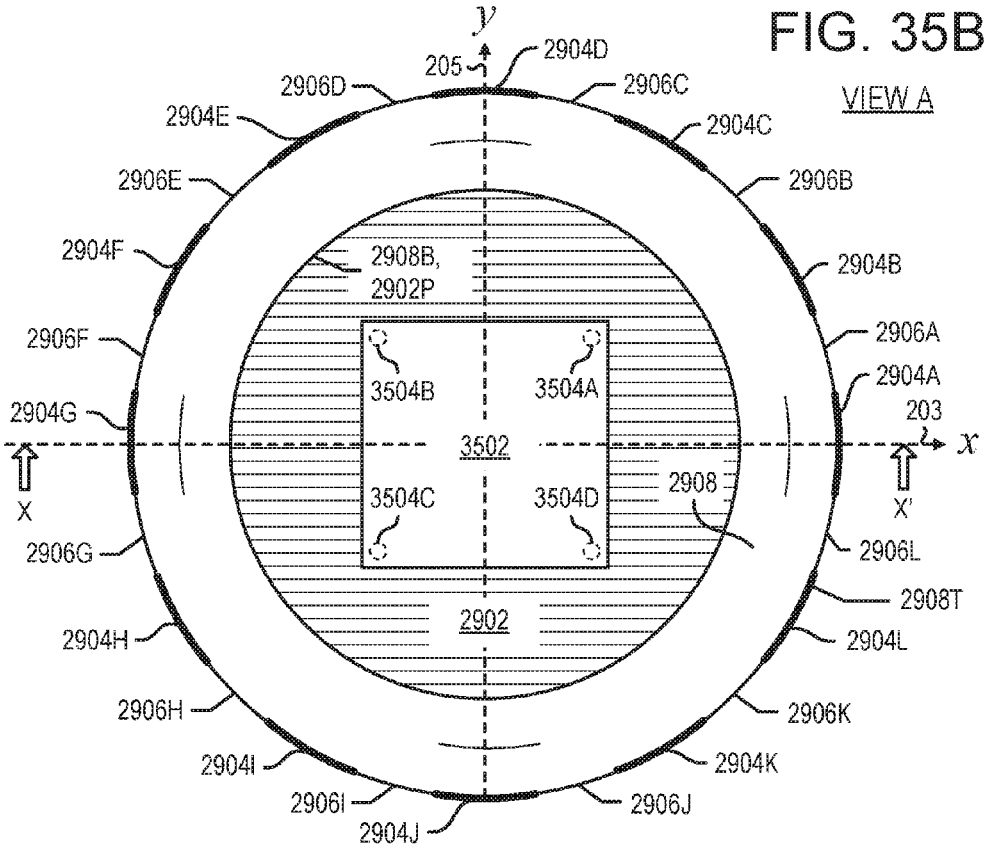

Refer to FIG. 35B, which shows a top view (View A, sighted along the $-z$-axis) of the assembly. In the embodiment shown, the exciter 3502 is mounted to the ground plane 2902 by one or more dielectric posts. In the embodiment shown, four dielectric posts, referenced as dielectric post 3504A-dielectric post 3504D, are used; one dielectric post is placed at each corner of the exciter. In general, the number and placement of the dielectric posts are design choices.

Figure 35C:
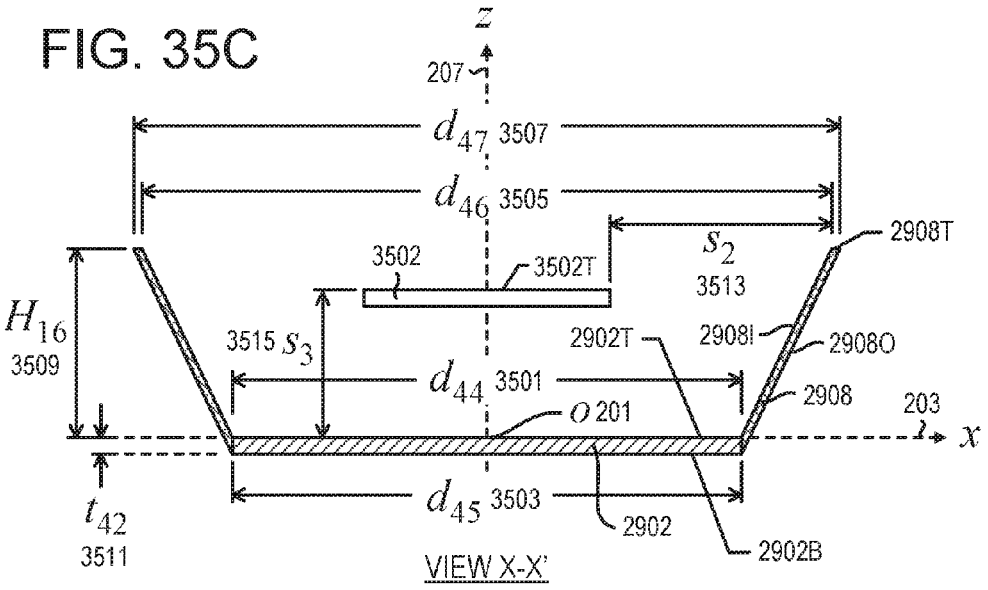

Refer to FIG. 35C, which shows a cross-sectional view of the assembly (View X-X', sighted along the +y-axis; the plane of the View X-X' is the x-$z$ plane). The ground plane 2902 has a diameter $d_{44}$ 3501 measured across the top surface 2902T, a diameter $d_{45}$ 3503 measured across the bottom surface 2902B, and a thickness $t_{42}$ 3511 (measured along the $z$-axis). The sidewall 2908 has a top face 2908T, an inner surface 2908I, and an outer surface 2908O. The sidewall 2908 has an inner diameter $d_{46}$ 3505 measured at the top face 2908T, and an outer diameter $d_{47}$ 3507 measured at the top face 2908T. The sidewall 2908 has a height $H_{16}$ 3509, measured along the $z$-axis from the top surface 2902T of the ground plane 2902 to the top face 2908T of the sidewall 2908.

The lateral distance between the sidewall 2908 and the exciter 3502 is $s_2$ 3513, measured orthogonal to the $z$-axis between a side of the exciter 3502 and the inside surface 2908I at the top face 2908T of the sidewall 2908 (that is, the distance $s_2$ is measured orthogonal to the $z$-axis on a common plane parallel to the x-y plane onto which the exciter and the sidewall are projected). The vertical distance between the exciter 3502 and the ground plane 2902 is $s_3$ 3515, measured along the $z$-axis from the top surface 2902T of the ground plane 2902 to the top surface 3502T of the exciter 3502.

Figure 35D:
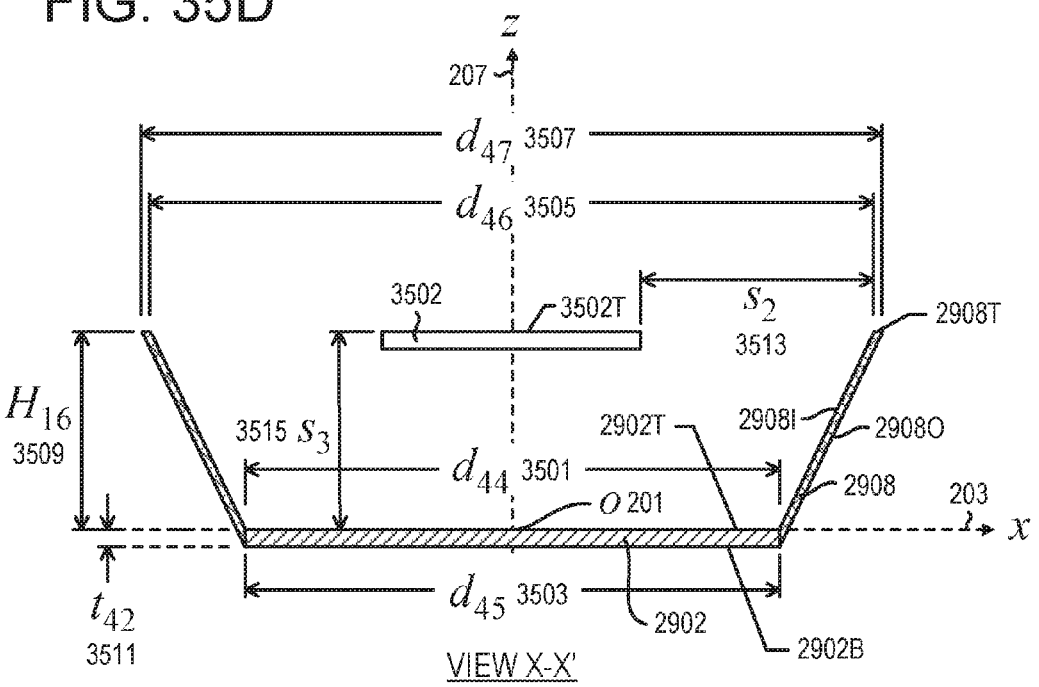
Figure 35E:
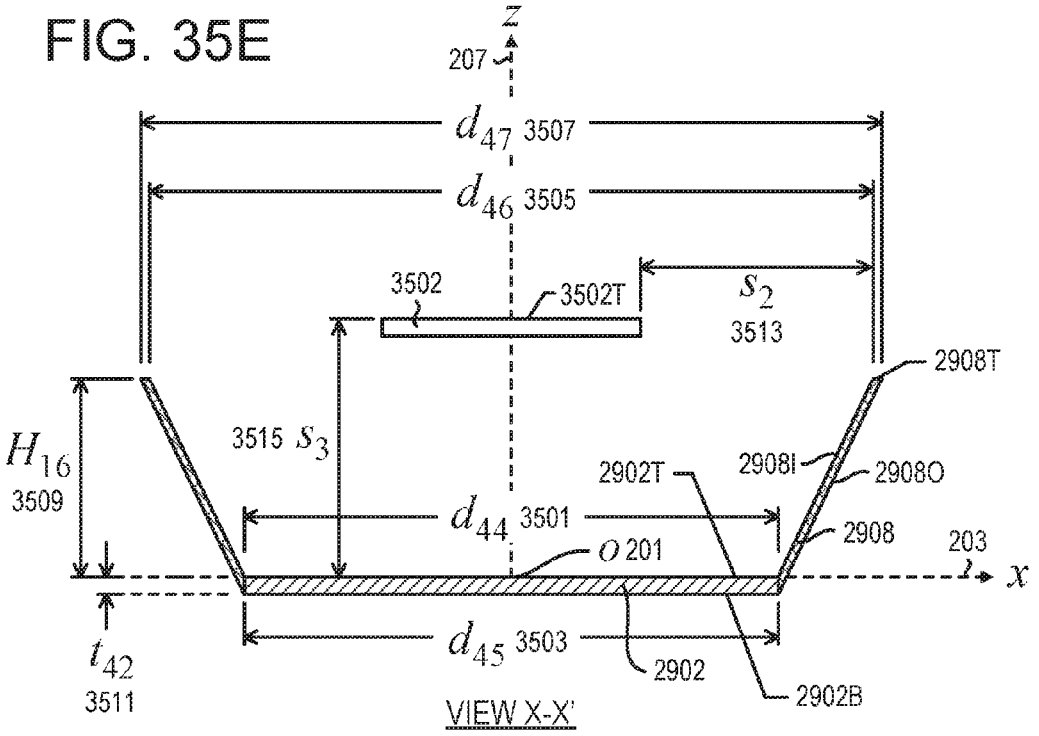

In the embodiment shown in FIG. 35C, the exciter 3502 is disposed below the top face 2908T of the sidewall 2908 ($s_3<H_{16}$). The exciter can also be disposed at the same height as the top face or above the top face. In FIG. 35D, the top surface 3502T of the exciter 3502 is at the same height as the top face 2908T of the sidewall 2908 ($s_3=H_{16}$). In FIG. 35E, the top surface 3502T of the exciter 3502 is above the top face 2908T of the sidewall 2908 ($s_3>H_{16}$).

Figure 35F:
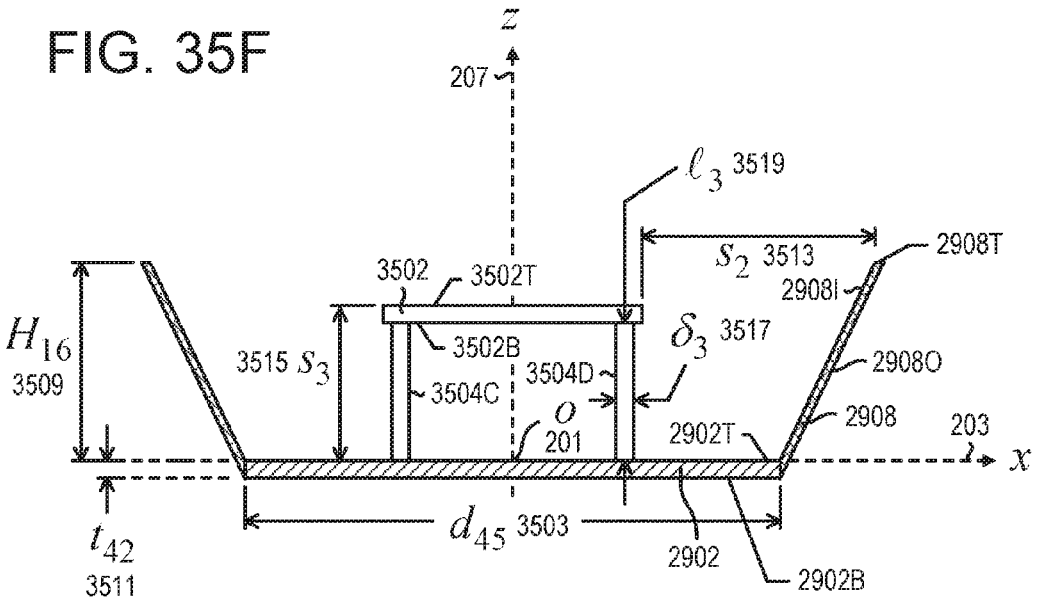

Refer to FIG. 35F, which shows a hybrid view of the assembly, a cross-sectional view (View X-X') of the ground plane and sidewall and a side view (View C, sighted along the +y-axis) of the exciter and dielectric posts. Shown in this view are two of the dielectric posts, dielectric post 3504C and dielectric post 3504D. The geometry of the dielectric posts is a design choice. In the embodiment shown, each dielectric post is cylindrical, with a diameter $\delta_3$ 3517 and a length $l_3$ 3519. The top end of each dielectric post is attached to the bottom surface 3502B of the exciter 3502, and the bottom end of each dielectric post is attached to the top surface 2902T of the ground plane 2902. Attachment can be performed, for example, with adhesive or mechanical fasteners.

Figure 35G:
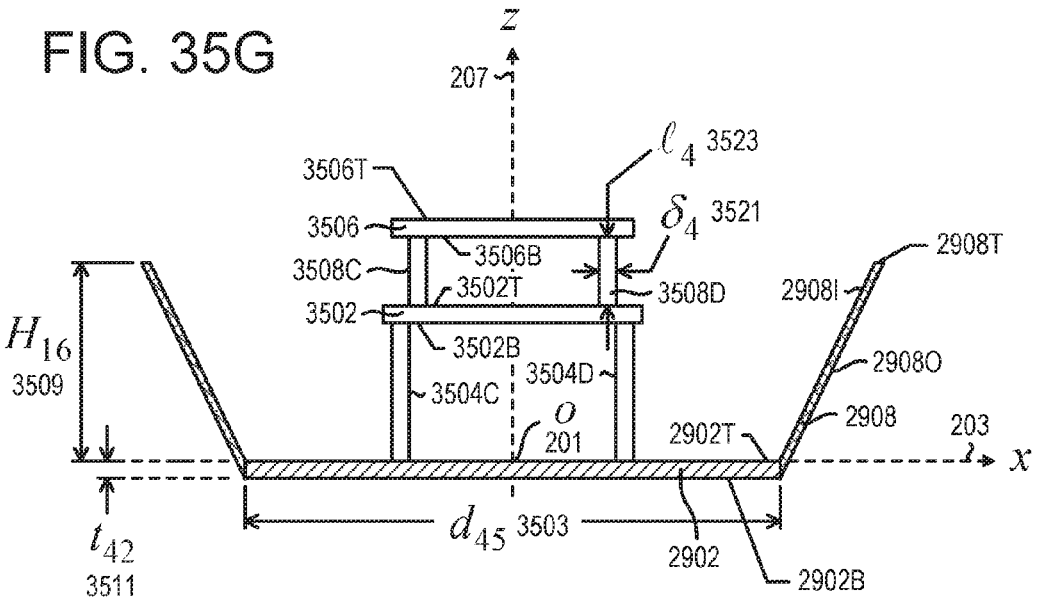

Refer to FIG. 35G, which shows the configuration shown in FIG. 35F, with the addition of the auxiliary patch 3506. The auxiliary patch 3506, which has a top surface 3506T and a bottom surface 3506B, is disposed above the exciter 3502 and is oriented parallel to the exciter 3502. The auxiliary patch is supported above the exciter by four dielectric posts, shown in this view are two representative dielectric posts, the dielectric post 3508C and the dielectric post 3508D. As discussed above, the geometry of the dielectric posts is a design choice. In the embodiment shown, each dielectric post is cylindrical, with a diameter $\delta_4$ 3521 and a length $l_4$ 3523. The top end of each dielectric post is attached to the bottom surface 3506B of the auxiliary patch 3506, and the bottom end of each dielectric post is attached to the top surface 3502T of the exciter 3502. Attachment can be performed, for example, with adhesive or mechanical fasteners. Note: the geometry of the ground plane, the geometry of the exciter, and the geometry of the auxiliary patch do not need to be the same.

Figure 36A:
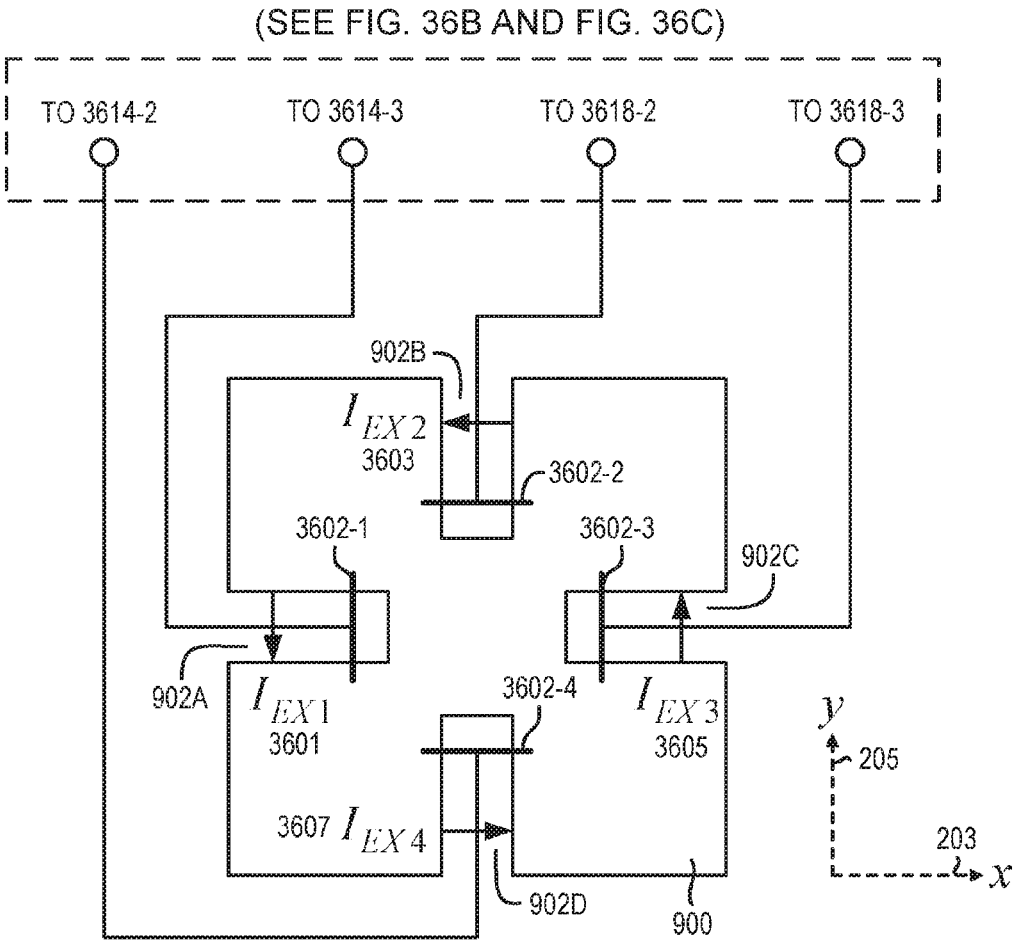
FIG. 36A-FIG. 36D show electrical schematics for an embodiment of an antenna system.

The antenna system is excited by an excitation circuit. The exciter 900 (previously described) is selected as a representative exciter in the discussion below. In general, any one of the exciters previously described can be used. Refer to FIG. 36A, which shows a top view (View A, sighted along the $-z$ -axis) of the exciter 900. Excitation pin 3602-1 is electrically connected across slot 902A; excitation pin 3602-2 is electrically connected across slot 902B; excitation pin 3602-3 is electrically connected across slot 902C; and excitation pin 3602-4 is electrically connected across slot 902D. The excitation pins are fabricated from a conductive material, such as metal, and can be electrically connected, for example, with solder joints.

Figure 36B:
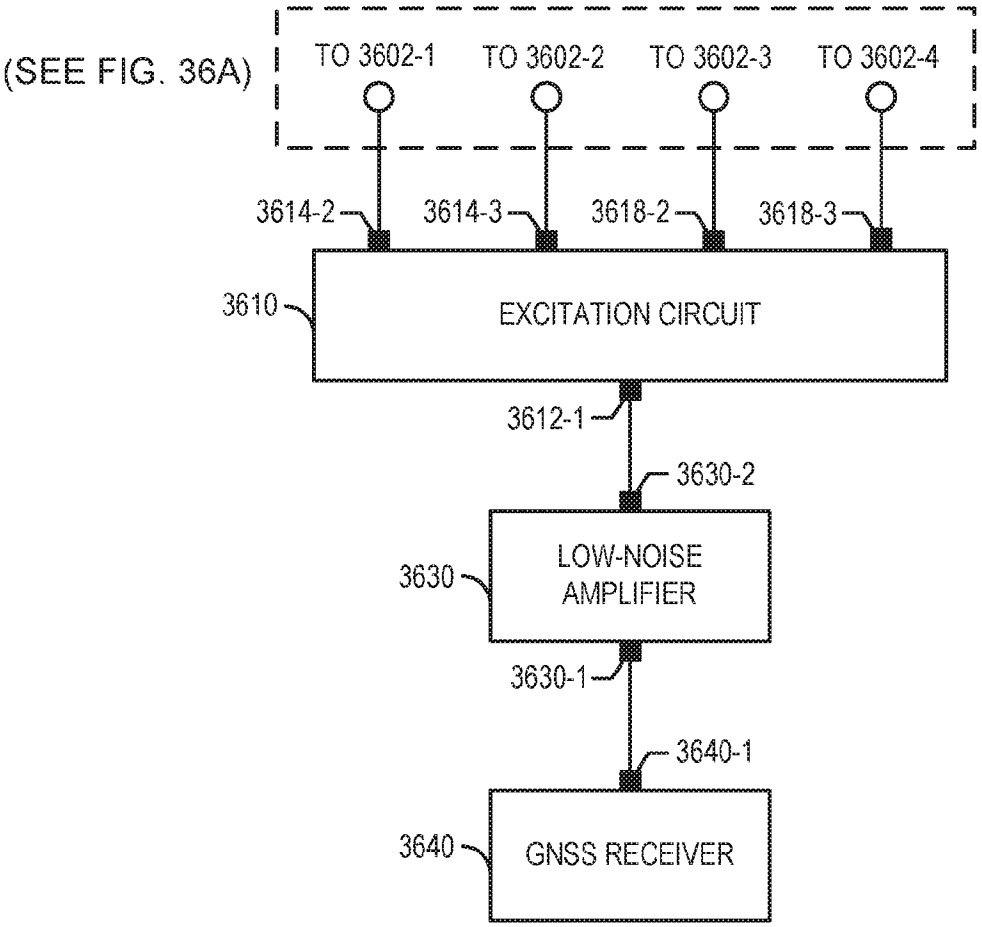
Figure 36C:
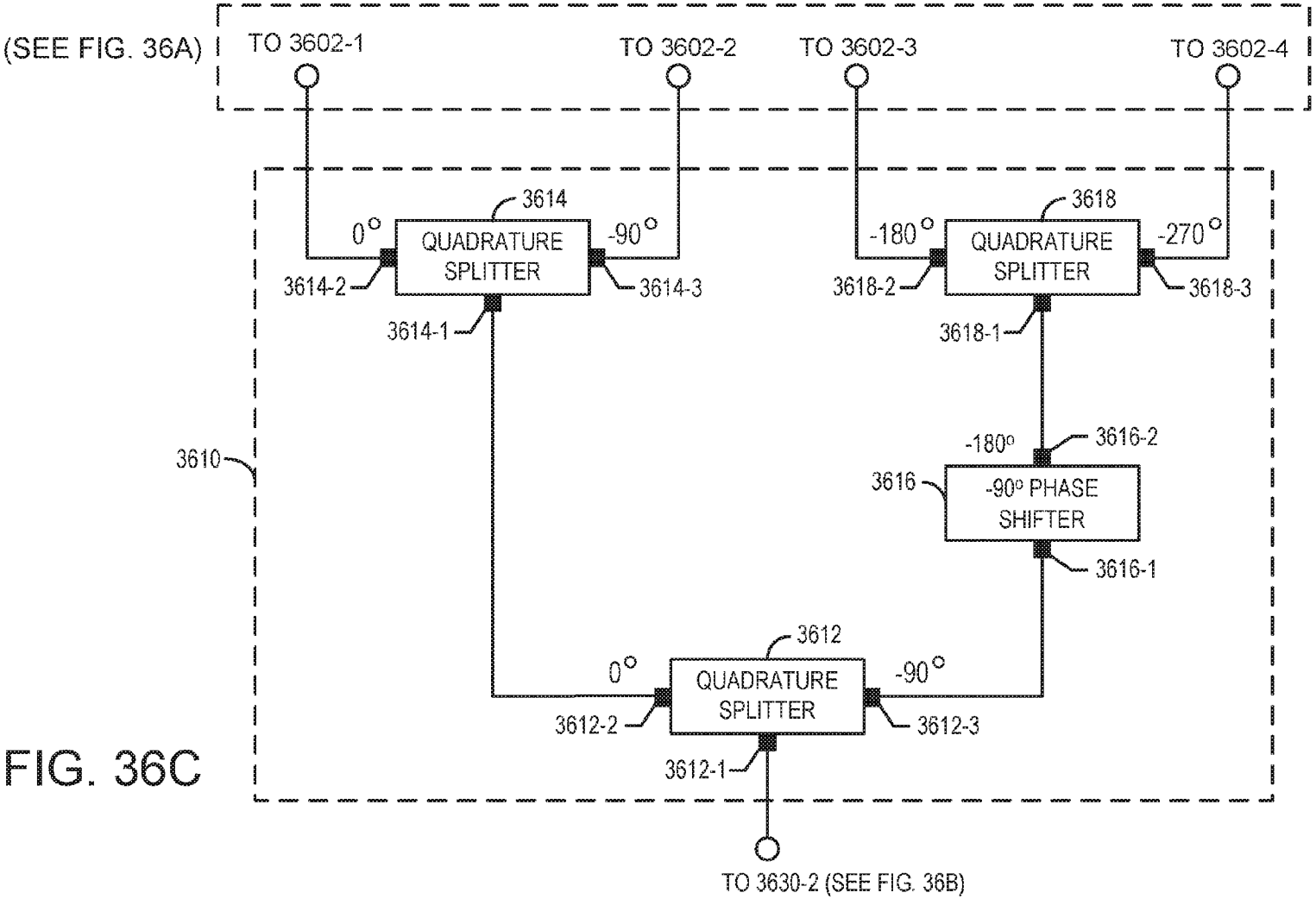

FIG. 36B and FIG. 36C show schematics of an embodiment of an excitation circuit 3610. Other embodiments of excitation circuits can be used. Refer to FIG. 36B. Described in the receive mode, the output port 3612-1 of the excitation circuit 3610 is electrically connected to the input port 3630-2 of the low-noise amplifier (LNA) 3630. The output port 3630-1 of the LNA 3630 is electrically connected to the input port 3640-1 of the GNSS receiver 3640.

The excitation circuit 3610 is shown schematically in FIG. 36C and described in the transmit mode. Refer to the quadrature splitter 3612. The input port 3612-1 is electrically connected to the port 3630-2 of the LNA 3630. With respect to the signal at the input port 3612-1, the signal at the output port 3612-2 is in-phase (0 deg phase shift), and the signal at the output port 3612-3 is phase shifted by −90 deg. The output port 3612-2 is electrically connected to the input port 3614-1 of the quadrature splitter 3614. With respect to the signal at the input port 3614-1, the signal at the output port 3614-2 is in-phase (0 deg phase shift), and the signal at the output port 3614-3 is phase shifted by −90 deg.

Return to the quadrature splitter 3612. The output port 3612-3 is electrically connected to the input port 3616-1 of the −90 deg phase shifter 3616. With respect to the signal at the input port 3616-1, the signal at the output port 3616-2 is phase shifted by −90 deg (net phase shift of −180 deg with respect to the signal at the input port 3612-1 of the quadrature splitter 3612). The output port 3616-2 is electrically connected to the input port 3618-1 of the quadrature splitter 3618. With respect to the signal at the input port 3618-1, the signal at the output port 3618-2 is in-phase (0 deg phase shift), and the signal at the output port 3618-3 is phase shifted by −90 deg.

Consequently, the output signals at port 3614-2, port 3614-3, port 3618-2, and port 3618-3 have net phase shifts of 0 deg, −90 deg, −180 deg, and −270 deg, respectively, with respect to the input signal at port 3612-1. These four ports are electrically connected to the excitation pin 3602-1, the excitation pin 3602-2, the excitation pin 3602-3, and the excitation pin 3602-4, respectively. Refer to FIG. 36A. Described in the transmit mode, excitation signals applied by the excitation pins 3602-1 to 3602-4 to the slots 902A to 902D, respectively, cause the slots to radiate excitation currents $I_{EX\,1}$ 3601, $I_{EX\,2}$ 3603, $I_{EX\,3}$ 3605, and $I_{EX\,4}$ 3607 in the directions shown. Right-hand circularly-polarized (RHCP) radiation is therefore excited.

Figure 36D:
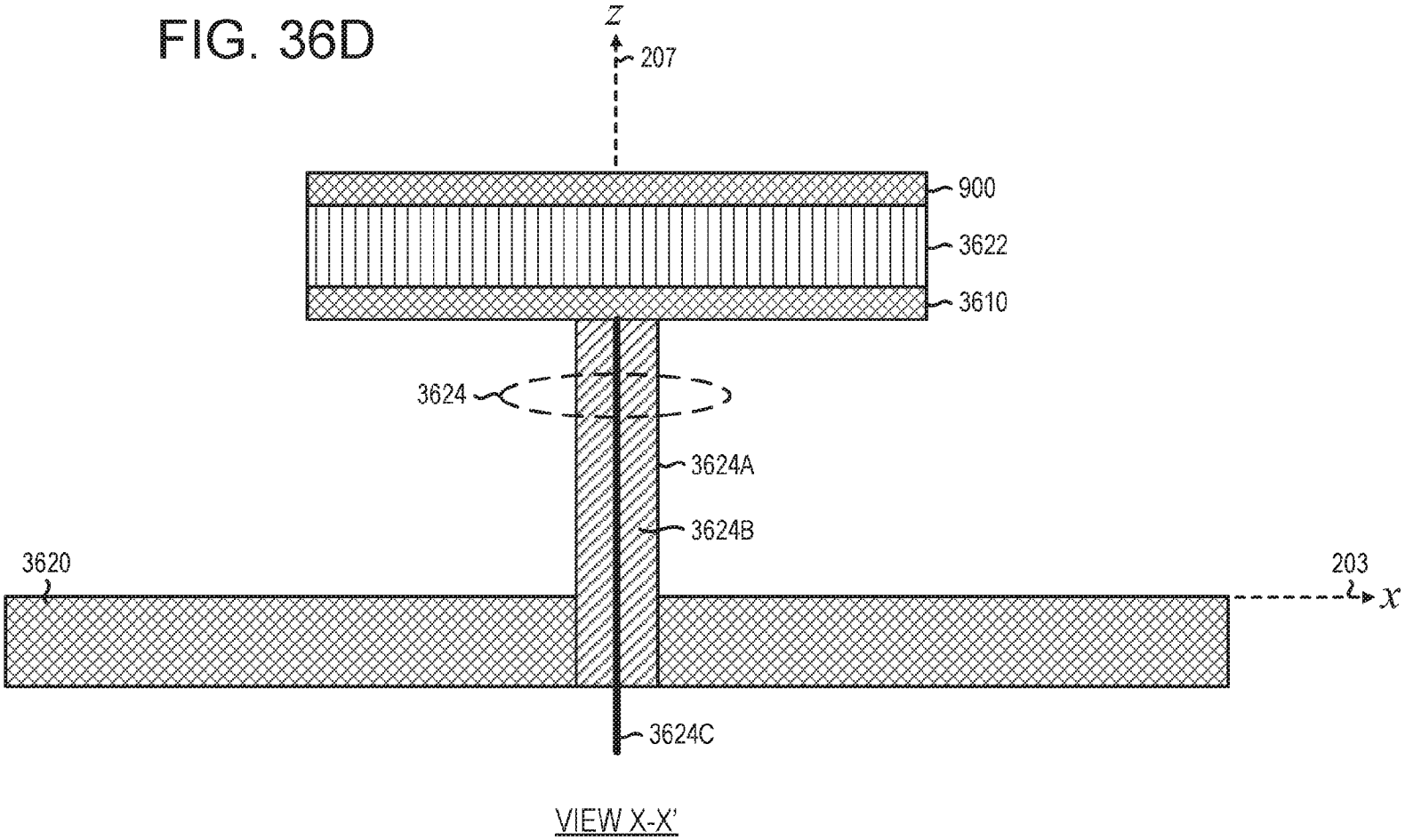

Refer to FIG. 36D, which shows a cross-sectional view (View X-X', sighted along the +y-axis; the plane of the View X-X' is the x-$z$ plane). To simplify the drawing, details such as the passive elements and dielectric posts, are not shown. In an embodiment, the excitation circuit 3610 is fabricated on the bottom side of the double-sided printed-circuit board (PCB) 3622; and the exciter 900 is fabricated on the top side of the PCB 3622. In another embodiment, the excitation circuit is fabricated on the top side of the PCB; and the exciter is fabricated on the bottom side of the PCB. A coax cable 3624 is routed orthogonal to the ground plane 3620 and the PCB 3622. The coax cable 3624 includes the outer shield 3624A, the dielectric insulation 3624B, and the center conductor 3624C. The coax cable 3624 is inserted through an opening in the ground plane 3620, and the outer shield 3624A is electrically connected to the ground plane 3620. The top end of the center conductor 3624C is electrically connected to the port 3612-1 of the excitation circuit 3610 (FIG. 36B). The bottom end of the center conductor 3624C is electrically connected to the port 3630-2 of the LNA 3630 (FIG. 36B). No signal current travels along the grounded shield 3624A. The signal current travelling along the center conductor 3624C is surrounded by the grounded shield 3624A and does not contribute to the radiation field.

Figures 35H, 35I:
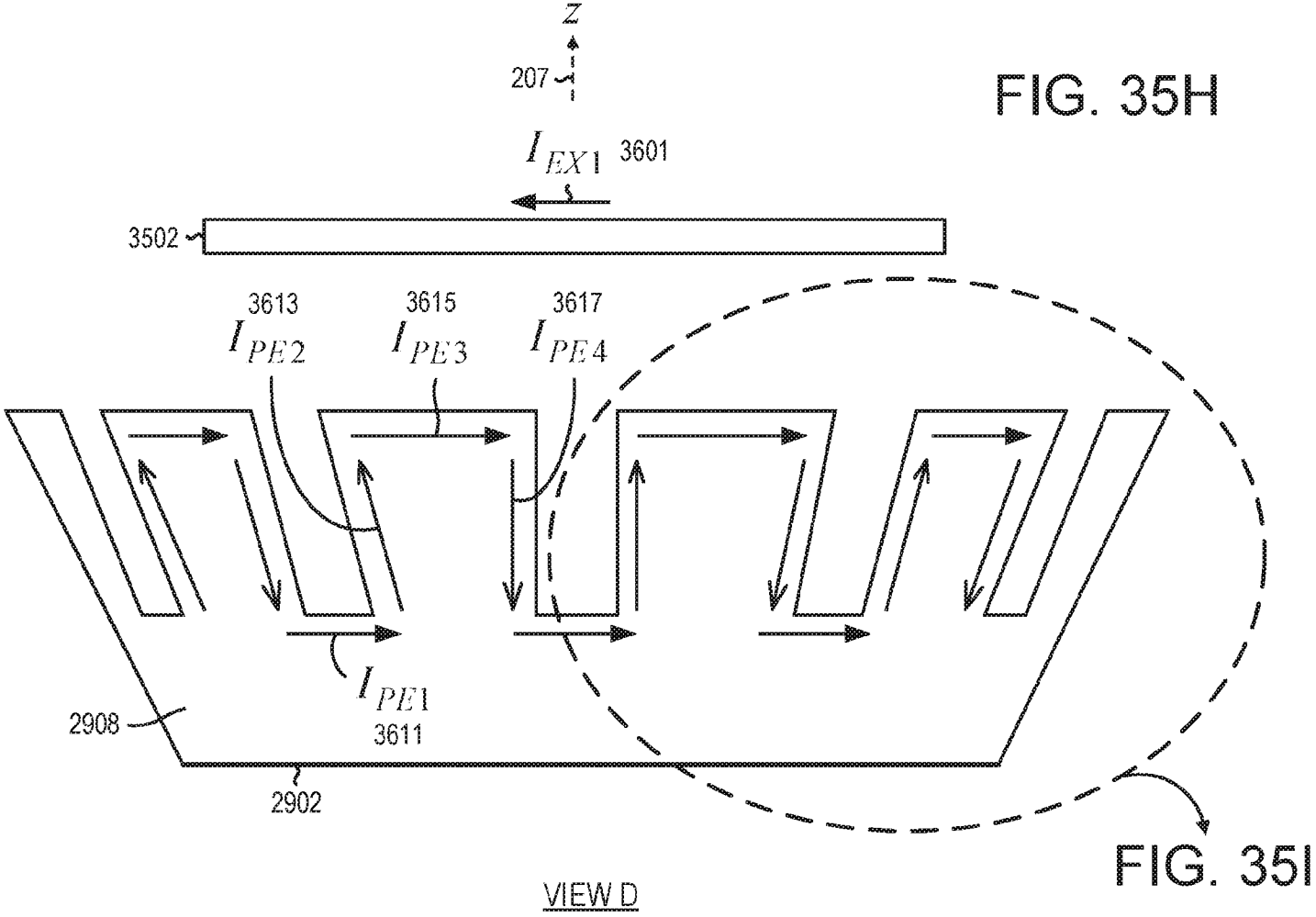
Figure 35I:
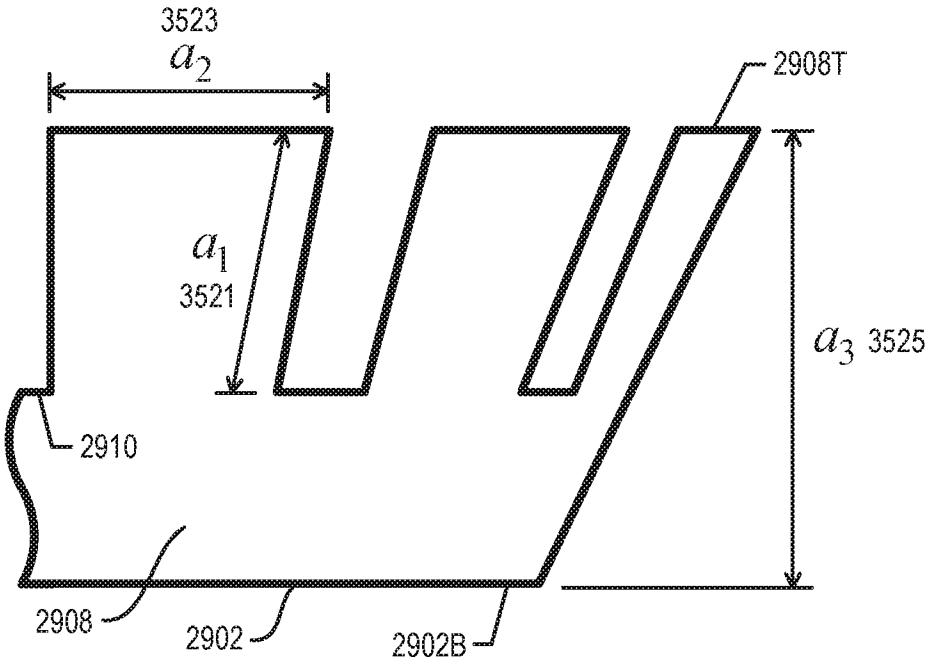

Refer to FIG. 35H, which shows a side view (View D, sighted along the +x-axis) of the assembly previously shown in FIG. 35A. Compared to FIG. 35A, the exciter 3502 has been raised to avoid obscuring detail. In the exciter 3502, the excitation currents flows only parallel to the x-y plane (see FIG. 36A). Shown in FIG. 35H is the excitation current $I_{EX\,1}$ 3601. The excitation currents induces currents in the set of passive elements. Shown are four representative induced current segments: $I_{PE1}$ 3611, $I_{PE2}$ 3613, $I_{PE3}$ 3615, and $I_{PE4}$ 3617. The current segment $I_{PE1}$ and the current segment $I_{PE3}$ flow parallel to the x-y plane in the opposite phase to the excited current $I_{EX\,1}$. The current segment $I_{PE2}$ and the current segment $I_{PE4}$ have major components orthogonal to the x-y plane and minor components parallel to the x-y plane.

The antenna can be modelled by a system of excitation sources, and the antenna pattern can be computed from Maxwell's equations. A simplified model is shown in FIG.

39A. More complex models can be used for specific antenna configurations. Shown are two isotropic excitation sources, source 1 3902 and source 2 3904. The two sources are disposed along the $z$-axis, with the source 1 disposed at $z=\Delta/2$ and the source 2 disposed at $z=-\Delta/2$. Let $j_1$ be the current density of source 1 and $j_2$ be the current density of source 2. Further, excite the sources such that $$\frac{j_1}{j_2} = -e^{-ik\Delta}. \tag{E7}$$

The antenna pattern is then given by $$F(\theta) = \frac{1 - e^{ik\Delta(\sin\theta+1)}}{\sin k\Delta}. \tag{E8}$$

Figure 39A:
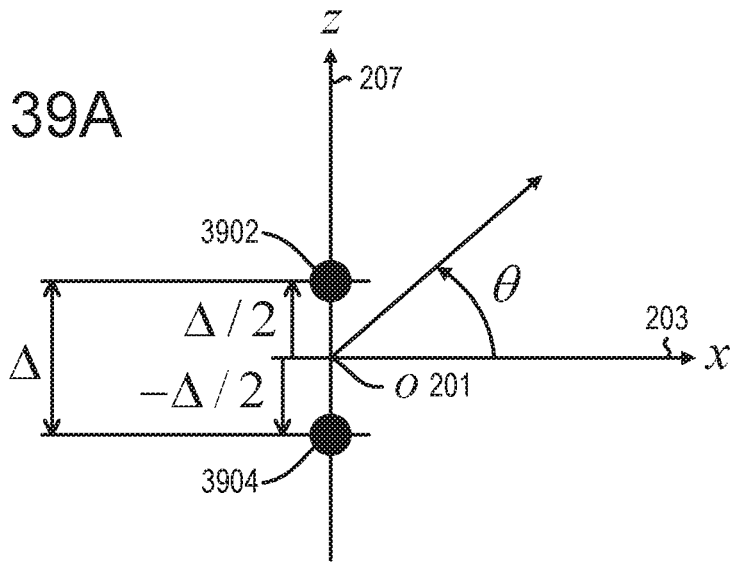
FIG. 39A shows a simplified model of an antenna.
Figure 39B:
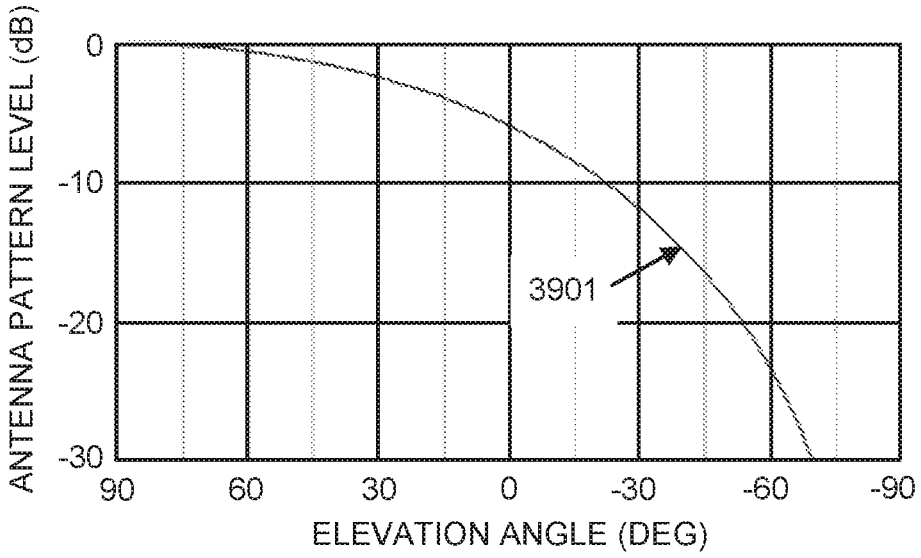
FIG. 39B shows a plot of antenna pattern level as a function of elevation angle.

At $\theta=-90°$, the antenna pattern is 0 due to the subtraction of the fields of the two sources. Refer to FIG. 39B. Plot 3901 shows the normalized antenna pattern level (dB) as a function of elevation angle $\theta$ for $\Delta=0.05\lambda$.

Refer to FIG. 35I, which shows a close-up view of a portion of the passive elements. Shown are the dimensions $a_1$ 3521, $a_2$ 3523, and $a_3$ 3525. Here, $a_1$ and $a_2$ represent values of arc lengths (for general curved surfaces) and $a_3$ represents a value of a linear length.

Examples of dimensions are provided below for embodiments of an antenna system configured to operate over the full GNSS frequency range: both the low-frequency band (about 1164 to about 1300 MHz) and the high-frequency band (about 1525 to about 1610 MHz). For operation optimized for narrower frequency bands, dimensions are appropriately adjusted.

- Exciter 1300 (FIG. 13A); side length $d_9$=about 75 mm
- Exciter 1400 (FIG. 14A); side length $d_0$=about 75 mm
- Auxiliary patches 1700-1, 1700-2, and 1700-3 (FIG. 17A); diameter $d_{12}$=about 65 mm
- Auxiliary patches 1800-1, 1800-2, and 1800-3 (FIG. 18A); side length $d_{13}$=about 65 mm
- Auxiliary patches 1900-1, 1900-2, and 1900-3 (FIG. 19A); distance $d_{14}$=about 65 mm
- Spacing between exciter and auxiliary patch (FIG. 16B), distance $s_1$=about 3 mm to about 15 mm
- Ground plane 500-1 (FIG. 5A); diameter $d_1$=about 120 mm to about 180 mm
- Passive elements
  - Configuration: truncated conical shell electrically connected to ground plane (FIG. 29)
  - Number of passive elements=8 or more
  - Inside diameter of truncated conical shell at top face (FIG. 29), $d_{48}$=about 136 mm to about 160 mm
  - Width of passive element (FIG. 35I), $a_2$=about 5 mm to about 40 mm
  - Length of passive element (FIG. 35I), $a_1$=about 18 mm to about 35 mm
  - Height of passive element (FIG. 35I), $a_3$=about 30 mm to about 45 mm.

Figure 37A:
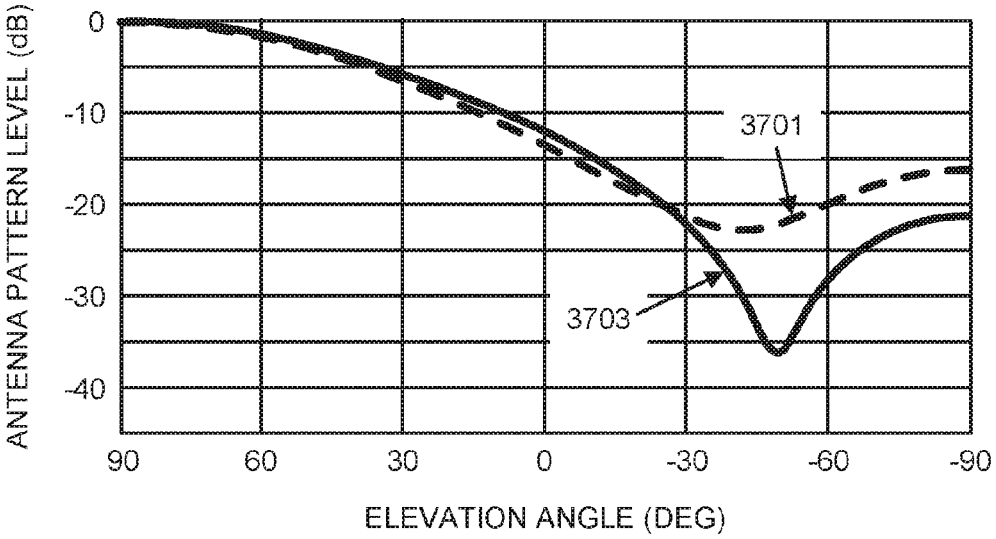
FIG. 37A and FIG. 37B show plots of antenna pattern level as a function of elevation angle.
Figure 37B:
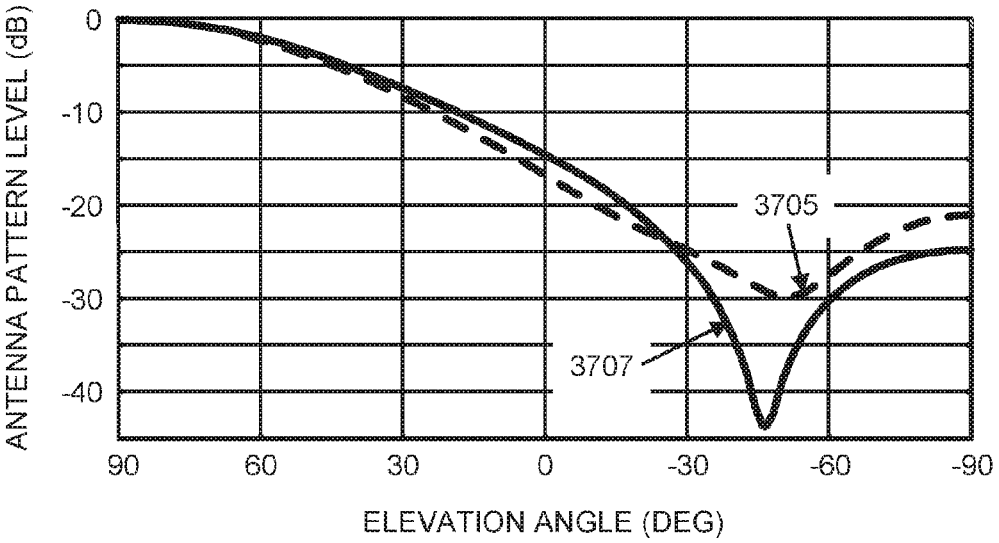

FIG. 37A and FIG. 37B shows the effects of the passive elements on the antenna pattern levels, for the antenna shown in FIG. 35A. In the plots, the horizontal axis represents the elevation angle (dB), and the vertical axis represents the normalized antenna pattern level. FIG. 37A shows the measurements at a frequency of 1227 MHz. Plot 3701 shows the measurements without grooves in the sidewall; plot 3703 shows the measurements with grooves in the sidewall. FIG. 37B shows the measurements at a frequency of 1575 MHz. Plot 3705 shows the measurements without grooves in the sidewall; plot 3707 shows the measurements with grooves in the sidewall. The presence of grooves in the sidewall strongly reduces multipath reception.

Figure 40A:
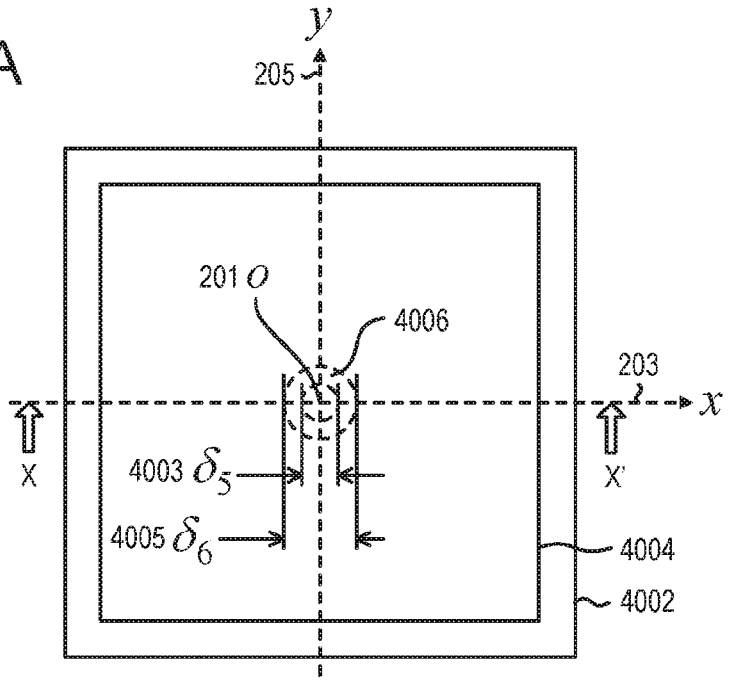
FIG. 40A and FIG. 40B show schematics of an auxiliary patch supported above an exciter by a conductive post.
Figure 40B:
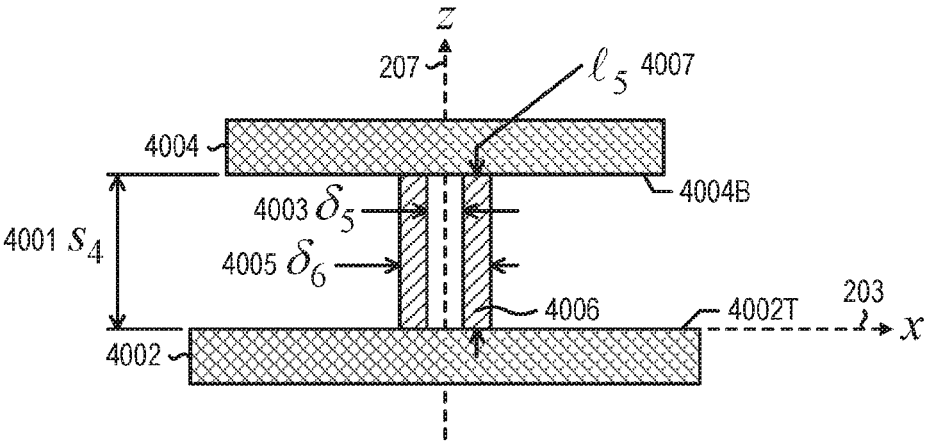

In previously described embodiments, the auxiliary patch was supported above the exciter by one or more thin dielectric posts (see, for example, FIG. 16A, FIG. 16B, and FIG. 35G). In other embodiments, a thin conductive post (for example, fabricated from metal) is used for support. The thin conductive post can be used by itself or in combination with one or more thin dielectric posts. The conductive post is disposed orthogonal to the auxiliary patch and the exciter at the center of the auxiliary patch and the exciter such that no current flows orthogonal to the auxiliary patch and the exciter along the conductive post. Refer to FIG. 40A and FIG. 40B. FIG. 40A shows a top view (View A, sighted along the $-z$-axis), and FIG. 40B shows a cross-sectional view (View X-X', sighted along the +y-axis; the plane of the View X-X' is the x-$z$ plane) of the exciter 4002, the auxiliary patch 4004, and the conductive post 4006. The exciter 4002 has the geometry of a square; in general, the exciter can have any one of the geometries previously described above. Similarly, the auxiliary patch 4004 has the geometry of a square; in general, the auxiliary patch can have any one of the geometries previously described above.

In an advantageous embodiment, the conductive post 4006 has the geometry of a cylindrical tube, with an inner diameter $\delta_5$ 4003, an outer diameter $\delta_6$ 4005, and a length $l_5$ 4007. The length $l_5$ 4007 is equal to $s_4$ 4001, the distance between the top surface 4002T of the exciter 4002 and the bottom surface 4004B of the auxiliary patch 4004, measured along the $z$-axis. The values of the dimensions are design values. The conductive post, for example, can be the outer shield of a rigid coax cable; signals or power can be carried along the center conductor (not shown) of the coax cable.

Figure 41A:
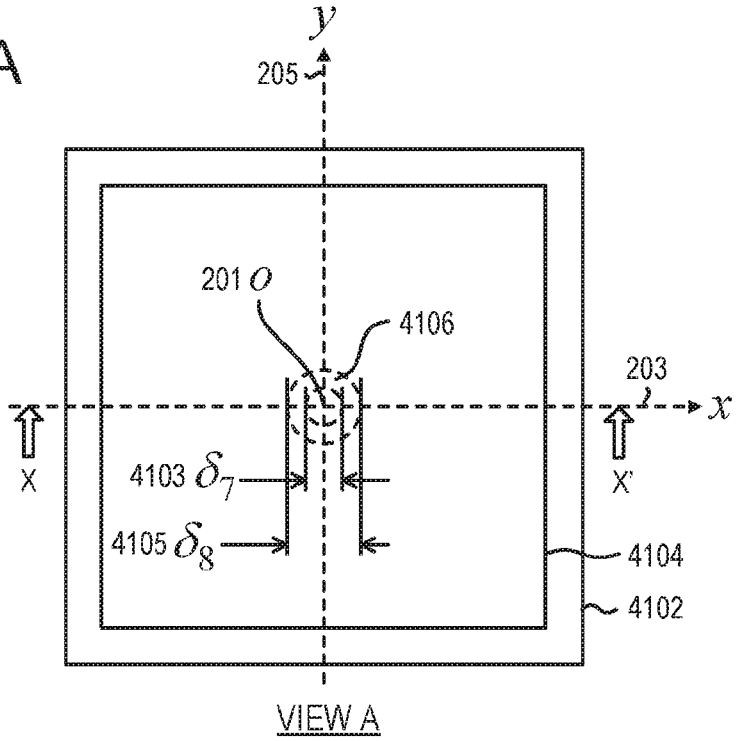
FIG. 41A and FIG. 41B show schematics of an exciter supported above a ground plane by a conductive post.
Figure 41B:
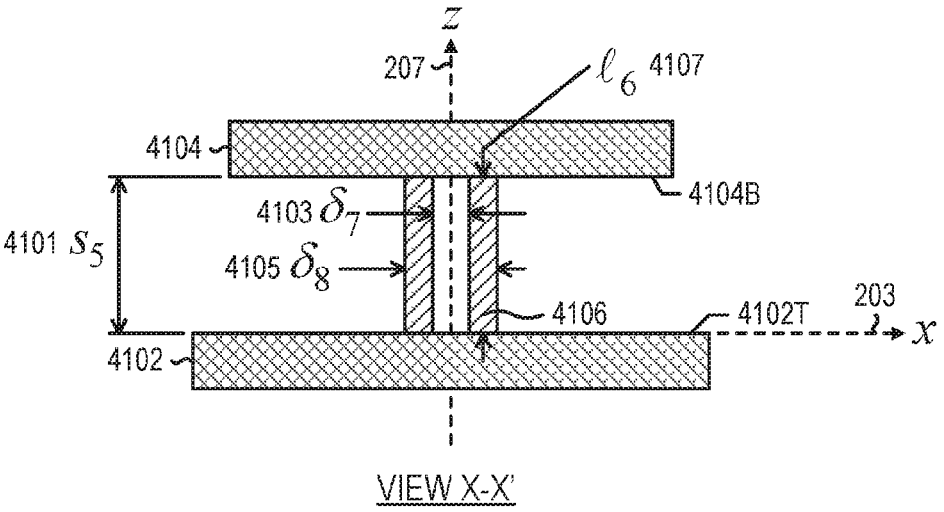

In previously described embodiments, the exciter was supported above the ground plane by one or more thin dielectric posts (see, for example, FIG. 35F and FIG. 35G). In other embodiments, a thin conductive post (for example, fabricated from metal) is used for support. The thin conductive post can be used by itself or in combination with one or more thin dielectric posts. The conductive post is disposed orthogonal to the exciter and the ground plane at the center of the exciter and the ground plane such that no current flows orthogonal to the exciter and the ground plane along the conductive post. Refer to FIG. 41A and FIG. 41B. FIG. 41A shows a top view (View A, sighted along the $-z$-axis), and FIG. 41B shows a cross-sectional view (View X-X', sighted along the +y-axis; the plane of the View X-X' is the x-$z$ plane) of the ground plane 4102, the exciter 4104, and the conductive post 4106. The ground plane 4102 has the geometry of a square; in general, the ground plane can have any one of the geometries previously described above. Similarly, the exciter 4104 has the geometry of a square; in general, the auxiliary patch can have any one of the geometries previously described above.

In an advantageous embodiment, the conductive post 4106 has the geometry of a cylindrical tube, with an inner diameter $\delta_7$ 4103, an outer diameter $\delta_8$ 4105, and a length $l_6$ 4107. The length $l_6$ 4107 is equal to $s_5$ 4101, the distance between the top surface 4102T of the ground plane 4102 and the bottom surface 4104B of the exciter 4104, measured along the $z$-axis. The values of the dimensions are design values. The conductive post, for example, can be the outer shield of a rigid coax cable; signals or power can be carried along the center conductor (not shown) of the coax cable.

The support structure supporting the auxiliary patch above the exciter is independent of the support structure supporting the exciter above the ground plane. The two support structures can be similar or different. Examples of combinations of support structures include the following: (a) The auxiliary patch is supported above the exciter by one or more dielectric posts. The exciter is supported above the ground plane by one or more dielectric posts. (b) The auxiliary patch is supported above the exciter by a conductive post. The exciter is supported above the ground plane by a conductive post. (c) The auxiliary patch is supported above the exciter by one or more dielectric posts. The exciter is supported above the ground plane by a conductive post. (d) The auxiliary patch is supported above the exciter by a conductive post. The exciter is supported above the ground plane by one or more dielectric posts.

Figure 42A:
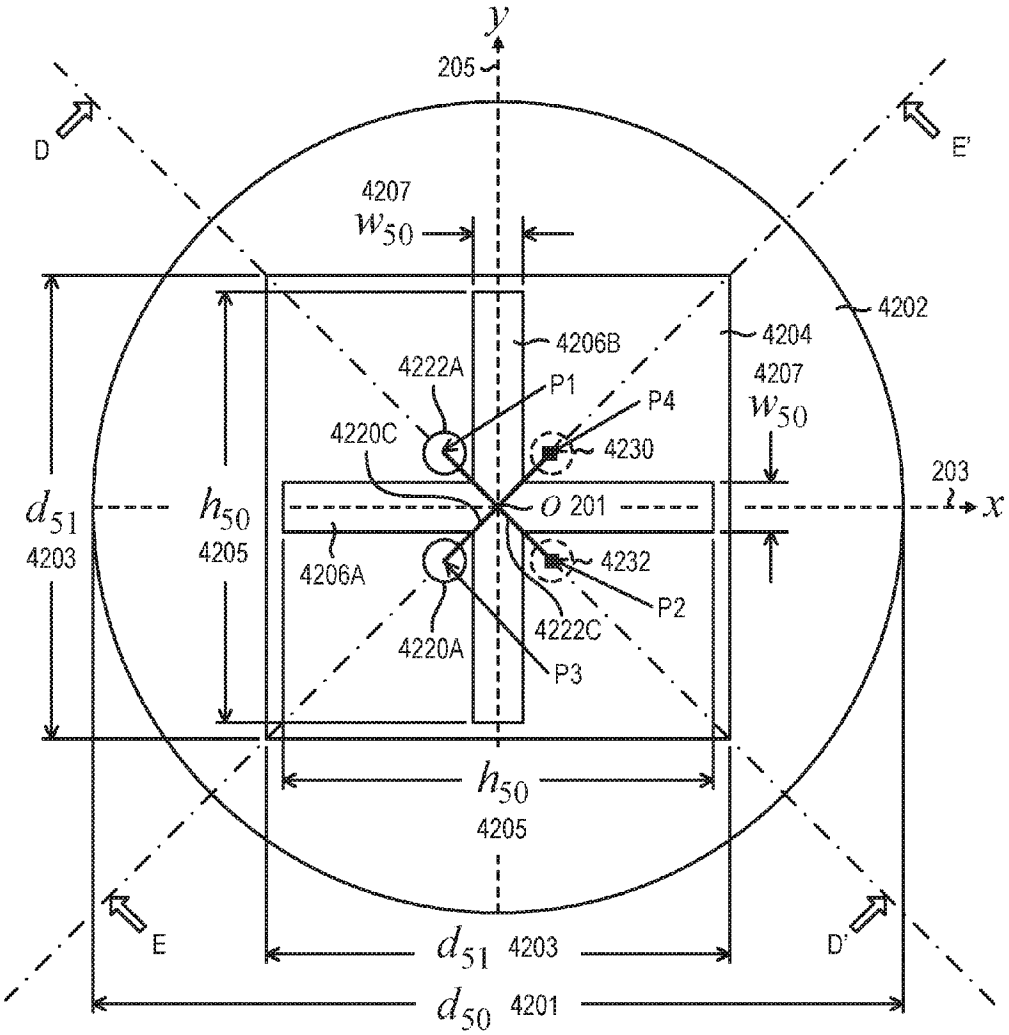
FIG. 42A-FIG. 42C show schematics of an embodiment of an exciter and a ground plane.

In the embodiments of exciters described above, the exciters included four slots. In other embodiments of exciters, the exciter includes two slots. Refer to FIG. 42A. FIG. 42A shows a top view (View A) of the ground plane 4202 and the exciter 4204. The ground plane 4202 has the geometry of a circle, with a diameter $d_{50}$ 4201. The exciter 4204 has the geometry of a square, with a side length $d_{51}$ 4203. The exciter 4204 includes two slots, slot 4206A and slot 4206B, which are oriented perpendicular to each other and which intersect each other at the center of the square. Each slot has a length $h_{50}$ 4205 (where $h_{50}<d_{51}$) and a width $w_{50}$ 4207.

In general, the slots can have other geometries (for example, widened ends). In general, the exciter can have other geometries (for example, a circle) with four-fold azimuthal symmetry about the $z$-axis.

Figure 42B:
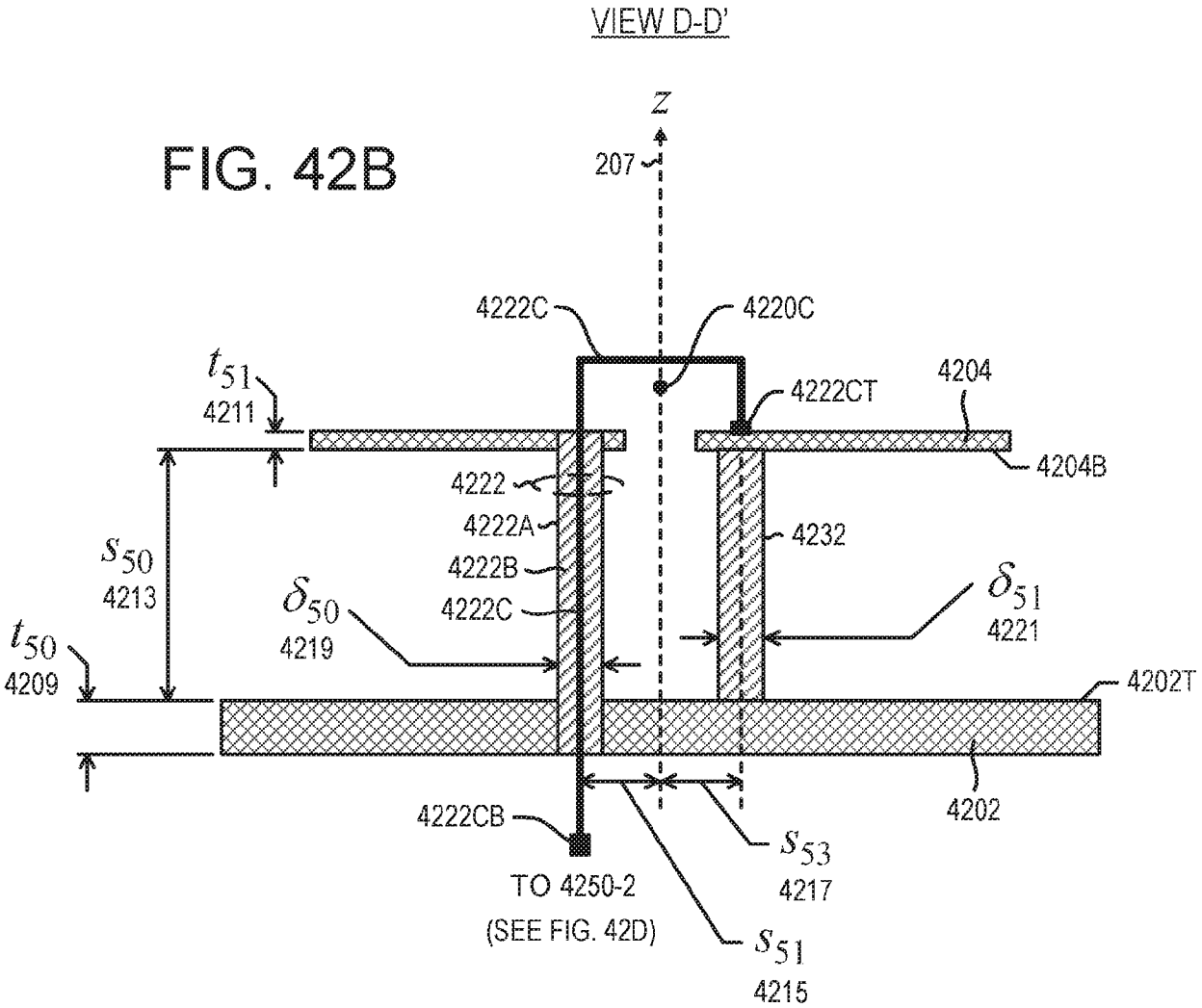
Figure 42C:
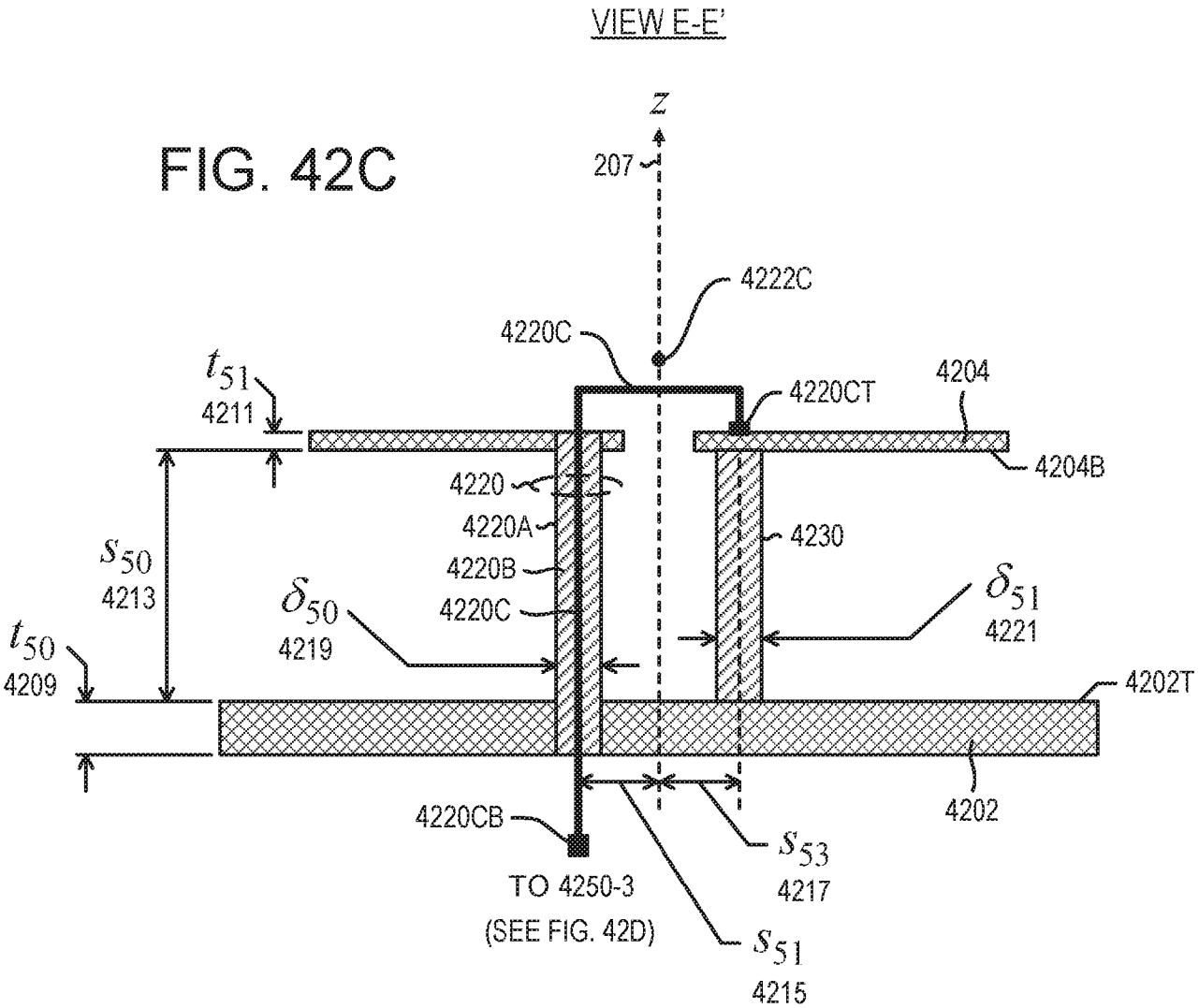

Note: FIG. 42A-FIG. 42C highlight an embodiment of an exciter with two slots and a ground plane. To simplify the figures, other features are not shown. For an antenna system, a set of passive elements, as described above, is included. An auxiliary patch, as described above, can also be included.

In general, the ground plane can have other geometries, and the exciter can have other geometries, as described above. In general, the ground plane can be fabricated from a solid conductive material, such as sheet metal, or can be fabricated from a thin film of a solid conductive material, such as metal, disposed on a dielectric substrate, such as a printed circuit board (PCB). In general, the exciter can be fabricated from a solid conductive material, such as sheet metal, or can be fabricated from a thin film of a solid conductive material, such as metal, disposed on a dielectric substrate, such as a PCB.

Refer to FIG. 42B. FIG. 42B shows a cross-sectional view (View D-D'). View D-D' is orthogonal to View A; the cross-section is taken along the diagonal line D-D' shown in FIG. 42A. The ground plane 4202 has a thickness $t_{50}$ 4209, measured along the $z$-axis. The exciter 4204 has a thickness $t_{51}$ 4211. The distance between the top surface 4202T of the ground plane 4202 and the bottom surface 4204B of the exciter 4204 is the distance $s_{50}$ 4213, measured along the $z$-axis.

A coax cable 4222 is routed orthogonal to the ground plane 4202 and the exciter 4204. The coax cable 4222 includes the outer shield 4222A, the dielectric insulation 4222B, and the center conductor 4222C. The coax cable 4222 is inserted through an opening in the ground plane 4202 and through an opening in the exciter 4204. The bottom end of the outer shield 4222A is electrically connected to the ground plane 4202. The top end of the outer shield 4222A is electrically connected to the exciter 4204. The top end of the center conductor 4222C emerges from the exciter at the position shown (position P1) and crosses diagonally over the central region of the exciter (see also FIG. 42A). The tip 4222CT of the center conductor 4222C is electrically connected to the exciter at the position shown (position P2) such that the distance $s_{51}$ 4215 between the central axis of the coax cable 4222 and the $z$-axis is equal to the distance $s_{53}$ 4217 between the tip 4222CT and the $z$-axis; the distance $s_{51}$ and the distance $s_{53}$ are measured orthogonal to the $z$-axis. Position P2 is diagonally opposite position P1.

To provide a symmetric antenna pattern about the $z$-axis, a conductor 4232 is electrically connected between the ground plane 4202 and the exciter 4204. The conductor 4232, for example, can be a conductive post with a top face electrically connected to the exciter and a bottom face electrically connected to the ground plane; the longitudinal axis of the conductive post is parallel to the $z$-axis (orthogonal to the exciter and ground plane). A reference axis parallel to the $z$-axis passes through the position of the tip 4222CT and passes through the conductor 4232 (for example, passes through the center of the top face of a conductive post). The diameter of the outer shield 4222A of the coax cable 4222 is $\delta_{50}$ 4219. The diameter of the conductor 4232 is $\delta_{51}$ 4221. The diameter $\delta_{50}$ is equal to the diameter $\delta_{51}$.

Refer to FIG. 42C. FIG. 42C shows a cross-sectional view (View E-E'). View E-E' is orthogonal to View A; the cross-section is taken along the diagonal line E-E' shown in FIG. 42A.

A coax cable 4220 is routed orthogonal to the ground plane 4202 and the exciter 4204. The coax cable 4220 includes the outer shield 4220A, the dielectric insulation 4220B, and the center conductor 4220C. The coax cable 4220 is inserted through an opening in the ground plane 4202 and through an opening in the exciter 4204. The bottom end of the outer shield 4220A is electrically connected to the ground plane 4202. The top end of the outer shield 4220A is electrically connected to the exciter 4204. The top end of the center conductor 4220C emerges from the exciter at the position shown (position P3) and crosses diagonally over the central region of the exciter (see also FIG. 42A). Position P3 is opposite position P1 across the x-axis; and position P3 is opposite position P2 across the y-axis. The tip 4220CT of the center conductor 4220C is electrically connected to the exciter at the position shown (position P4) such that the distance $s_{51}$ 4215 between the central axis of the coax cable 4220 and the $z$-axis is equal to the distance $s_{53}$ 4217 between the tip 4220CT and the $z$-axis; the distance $s_{51}$ and the distance $s_{53}$ are measured orthogonal to the $z$-axis. Position P4 is diagonally opposite position P3. The distance $s_{51}$ and the distance $s_{53}$ shown in FIG. 42C are equal to those shown in FIG. 42B. As shown in FIG. 42B and FIG. 42C, the center conductor 4220C and the center conductor 4222C are separated vertically along the $z$-axis and do not touch where they cross over in the central region. In the embodiment shown, the center conductor 4222C is above the center conductor 4220C; however, the center conductor 4222C can be below the center conductor 4220C.

To provide a symmetric antenna pattern about the $z$-axis, a conductor 4230 is electrically connected between the ground plane 4202 and the exciter 4204. The conductor 4230, for example, can be a conductive post with a top face electrically connected to the exciter and a bottom face electrically connected to the ground plane; the longitudinal axis of the conductive post is parallel to the $z$-axis (orthogonal to the exciter and ground plane). A reference axis parallel to the $z$-axis passes through the position of the tip 4220CT and passes through the conductor 4230 (for example, passes through the center of the top face of a conductive post). The diameter of the outer shield 4220A of the coax cable 4220 is $\delta_{50}$ 4219. The diameter of the conductor 4230 is $\delta_{51}$ 4221. The diameter $\delta_{50}$ and the diameter $\delta_{51}$ shown in FIG. 42C are equal to those shown in FIG. 42B. The diameter $\delta_{50}$ is equal to the diameter $\delta_{51}$.

In the embodiment shown, the exciter 4204 is supported above the ground plane by the coax cable 4220, the coax cable 4222, the conductor 4230, and the conductor 4232. Additional dielectric support posts can be used.

Figure 42D:
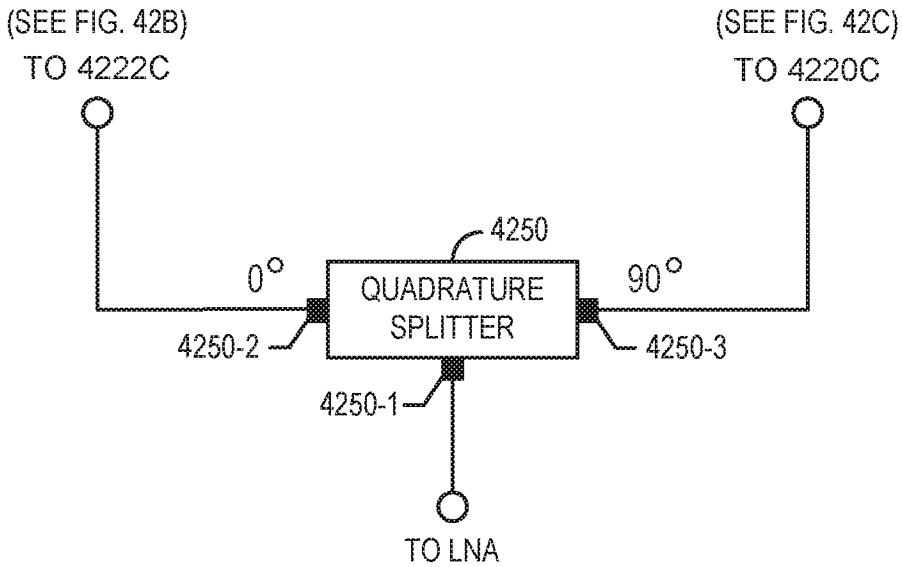
FIG. 42D shows a schematic of an embodiment of an excitation circuit.

Refer to FIG. 42D. FIG. 42D shows a schematic of an embodiment of an excitation circuit for the exciter shown in FIG. 42A-FIG. 42C. Other embodiments of an excitation circuit can be used. The excitation circuit is described in the transmit mode. Refer to the quadrature splitter 4250. The input port 4250-1 is electrically connected to an LNA (not shown). With respect to the signal at the input port 4250-1, the signal at the output port 4250-2 is in-phase (0 deg phase shift), and the signal at the output port 4250-3 is phase shifted by 90 deg. The output port 4250-2 is electrically connected to the bottom end 4222CB of the center conductor 4222C (FIG. 42B). The output port 4250-3 is electrically connected to the bottom end 4220CB of the center conductor 4220C (FIG. 42C). The excitation circuit excites RHCP radiation in the exciter 4204. In an embodiment, the ground plane 4202 is fabricated on the top metallization of a double-sided PCB, and the excitation circuit is fabricated on the bottom metallization.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. An antenna having a longitudinal axis, the antenna comprising:
- a planar ground plane, wherein the planar ground plane is disposed orthogonal to the longitudinal axis;
- a planar exciter, wherein:
  - the planar exciter is disposed orthogonal to the longitudinal axis;
  - the planar exciter is spaced apart from the ground plane;
  - the planar exciter is configured to excite right-hand circularly-polarized electromagnetic radiation;
  - the planar exciter is configured to excite first currents orthogonal to the longitudinal axis; and
  - the planar exciter is configured to excite substantially no current parallel to the longitudinal axis; and
- a plurality of passive elements, wherein:
  - the plurality of passive elements is symmetrically disposed azimuthally about the longitudinal axis;
  - the plurality of passive elements is spaced apart from the planar exciter;
  - the plurality of passive elements is electromagnetically coupled to the planar exciter; and
  - the plurality of passive elements is configured to excite second currents parallel to the longitudinal axis and third currents orthogonal to the longitudinal axis.

2. The antenna of claim 1, wherein the antenna is configured to operate with global navigation satellite signals having frequencies in at least one frequency range selected from the group consisting of:
- a first frequency range from about 1164 to about 1300 MHz; and
- a second frequency range from about 1525 to about 1610 MHz.

3. The antenna of claim 1, wherein the planar ground plane has a geometry of:
- a circle; or
- a regular polygon with four or more sides.

4. The antenna of claim 1, wherein the planar exciter has four-fold symmetry about the longitudinal axis.

5. The antenna of claim 1, wherein the number of passive elements in the plurality of passive elements is eight or more.

6. The antenna of claim 1, wherein:
- the planar ground plane is fabricated from:
  - a first solid conductive material; or
  - a first thin film of a first solid conductive material disposed on a surface of a first dielectric substrate; and
- the planar exciter is fabricated from:
  - a second solid conductive material; or
  - a second thin film of a second solid conductive material disposed on a surface of a second dielectric substrate.

7. The antenna of claim 1, further comprising a planar auxiliary patch, wherein:
- the planar auxiliary patch is disposed orthogonal to the longitudinal axis;
- the planar auxiliary patch is spaced apart from the planar exciter;
- the planar auxiliary patch is spaced apart from the planar ground plane;
- the planar auxiliary patch is disposed such that the planar exciter is disposed between the planar auxiliary patch and the planar ground plane;
- the planar auxiliary patch is electromagnetically coupled to the planar exciter;
- the planar auxiliary patch is configured to excite fourth currents orthogonal to the longitudinal axis; and
- the planar auxiliary patch is configured to excite substantially no current parallel to the longitudinal axis.

8. The antenna of claim 7, wherein the planar auxiliary patch has four-fold symmetry about the longitudinal axis.

9. The antenna of claim 7, wherein the planar auxiliary patch is fabricated from:
- a conductive solid material; or
- a thin film of a conductive solid material disposed on a surface of a dielectric substrate.

10. The antenna of claim 1, wherein:
- the antenna further comprises a plurality of dielectric posts;
- each of the passive elements in the plurality of passive elements is separated from another passive element in the plurality of passive elements; and
- each of the passive elements in the plurality of passive elements is attached to the ground plane by a corresponding dielectric post in the plurality of dielectric posts.

11. The antenna of claim 10, wherein the plurality of passive elements is not electrically connected to the ground plane.

12. The antenna of claim 10, wherein the plurality of passive elements is electrically connected to the ground plane.

13. The antenna of claim 1, wherein:

the antenna further comprises a hollow dielectric substrate disposed about the longitudinal axis;

each of the passive elements in the plurality of passive elements is separated from another passive element in the plurality of passive elements; and the plurality of passive elements are disposed on a surface of the hollow dielectric substrate.

14. The antenna of claim 13, wherein the plurality of passive elements is not electrically connected to the ground plane.

15. The antenna of claim 13, wherein the plurality of passive elements is electrically connected to the ground plane.

16. The antenna of claim 1, wherein:

the antenna further comprises a conductive sidewall disposed about the longitudinal axis;

the conductive sidewall has a first face and a second face;

the first face is electrically connected to the ground plane; and a plurality of grooves is disposed along the second face to form the plurality of passive elements, wherein the plurality of grooves is symmetrically disposed about the longitudinal axis.

17. The antenna of claim 1, wherein the exciter comprises:

a plurality of four slots, wherein the plurality of four slots comprises a first slot, a second slot, a third slot, and a fourth slot symmetrically disposed azimuthally about the longitudinal axis; and a plurality of four excitation pins, wherein the plurality of four excitation pins comprises:

a first excitation pin electrically connected across the first slot;

a second excitation pin electrically connected across the second slot;

a third excitation pin electrically connected across the third slot; and a fourth excitation pin electrically connected across the fourth slot.

18. The antenna of claim 17, wherein the plurality of excitation pins are electrically connected to an excitation circuit configured to excite right-hand circularly-polarized electromagnetic radiation.

19. The antenna of claim 1, wherein:

the exciter comprises a first slot and a second slot, wherein:

the first slot is disposed along a first lateral axis;

the second slot is disposed along a second lateral axis;

the first lateral axis is perpendicular to the second lateral axis; and the first lateral axis and the second lateral axis are orthogonal to the longitudinal axis;

the antenna further comprises a first coax cable, wherein:

the first coax cable comprises an outer shield and an inner conductor;

the outer shield of the first coax cable has a first end and a second end;

the inner conductor of the first coax cable has a first end and a second end, wherein the first end of the inner conductor of the first coax cable corresponds to the first end of the outer shield of the first coax cable and the second end of the inner conductor of the first coax cable corresponds to the second end of the outer shield of the first coax cable;

the first coax cable is disposed between the exciter and the ground plane;

the first coax cable is disposed orthogonal to the exciter and orthogonal to the ground plane;

the first coax cable passes through a first opening in the ground plane and a second opening in the exciter;

the first end of the outer shield of the first coax cable is electrically connected to the ground plane;

the second end of the outer shield of the first coax cable is electrically connected to the exciter;

the inner conductor of the first coax cable emerges from the exciter at a first position; and the second end of the inner conductor of the first coax cable is electrically connected to the exciter at a second position, wherein the second position is diagonally opposite the first position;

the antenna further comprises a second coax cable, wherein:

the second coax cable comprises an outer shield and an inner conductor;

the outer shield of the second coax cable has a first end and a second end;

the inner conductor of the second coax cable has a first end and a second end, wherein the first end of the inner conductor of the second coax cable corresponds to the first end of the outer shield of the second coax cable and the second end of the inner conductor of the second coax cable corresponds to the second end of the outer shield of the second coax cable;

the second coax cable is disposed between the exciter and the ground plane;

the second coax cable is disposed orthogonal to the exciter and orthogonal to the ground plane;

the second coax cable passes through a third opening in the ground plane and a fourth opening in the exciter;

the first end of the outer shield of the second coax cable is electrically connected to the ground plane;

the second end of the outer shield of the second coax cable is electrically connected to the exciter;

the inner conductor of the second coax cable emerges from the exciter at a third position;

the third position is opposite the first position across the first lateral axis and opposite the second position across the second lateral axis; and the second end of the inner conductor of the second coax cable is electrically connected to the exciter at a fourth position, wherein the fourth position is diagonally opposite the third position;

the antenna further comprises a first conductive post, wherein:

the first conductive post has a first face and a second face;

the first conductive post is disposed between the exciter and the ground plane;

the first conductive post is disposed orthogonal to the exciter and orthogonal to the ground plane;

the second face of the first conductive post is disposed such that a first reference axis parallel to the longitudinal axis and passing through the second position passes through the second face of the first conductive post;

the first face of the first conductive post is electrically connected to the ground plane; and the second face of the first conductive post is electrically connected to the exciter; and the antenna further comprises a second conductive post, wherein:

the second conductive post has a first face and a second face;

the second conductive post is disposed between the exciter and the ground plane;

the second conductive post is disposed orthogonal to the exciter and orthogonal to the ground plane;

the second face of the second conductive post is disposed such that a second reference axis parallel to the longitudinal axis and passing through the fourth position passes through the second face of the second conductive post;

the first face of the second conductive post is electrically connected to the ground plane; and the second face of the second conductive post is electrically connected to the exciter.

20. The antenna of claim 19, wherein the first end of the inner conductor of the first coax cable and the first end of the inner conductor of the second coax cable are electrically connected to an excitation circuit configured to excite right-hand circularly-polarized electromagnetic radiation.

* * * * *